US007292811B2

(12) United States Patent
Ban et al.

(10) Patent No.: US 7,292,811 B2
(45) Date of Patent: Nov. 6, 2007

(54) TONER SUPPLYING CONTAINER AND IMAGE FORMING APPARATUS

(75) Inventors: Yutaka Ban, Tokyo (JP); Tatsuya Goto, Numazu (JP); Fumio Tazawa, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/700,825

(22) Filed: Nov. 5, 2003

(65) Prior Publication Data

US 2004/0161266 A1 Aug. 19, 2004

Related U.S. Application Data

(62) Division of application No. 09/536,303, filed on Mar. 27, 2000, now Pat. No. 6,766,133.

(30) Foreign Application Priority Data

Mar. 29, 1999 (JP) ..... 11-085478

(51) Int. Cl.
*G03G 15/08* (2006.01)

(52) U.S. Cl. ..... 399/258

(58) Field of Classification Search ..... 399/258, 399/260, 262

See application file for complete search history.

(56) References Cited

U.S. PATENT DOCUMENTS

| | | | | |
|---|---|---|---|---|
| 5,268,722 A | | 12/1993 | Ikkatai et al. | 355/260 |
| 5,331,382 A | | 7/1994 | Miura et al. | 355/260 |
| 5,548,384 A | * | 8/1996 | Weed | 399/120 |
| 5,608,501 A | | 3/1997 | Makino | 399/119 |

(Continued)

FOREIGN PATENT DOCUMENTS

| | | |
|---|---|---|
| EP | 0 905 577 A2 | 3/1999 |

(Continued)

*Primary Examiner*—Quana Grainger
(74) *Attorney, Agent, or Firm*—Fitzpatrick, Cella, Harper & Scinto

(57) ABSTRACT

A toner supply container is detachably mountable to an image forming apparatus and includes a container body for containing toner; a shutter for closing and opening an opening, which is provided in the container body; a rotatable member; and a projection. The shutter includes a first gear portion for meshing engagement with a first gear member, which is provided in the image forming apparatus. The rotatable member, which is rotatable relative to the container body, produces a driving force for opening and closing the shutter. The rotatable member includes a second gear portion for meshing engagement with a second gear member, which is provided in the image forming apparatus. The first gear member and second gear member are rotatable together. The projection, which is provided on the rotatable member, receives a force for pre-rotating the rotatable member through a predetermined angle in a direction of opening the shutter, from the image forming apparatus in response to a mounting operation of the toner supply container to the image forming apparatus. The rotatable member is rotatable through a predetermined angle in a direction of closing the shutter from a position at which the second gear portion is in meshing engagement with the first gear member. The projection enables disengagement between the first gear portion and the second gear member so as to substantially prevent the second gear portion from rotating the second gear member in a dismounting operation of the toner supply container from the image forming apparatus.

8 Claims, 34 Drawing Sheets

U.S. PATENT DOCUMENTS

| | | | | |
|---|---|---|---|---|
| 5,870,652 | A | 2/1999 | Kanamori et al. | 399/106 |
| 6,185,401 | B1 | 2/2001 | Kanamori et al. | 399/262 |
| 6,292,644 | B1 * | 9/2001 | Goto et al. | 399/262 |
| 6,438,345 | B1 | 8/2002 | Ban et al. | 399/262 |
| 2004/0131391 | A1 * | 7/2004 | Nagashiro | 399/258 |

FOREIGN PATENT DOCUMENTS

| | | |
|---|---|---|
| JP | 1-108581 | 4/1989 |
| JP | 7-225514 | 8/1996 |
| JP | 10-198145 | 7/1998 |

* cited by examiner

TONER SUPPLYING CONTAINER AND IMAGE FORMING APPARATUS

CROSS-REFERENCE TO RELATED APPLICATION

This application is a divisional of application Ser. No. 09/536,303, filed Mar. 27, 2000 now U.S. Pat. No. 6,766, 133.

FIELD OF THE INVENTION AND RELATED ART

The present invention relates to a toner supply container for supplying toner to an image forming apparatus such as an electrophotographic copying machine or an electrophotographic printer. It also relates to an image forming apparatus in which such a toner supply container is removably installable.

An image forming apparatus to which the present invention is preferably applicable is of a type which employs an electrophotographic image formation system to form images on a piece of recording medium. As examples of an electrophotographic image forming apparatus, there are electrophotographic copying machines, electrophotographic printers (laser beam printers, LED printers, or the like), facsimile machines, word processors, and the like.

Conventionally, toner in the form of microscopic particles has been used as developer for an image forming apparatus such as an electrophotographic copying machine or printer. After the depletion of the developer (toner) within the main assembly of an image forming apparatus, a toner supply container is used to replenish the image forming apparatus with a fresh supply of toner. Since toner is in the form of extremely microscopic particles, it tends to easily scatter, creating a problem. Thus, an operator, and/or the environment in which the operator works, tends to be contaminated with toner which is being replenished, or a small amount of the toner which remains in a toner supply container after replenishment, scatters.

In the case of a method for sealing the toner outlet of a toner supply container by welding a piece of film across the outlet, the container cannot be resealed, after usage, to solve the above described problem. Therefore, it has been proposed, and also put to practical use, to provide a toner supply container with a shutter so that the toner discharging outlet of a toner supply container can be repeatedly opened or closed (sealed).

On the other hand, it has been a common practice to provide the toner supplying apparatus of an image forming apparatus, through which toner is received by the image forming apparatus, with a shutter so that the toner supply inlet of the toner supplying apparatus can be repeatedly opened or sealed. This arrangement makes it possible to keep the toner supplying apparatus sealed except for while the toner is being supplied, so that foreign substances such as dust, or foreign objects such as paper clips, are prevented from entering the toner supplying apparatus, and so that it is assured that the toner supplying apparatus is not supplied with wrong type of toner or a wrong amount of toner.

Further, it has been proposed, and also put to practical use, to engage the aforementioned shutter of a toner supply container with the shutter of the toner supplying apparatus, in such a manner that both shutters can be opened or closed together. This arrangement further assures that toner is prevented from scattering while the toner is being supplied, preventing thereby an operator or the adjacencies of the image forming apparatus from becoming contaminated with toner.

In order to open or close the shutter of the toner supply container and the shutter of the toner supplying apparatus on the main assembly side, the toner supply container is provided with a handle, which is a rotational member, so that the shutters are opened or closed by a rotational force transferring means, such as a gear train, with which the image forming apparatus is provided.

If the drive train through which driving force for opening or closing the shutters is transmitted from the handle to the shutters is constructed with low cost, that is, without using high precision components, it is virtually impossible to avoid such a problem that the components fit loosely with each other, which results in an excessive amount of play, causing thereby gear backlash and/or distortion of the driving train. With the components of the drive train fitting loosely, the ratio between an input stroke and an output stroke does not become 1:1. Thus, the opened shutter sometimes fails to be returned to the original position, that is, the original closed position. If a toner supply container, which was pulled out of the image forming apparatus main assembly, in such a condition, is reinstalled into the main assembly, and then, the shutter is reopened and closed, the distance by which the shutter fails to be returned to the closed position increases, as compared to the preceding opening and closing. With the repetition of the supplying of the apparatus with toner, the distance by which the shutter fails to be returned to the closed position keeps on increasing.

In particular, in the case of a toner supplying system in which the shutter on the main assembly side and the shutter on the toner supply container side are engaged with each other to be moved together, misalignment may occur between the two shutters, which makes it impossible to pull the toner supply container out of the image forming apparatus main assembly, or causes the shutter on the main assembly side to fail to return to the closed position, making it impossible to install a brand-new toner supply container (whose shutter is at the original position, or the correct position). This is a problem.

SUMMARY OF THE INVENTION

The primary object of the present invention is to provide a combination of a toner supply container and an image forming apparatus, which makes the driving force transmitting portion of the rotational member engage with the rotational force transmitting means, always at the same position.

The second object of the present invention is to provide a combination of a toner supply container and an image forming apparatus, by which the toner supply container shutter can be smoothly opened or closed.

The third object of the present invention is to provide a combination of a toner supply container and an image forming apparatus, which causes the opened toner supply container shutter to always return to the original position, or the original closed position, as it is closed.

The fourth object of the present invention is to provide a combination of a toner supply container and an image forming apparatus, which does not suffer from a problem that the toner supply container cannot be installed into, or removed from, the main assembly of an image forming apparatus because of the misalignment between the shutter on the toner supply container side and the shutter on the apparatus main assembly side.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Presented below are the embodiments of the present invention. First, a preferable embodiment of the present invention will be described, followed by the others.

The embodiments of the present invention, which will be described below, relates to a toner supply container used for supplying the main assembly of an electrophotographic image forming apparatus with toner. This toner supply container comprises a toner containing portion, a toner outlet for discharging the toner contained in the toner containing portion, a shutter for opening or closing the toner outlet, and a driving force receiving portion for receiving the driving force for moving the shutter to open the toner outlet.

(Electrophotographic Image Forming Apparatus)

Figure 28:
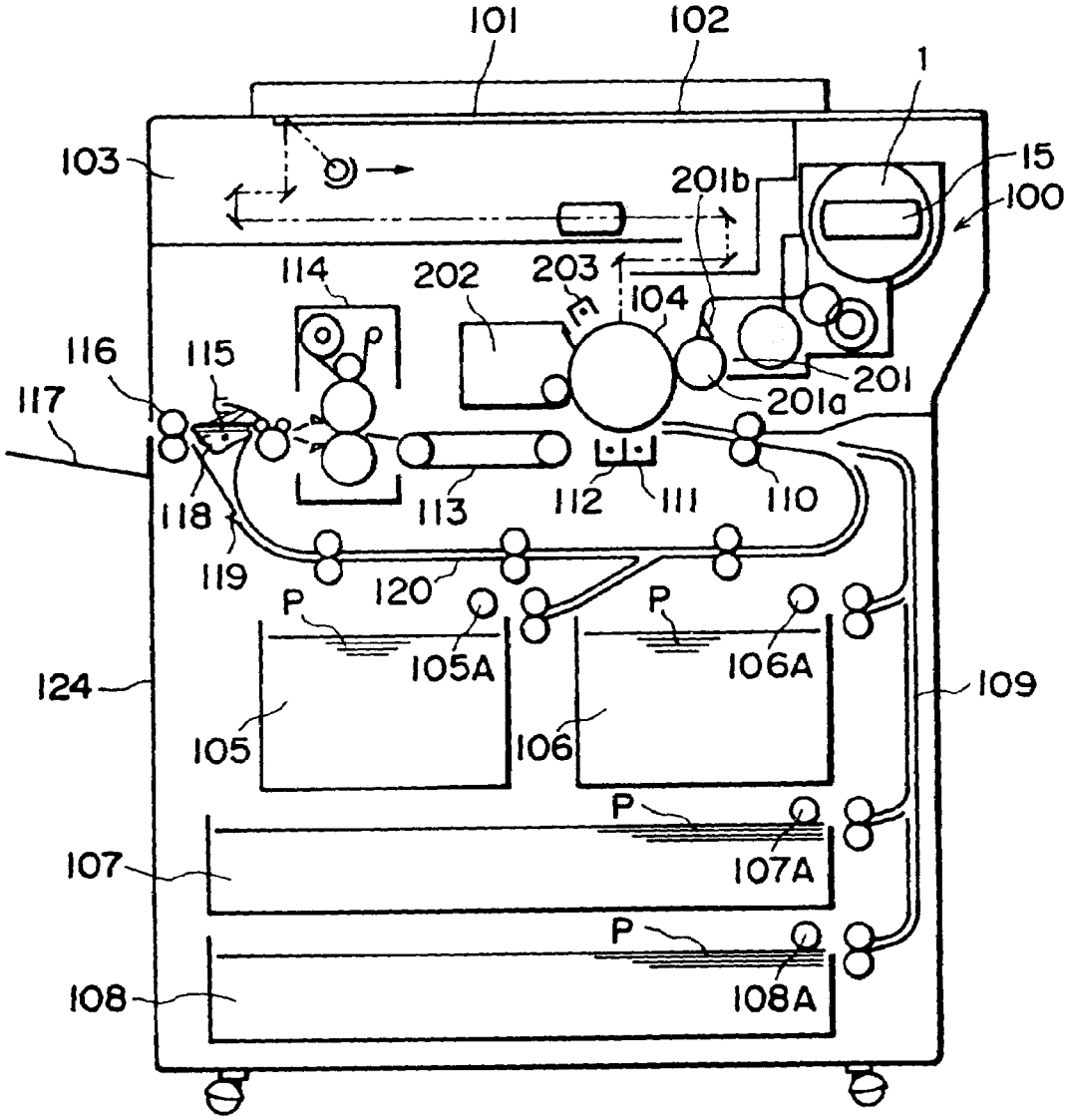
FIG. 28 is a vertical sectional view of an electrophotographic image forming apparatus.
Figure 29:
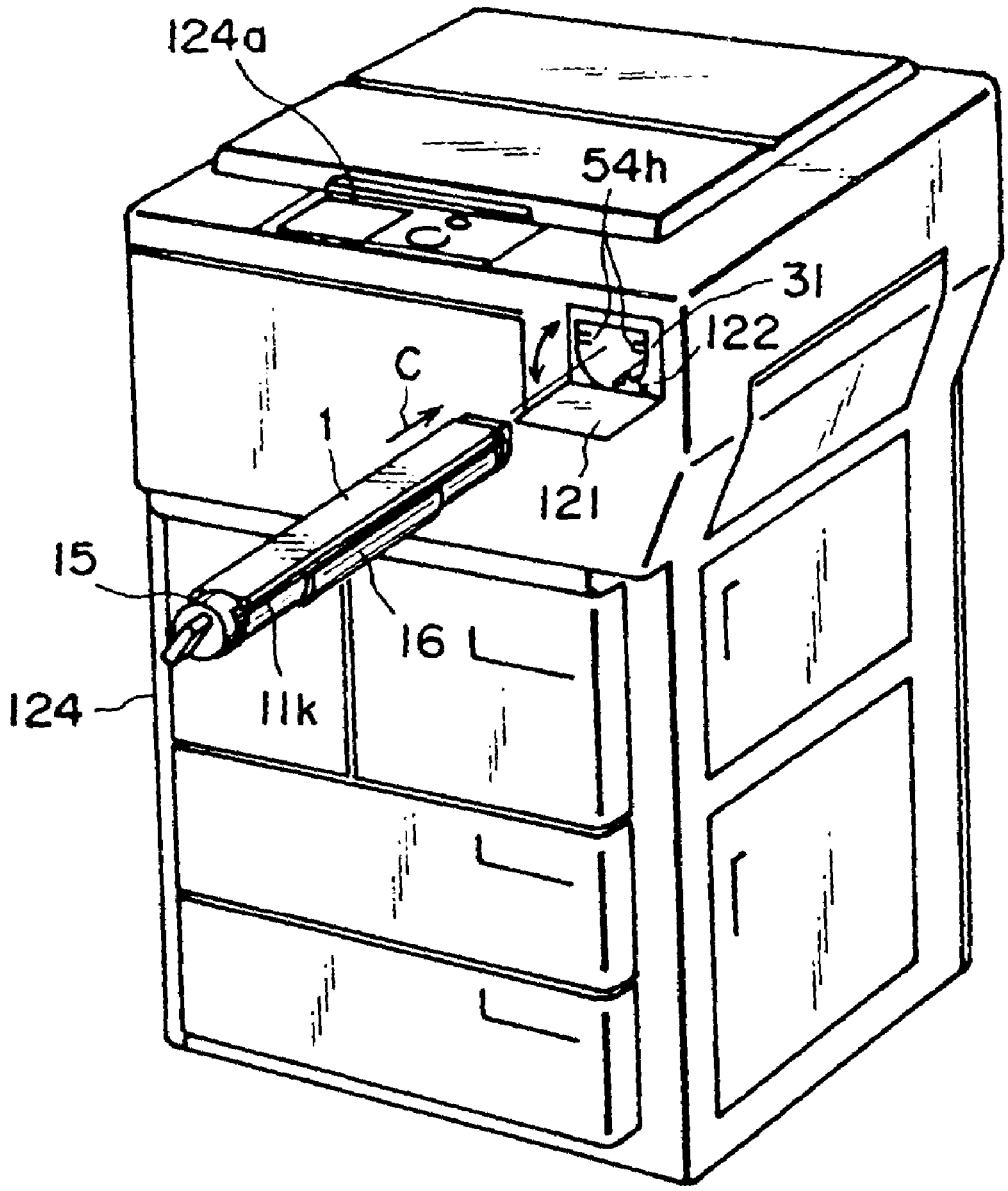
FIG. 29 is a perspective view of the electrophotographic image forming apparatus.
Figure 30:
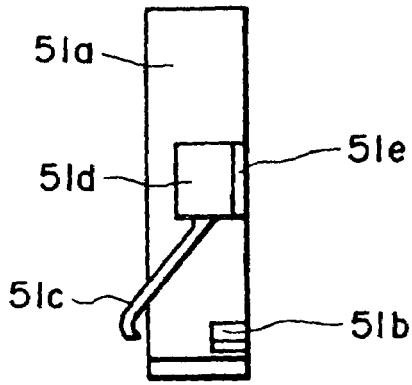
FIG. 30 is a lateral view of a handle locking member.
Figure 31:
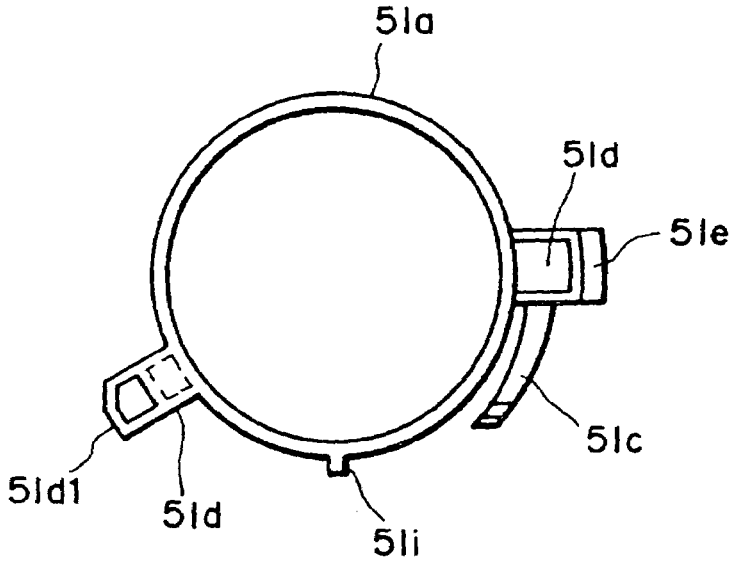
FIG. 31 is a front view of the handle locking member.
Figure 32:
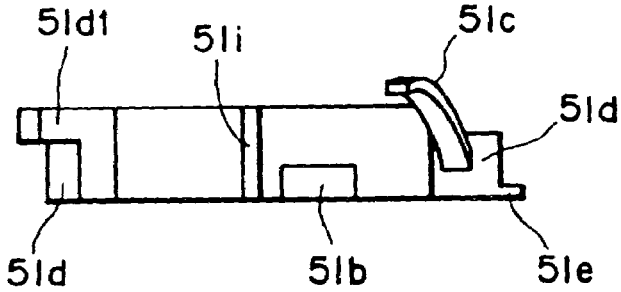
FIG. 32 is a bottom view of the handle locking member.

FIG. 28 is a vertical sectional view of an electrophotographic image forming apparatus in which there is a toner supply container in accordance with the present invention.

An original 101 is placed on a glass plate 102 for an original, by an operator. As a result, an optical image of the original 101 is formed on a photosensitive drum 104 as an image bearing member by the plurality of mirrors and lenses which an optical portion 103 comprises. Meanwhile, one of the feeder cassettes 105-108 in which recording media P (for example, paper, OHP sheet, or the like; hereinafter, "sheet") are stored in layers is selected on the basis of the sheet size information inputted through a control panel (unillustrated) by the operator. Then, among the feeder rollers 105A-108A, the roller of the selected feeder cassette is rotated to feed out a single sheet of recording medium P. After being fed out of the feeder cassette, the recording sheet P is conveyed to a registration roller 110 through a conveyance path 109. The registration roller 110 conveys the recording sheet P to the photosensitive drum 104 in synchronism with the rotational timing for the photosensitive drum 104 and the scanning timing for the optical portion 103. To this recording sheet P, the toner image on the photosensitive drum 104 is transferred by a transferring means 111. Thereafter, the recording sheet P is separated from the photosensitive drum 104 by a separating means 112. Then, the recording sheet P is conveyed to a fixing portion 114 by a conveying portion 113. In the fixing portion 114, the toner image on the recording sheet P is fixed to the recording sheet P with the application of heat and pressure.

Next,

1) In the single side copy mode, the recording sheet P is discharged into a delivery tray 117 by a discharge roller pair 16 through a reversing path 115.
2) In the multiple layer copy mode, the recording sheet P is directed toward conveying portions 119 and 120 by a flapper 118 of the reversing path 115, and is conveyed to the registration roller 110. Thereafter, the recording sheet P is passed through the image forming portion, conveying portion, and fixing portion as it was in the immediately preceding image formation cycle, and then, is discharged into the delivery tray 117.
3) In the two sided copy mode, the recording sheet P is passed through the reversing path 115, and is partially extended outward of the apparatus by the discharge roller pair 16 until its trailing edge passes the flapper 118. Then, as soon as the trailing edge of the recording sheet P passes the flapper 118, the discharge roller pair 116 is rotated in reverse to convey the recording sheet P back into the apparatus. Thereafter, the recording sheet P is conveyed to the conveying portions 119 and 120, and to the registration roller 110. Then, it is passed through the image forming portion, conveying portion, and fixing portion as it was in the immediately preceding image forming cycle, and is discharged into the delivery tray 117.

In an electrophotographic image forming apparatus structured as described above, a developing apparatus 201, a cleaning means 202, and a primary charging means 203 are disposed around the photosensitive drum 104. The developing apparatus 201 develops, with the use of toner, an electrostatic latent image formed on the photosensitive drum 104. A toner supplying apparatus 100 for supplying the developing apparatus 201 with toner is removably installed in the apparatus main assembly 124.

The developing apparatus 201 comprises a development roller 201*a* which maintains a microscopic gap (approximately 300 μm) from the photosensitive drum 104. During development, a thin layer of toner is formed on the peripheral surface of the development roller 201*a* by the development blade 201*b*. Then, as development bias is applied to the development roller 201*a*, the electrostatic latent image which has been formed on the photosensitive drum 104 is developed.

The charging means 203 is a means for charging the photosensitive drum 104. The cleaning means 202 is a means for removing the toner which remains on the photosensitive drum 104. The reduction in the amount of the toner in the developing apparatus 201 caused by development is compensated for by a fresh supply of toner gradually delivered by a toner supplying apparatus 100 with which the main apparatus of the image forming apparatus is provided.

Here, the exchanging of the toner supply container 301 will be described.

Figure 38:
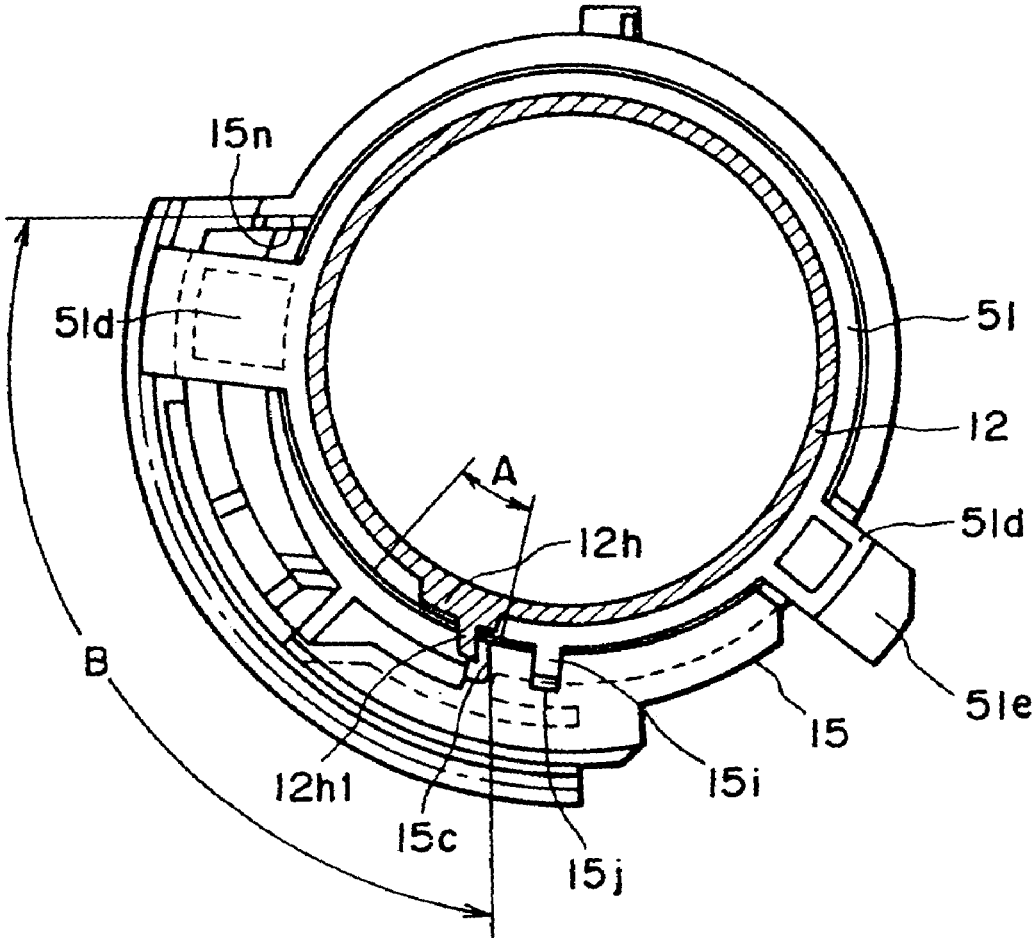
FIG. 38 is a vertical sectional view of the toner supplying apparatus, at a plane perpendicular to the longitudinal direction of the toner supply container, and shows the position of the handle locking member.

As the toner within the toner supplying apparatus 100 is depleted, the depletion of the toner is reported to a warning section 124*a*. Then, an operator opens the lid 121, which covers the opening 122 with which the main assembly 124 is provided, as shown in FIG. 38. Inside the opening 122, a holder 31 (installing means, more specifically, main assembly 54 of toner supplying apparatus) in which the toner supply container 1 is removably installable is provided. Into this holder 31, the toner supply container 1 is inserted in its longitudinal direction. During this operation, the toner supply container 1 is guided in its longitudinal direction by a guide, with which the holder 31 is provided, and which extends in the longitudinal direction of the holder 31, until the leading end of the toner supply container 1 reaches a predetermined point. Then, as the operator rotates the handle 15 of the toner supply container 1 after the leading end of the toner supply container 1 reaches the predetermined point, the toner within the toner supply container 1 is supplied to the developing apparatus 201. Then, as the operator closes the lid 121, the power switch is turned on, readying the image forming apparatus for image formation.

Figure 12:
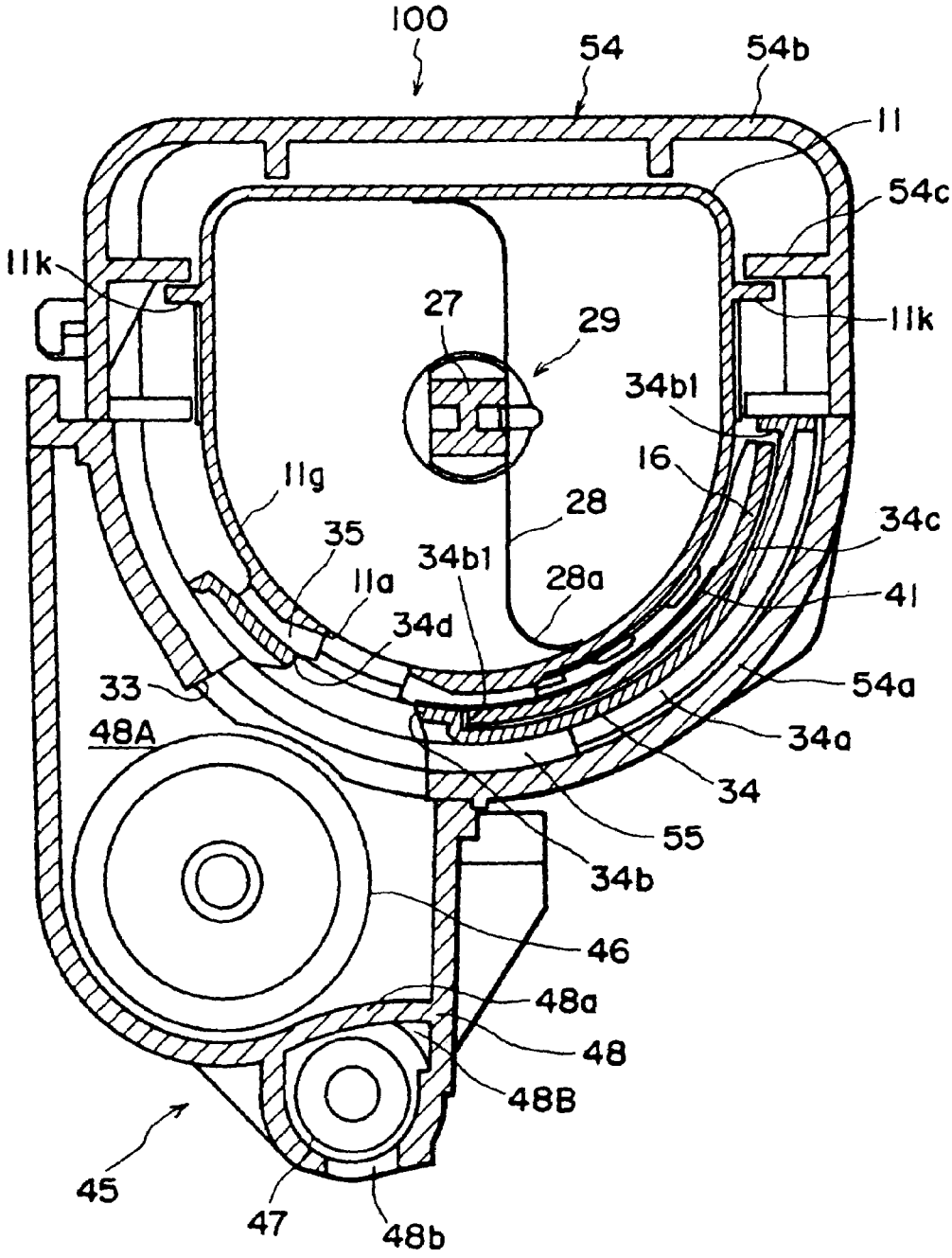
FIG. 12 is a vertical sectional view of the toner supplying apparatus, at the plane perpendicular to the longitudinal direction of the toner supplying apparatus (shutter is closed).

More specifically, as a signal which indicates that the amount of the toner in the developing apparatus 201 has become too small is sent out by a sensor (unillustrated) in the developing apparatus 201, toner conveying screws 46 and 47, illustrated in FIG. 12, rotate. As a result, the toner within a case 48 is gradually supplied to the developing apparatus 201. Then, as the amount of the toner within the developing apparatus 201 reaches a predetermined level, the toner conveying screws 46 and 47 stop. This process is repeated. Eventually, the amount of the toner within the case 48 becomes too small. Then, a signal which indicates that the amount of the toner within the case 48 has become too small is sent out by a sensor (unillustrated) within the case 48. As a result, a conveying member 29 (which will be described later) within the toner supply container 1 rotates to send the toner into the case 48. Then, as the amount of the toner within the case 48 reaches a predetermined level, the conveying member 29 stops. The process is repeated. If the toner is not supplied even though the sensor within the case 48 sends out the aforementioned signal, a message which suggests the exchange of the toner supply container 1 is displayed by the warning section 124*a*.

(Toner Supply Container)

Figure 1:
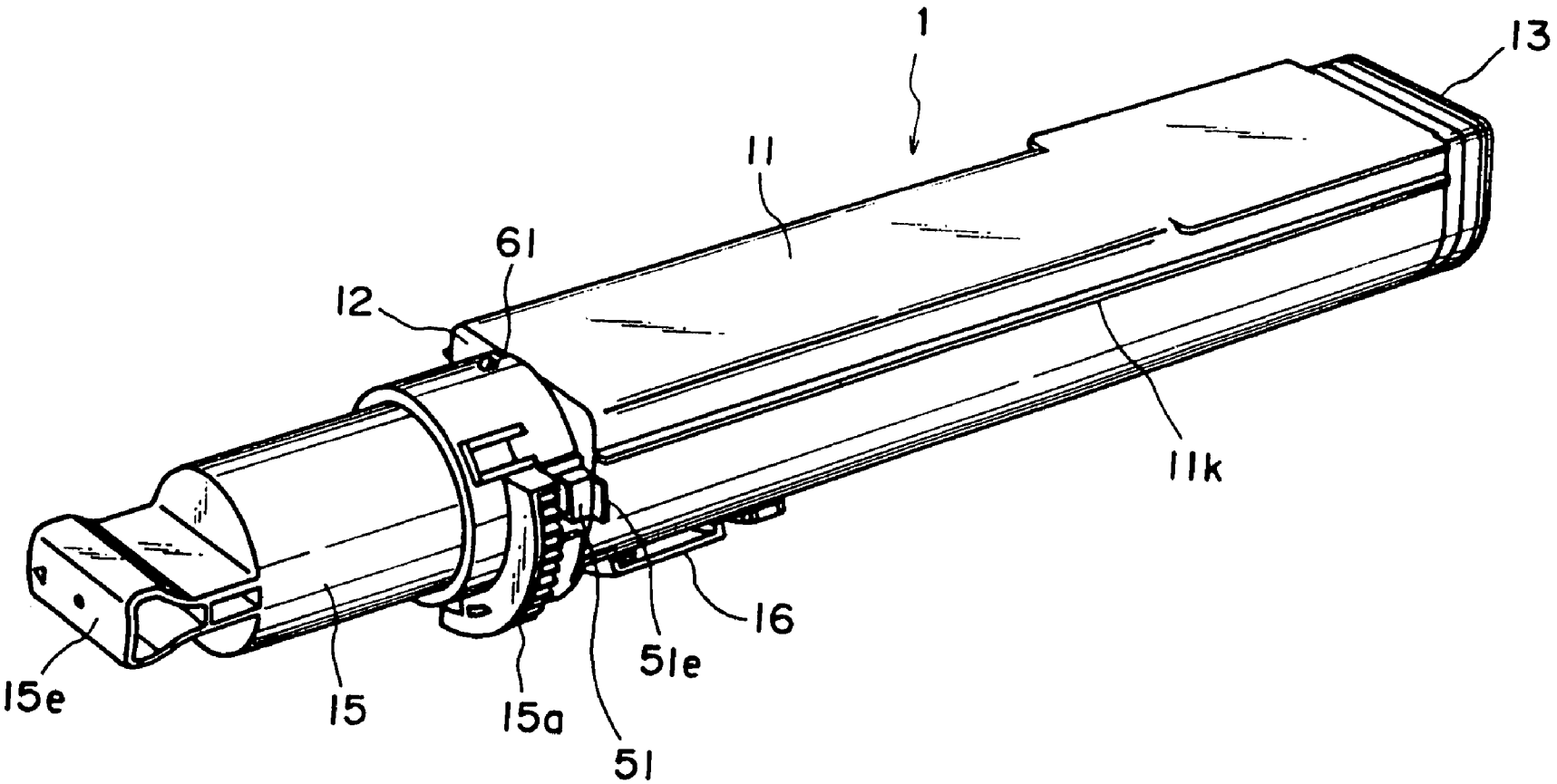
FIG. 1 is a perspective view of a toner supply container, as seen from diagonally above the upstream side in terms of its installation direction.
Figure 2:
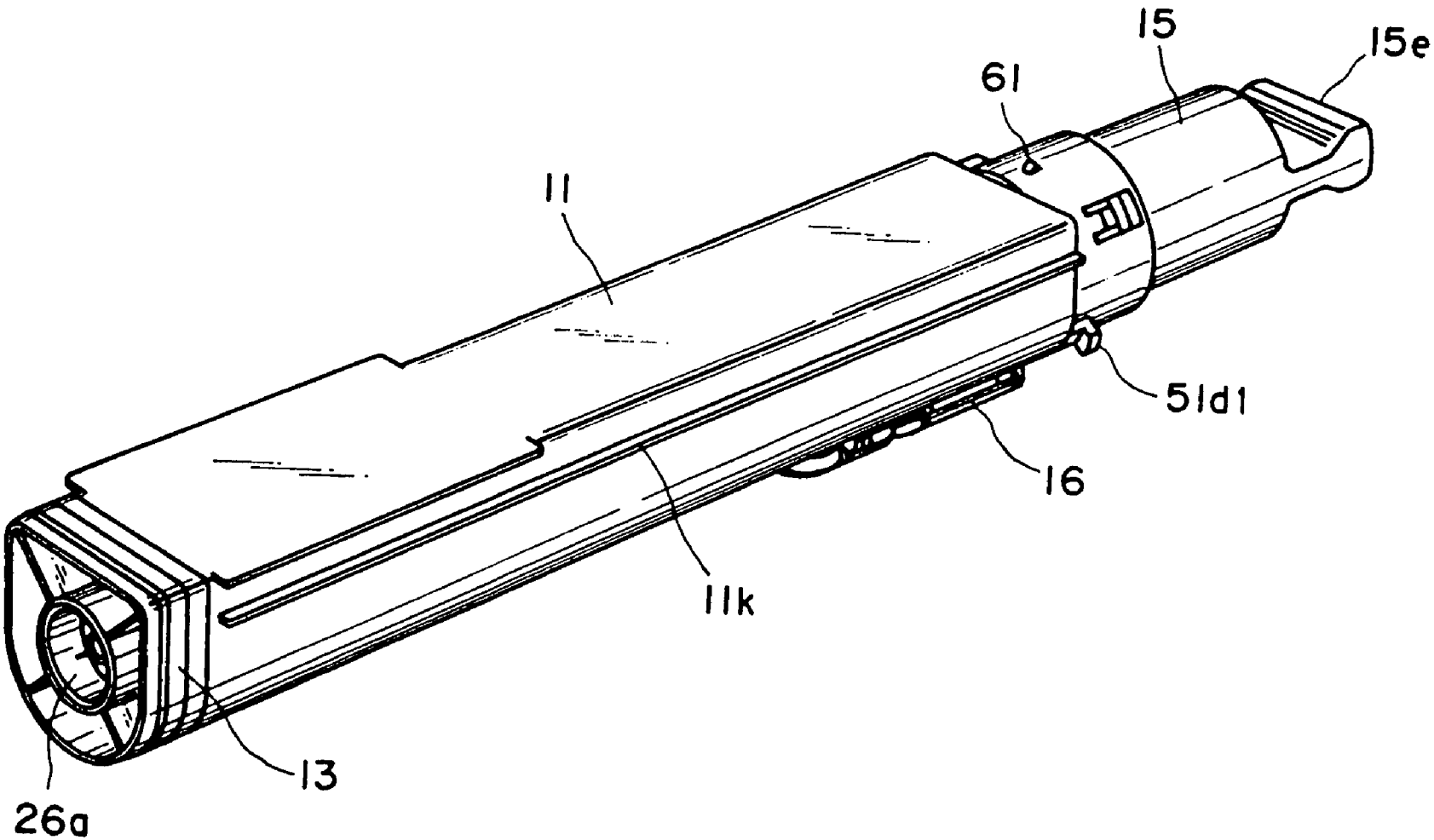
FIG. 2 is a perspective view of the toner supply container as seen from diagonally above the downstream side in terms of its installation direction.

The toner supply container 1 in this embodiment (FIGS. 1-3) is installed in the toner supplying apparatus 100 in an image forming apparatus, and is left there so that the toner within the toner supply container 1 is gradually supplied to the development station until the toner within the toner supply container 1 is depleted. In other words, it is of the so-called built-in type. However, the present invention does not require that the type of the toner supply container 1 is limited to the one described above; the present invention is also applicable to, for example, a toner supply container of the so-called integral type, which not only holds toner but also supplies it to the development station.

Figure 4:
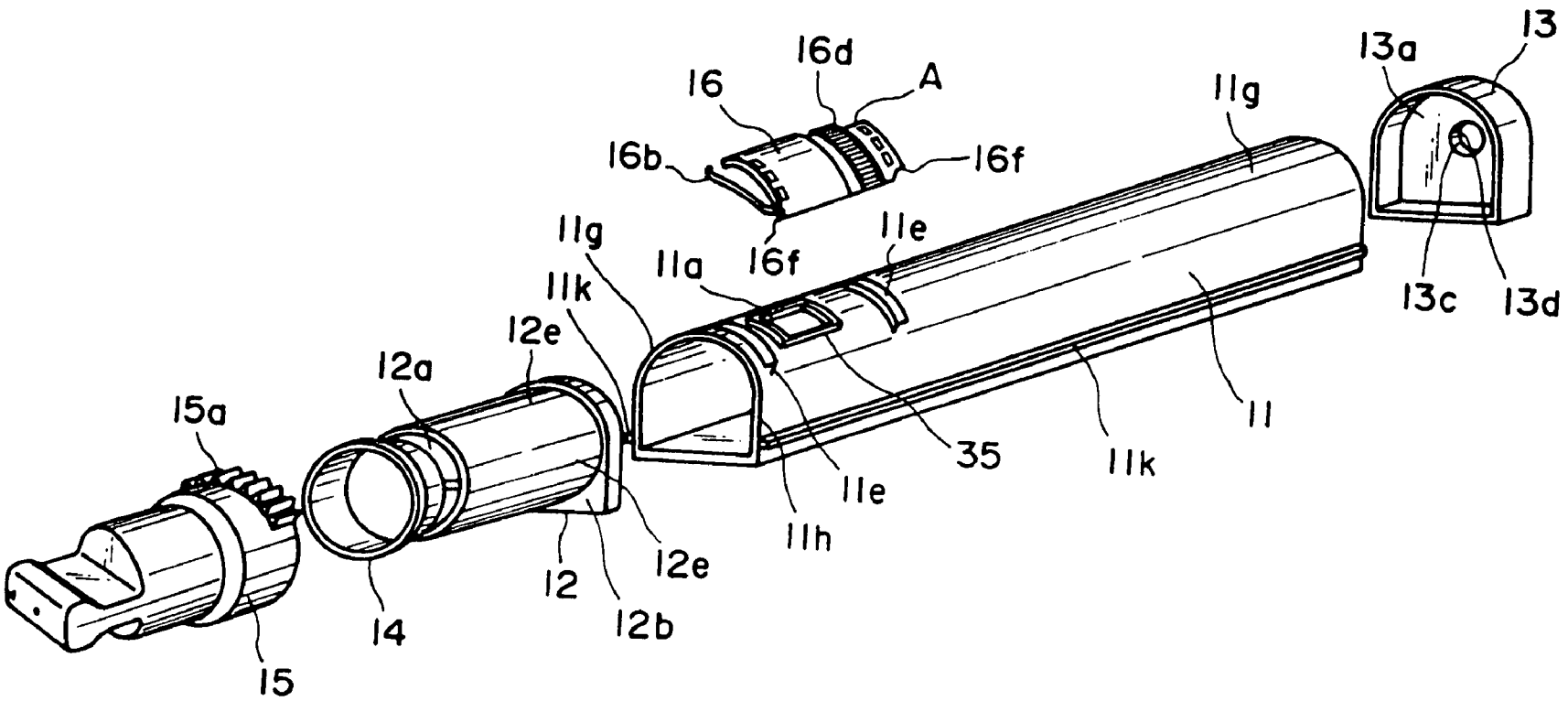
FIG. 4 is an exploded perspective view of the toner supply container.
Figure 5:
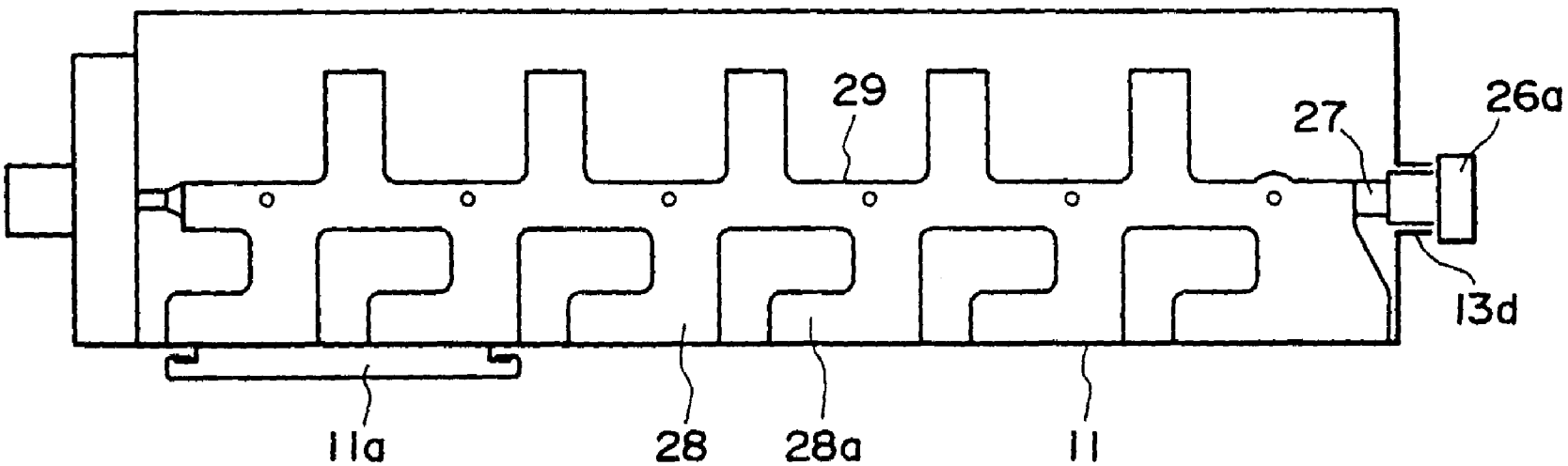
FIG. 5 is a schematic, vertical, sectional view of the toner supply container.

Referring to FIG. 4, a schematic exploded view of the aforementioned toner supply container 1, the toner supply container 1 has a toner containing portion 11 which is the main portion, and first and second flanges 12 and 13, respectively, which are attached to the corresponding longitudinal ends of the toner containing portion 11. It also has a cap 14 which is inserted into the first flange 12, and a handle 15, a rotational member, which is rotationally fitted around the first flange 12. Further, it has a container shutter 16 which exposes or covers the toner outlet 11*a* of the toner containing portion 11. Within the toner containing portion 11, a toner conveying member 29 is disposed as a toner conveying means (FIG. 5).

(Toner Container)

Referring to FIG. 4, the toner containing portion 11 is shaped so that its cross section perpendicular to its longitudinal direction becomes a combination of an approximately semi-circular portion 11*g* and a rectangular portion 11*h*. It is in the form of a hollow tube with the above described cross section, and the toner is stored within this toner containing portion 11. The toner containing portion 11 is provided with a toner outlet 11*a*, which is in the curved wall portion of the toner containing portion 11. The toner containing portion 11 is also provided with a pair of shutter supporting members 11*e*, which are located on the curved wall portion of the toner containing portion 11, one on the front side of the toner outlet 11*a* and the other on the rear side, in terms of the longitudinal direction of the toner containing portion 11, and extend in the circumferential direction of the toner containing portion 11. The container shutter 16 is supported by the supporting members 11*e* so that the container shutter 16 can take a closing position (FIG. 11) at which the container shutter 16 seals the toner outlet 11*a*, or an exposing position (FIG. 12) to which the container shutter 11 retreats to expose the toner outlet 11*a*.

Further, the toner containing portion 11 is provided with a pair of guiding portions 11*k*, which run in the longitudinal direction of the toner containing portion 11 along the lateral longitudinal edges of the toner containing portion 11. These guiding portions 11*k* are members which regulate the toner supply container 1 so that the toner supply container 1 moves in a straight line when the toner supply container 1 is installed into, or removed from, the toner supplying apparatus 100.

As described above, in this embodiment, the toner containing portion 11 is in the form of a tube, the cross section of which is such that its top half is semicircular and its bottom half is rectangular. However, the shape of the toner containing portion 11 does not need to be limited to the above described one. For example, the toner containing portion 11 may be shaped so that its cross section perpendicular to its longitudinal direction is circular, elliptical, or square. Further, there is no specific restriction regarding the structure and component count of the toner containing portion 11.

The toner containing portion 11 is filled with toner in the powder form (hereinafter, all toners are in the powder form). There are various classifications of toner: black toner, color toner, single component magnetic toner, single component nonmagnetic toner, and the like. From among these various classifications of toners, toner is selected as appropriate.

(Structures of First and Second Flanges 12 and 13)

The first and second flanges 12 and 13 are in the form of a hollow tube, which exactly fits into the corresponding longitudinal ends of the toner containing portion 11. After being exactly fitted into the corresponding longitudinal ends of the toner containing portion 11, they are fixed to the toner containing portion 11 with the use of adhesive to seal the toner containing portion 11. The first flange 12 comprises an end plate 12*b* and a cylindrical portion 12*e*. The axial line of the cylindrical portion 12*e* coincides with the longitudinal center line of the semicylindrical portion 11*g* of the toner containing portion 11. The first flange 12 comprises a toner inlet 12*a*, which runs within the cylindrical portion 12*e*. The second flange 13 comprises an end plate 13*a*.

The first and second flanges 12 and 13 may be integral with the toner containing portion 11, or a part of the toner containing portion 11. In other words, the main section of the toner containing portion 11 may be a single piece component.

Figure 36:
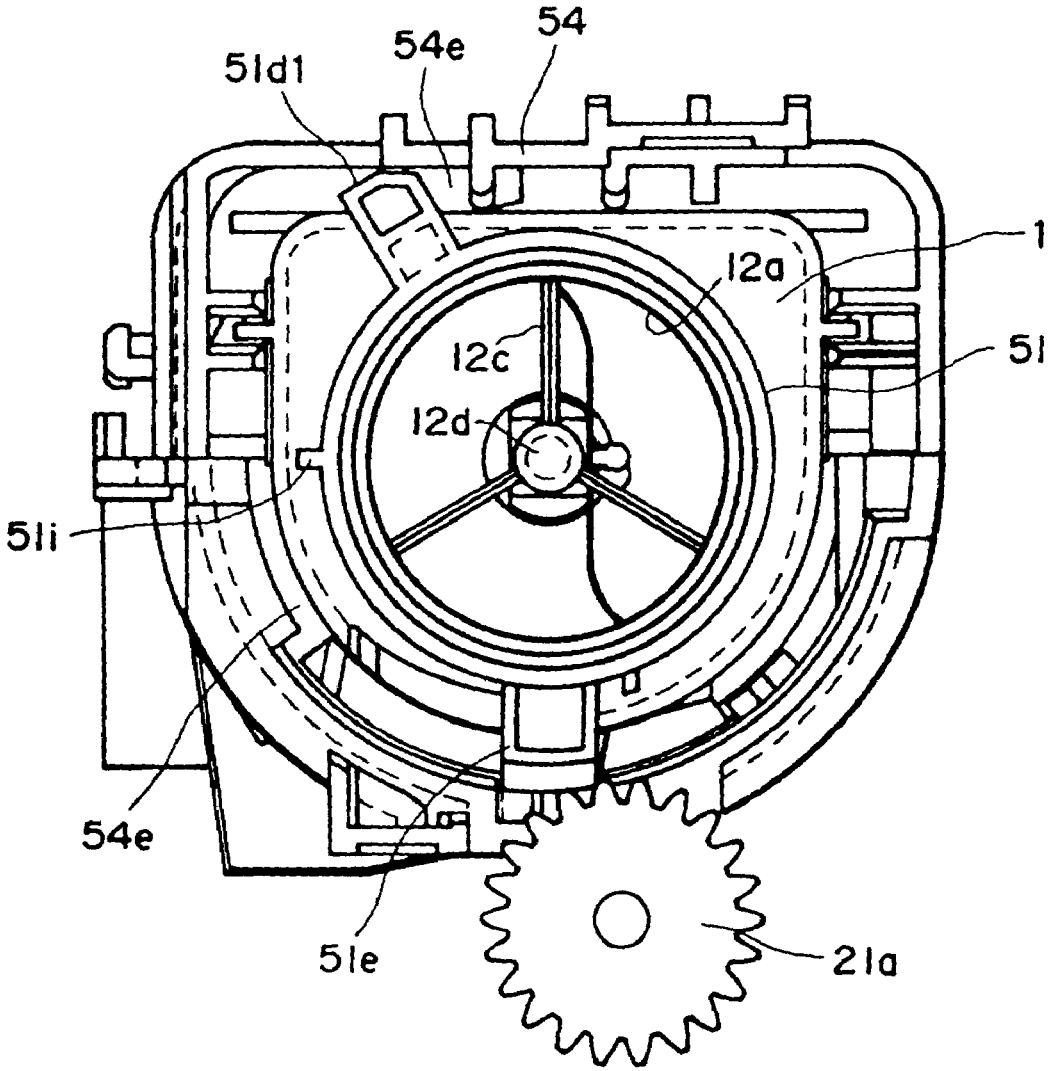
FIG. 36 is a front view of the toner supplying apparatus in which there is the toner supply container, the handle of the toner supply container being unillustrated.
Figure 37:
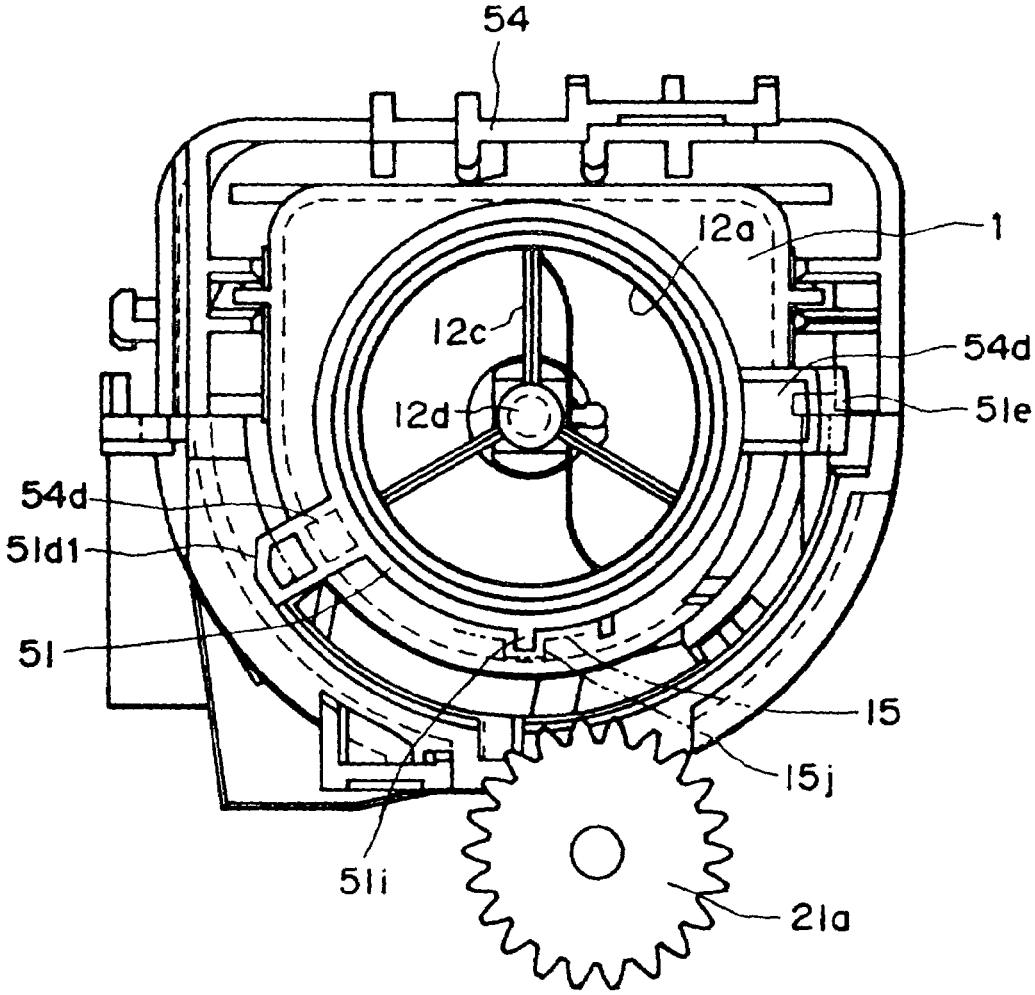
FIG. 37 is a front view of the toner supplying apparatus, which is containing the toner supply container, the handle of the toner supply container being unillustrated.

As described above, the first flange 12 is provided with the toner inlet 12*a*, the opening of which is located at the longitudinal end, on the upstream side in terms of the direction in which the toner containing portion 11 is inserted. The toner inlet 12*a* is provided with internal ribs 12*c*, which radially fit within the toner inlet 12*a* (FIGS. 36 and 37). Also, the toner inlet 12*a* is provided with a cylindrical hollow shaft, the axial line of which coincides with that of the toner inlet 12*a*, and which supports the axle of the toner conveying member which will be described later. Around the cylindrical portion 12*e*, i.e., the cylindrical wall of the toner inlet 12, a handle 15, which will be described layer, is fitted. After the toner is filled, the toner inlet 12*a* is sealed by fitting a cap 14 into the toner inlet 12*a*. Then, the first flange 12 is unitized with the toner containing portion 11 by an appropriate joining means.

The end plate 13*a* of the second flange 13 is provided with a hole 13*c*, into which a driving force transmitting bearing (for example, coupling) for bearing the axle of the toner conveying member 29 and also transmitting the driving force, is fitted from outside the toner containing portion 11. Further, the end plate 13*a* is provided with a cylindrical portion 13*d* (FIGS. 4 and 5), which projects outward from the outer edge of the hole 13*c* and supports the peripheral surface of the aforementioned coupling.

(Handle)

Figure 7:
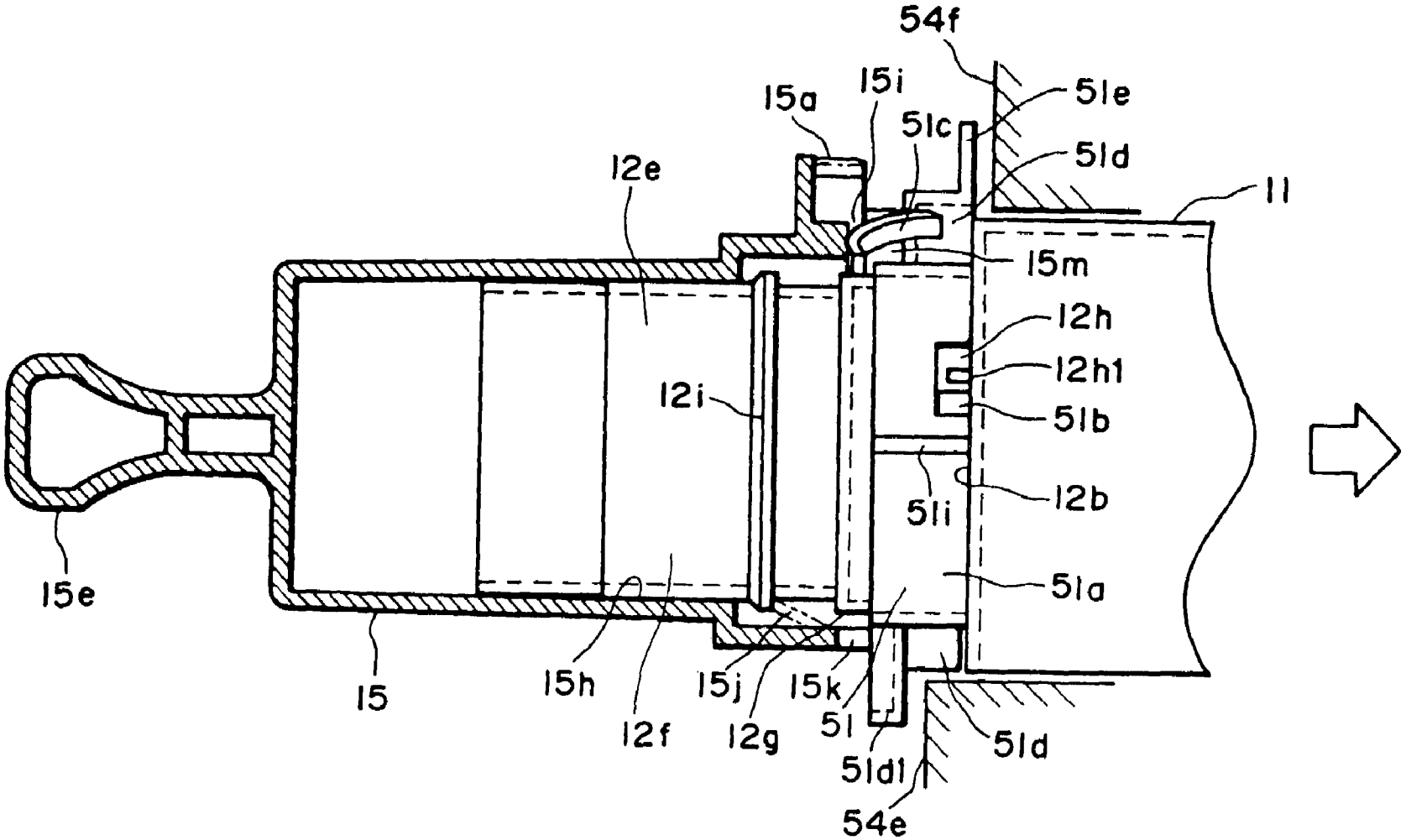
FIG. 7 is a vertical sectional view of the handle lock (in the locked state).
Figure 8:
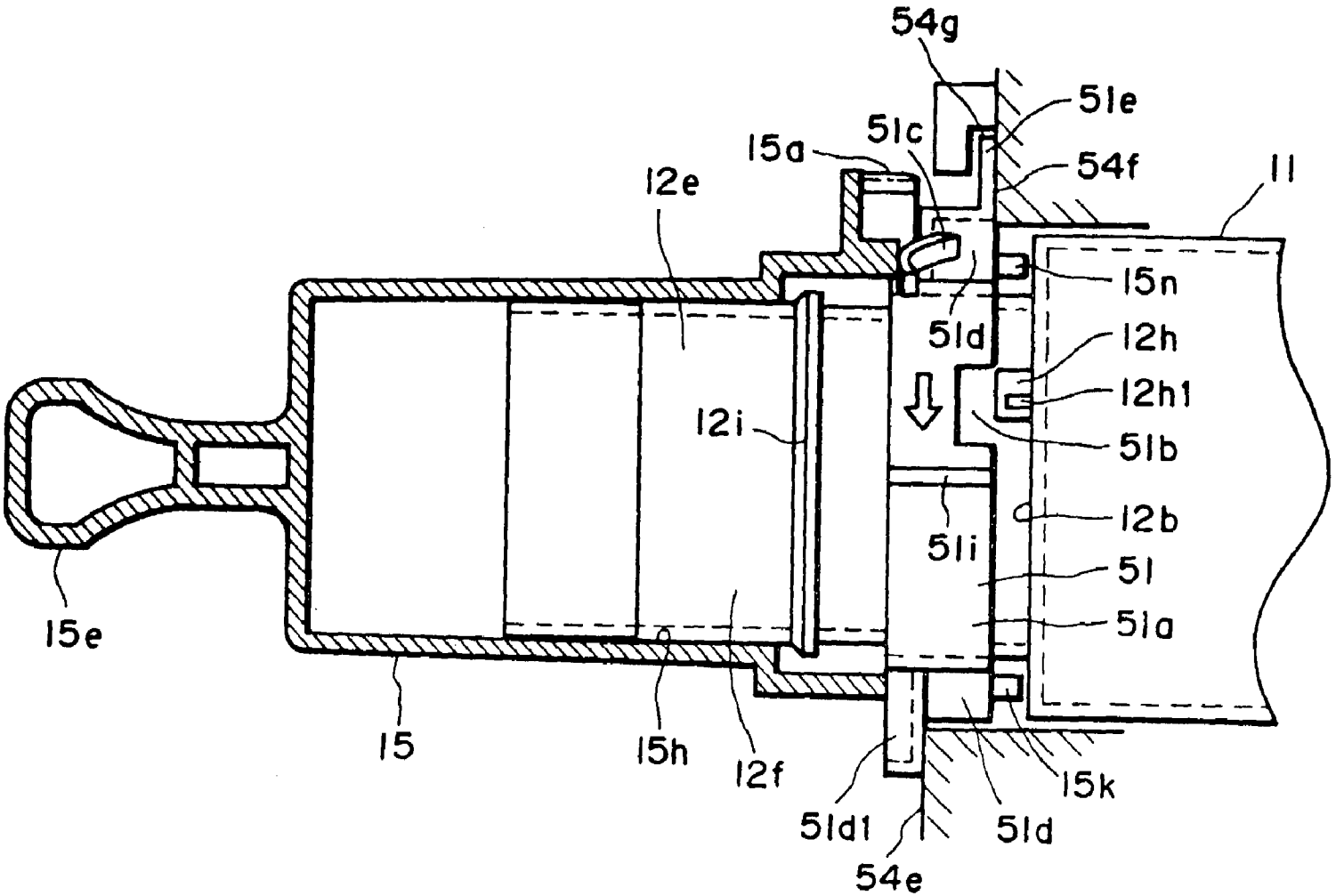
FIG. 8 is a vertical sectional view of the handle lock (in the unlocked state).

The handle 15, a rotational member, basically comprises three sections: a knob section 15*e*, a cylindrical hollow section 15*h* (middle section) with a smaller diameter, and a cylindrical hollow section with a larger diameter. The knob section 15*e* is the outward end of the handle 15, and is in the form of a thick plate with a thicker end. The cylindrical hollow section with a larger diameter is the inward end of the handle 15, and is open on the inward side. The handle 15 is rotationally attached to the toner containing portion 11 by manually fitting the middle section 15*h* around a handle supporting portion 12*f*, which is a part of the cylindrical portion 12*e* located at one of the longitudinal ends of the toner containing portion 11 (FIGS. 7 and 8). The handle 15 also comprises an engaging portion 15*a*, which is a driving force transmitting portion, for transmitting the driving force. The engaging portion 15*a* is on the outward facing surface of the handle 15.

Figure 6:
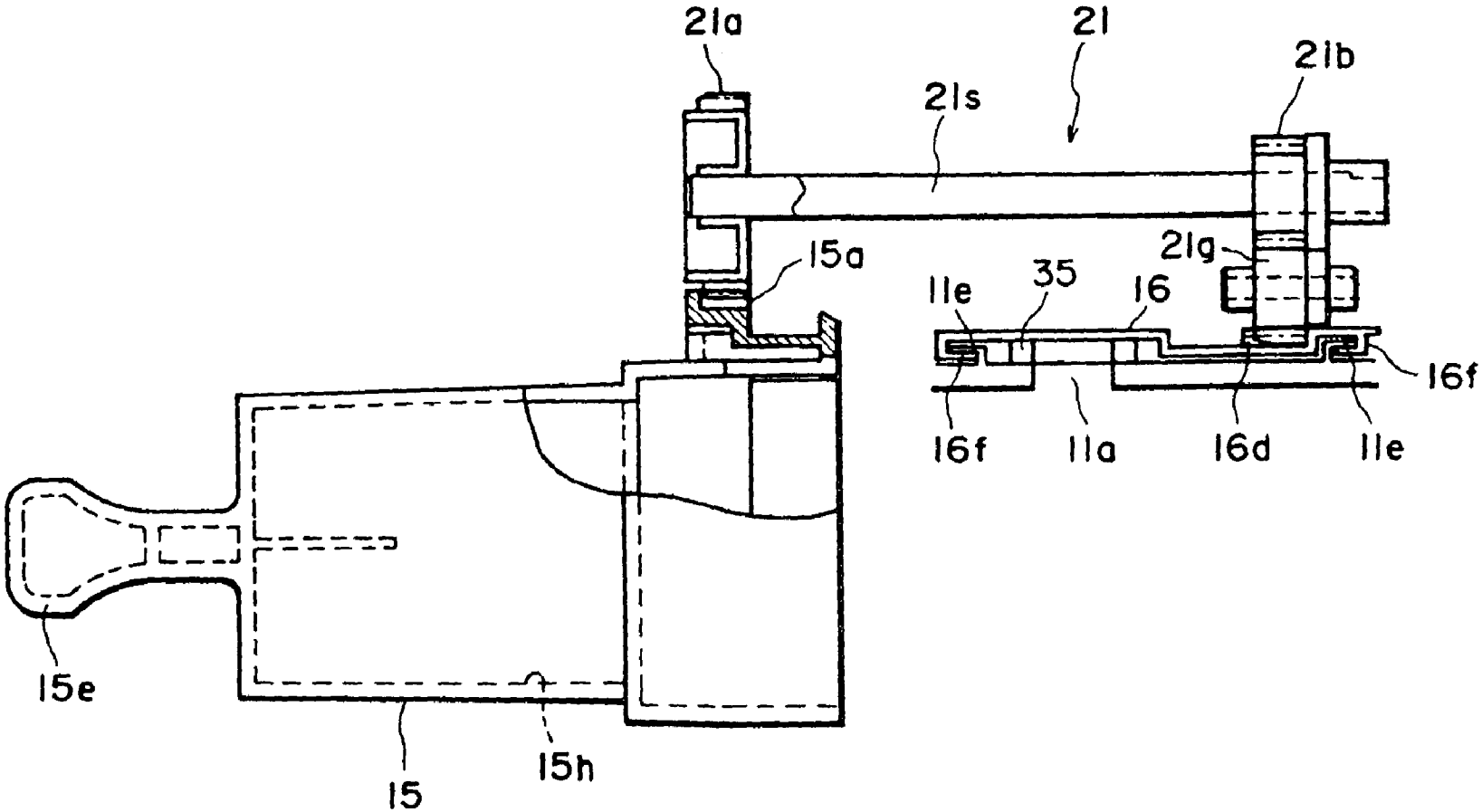
FIG. 6 is a vertical sectional view of the driving system of the toner supply container shutter.
Figure 10:
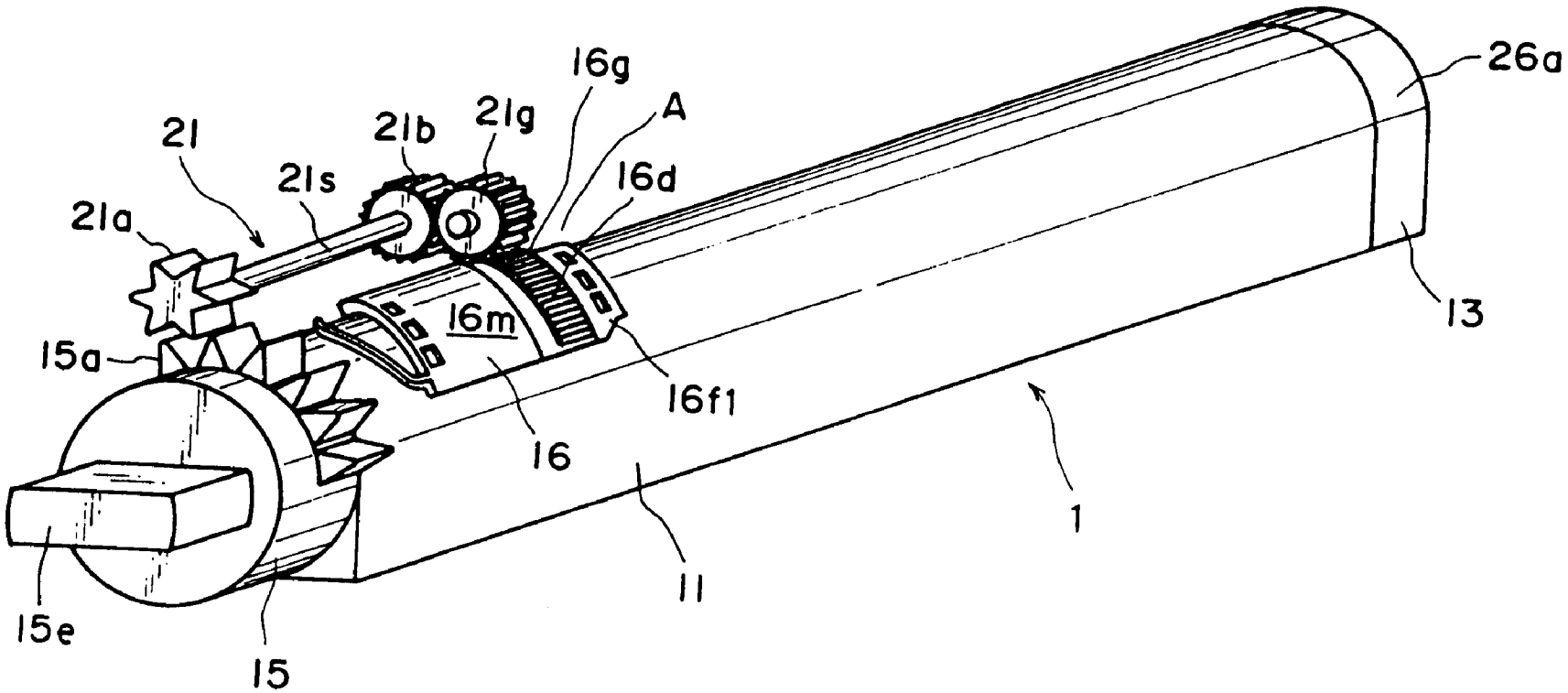
FIG. 10 is a perspective view of the driving force transmitting means of the toner supply container.

Referring to FIGS. 6 and 10, the engaging portion 15*a* is in the form of a segment gear so that when the toner supply container 1 is inserted into the toner supplying apparatus 100, the engaging portion 15*a* can engage with the engaging portion 21*a* of a driving force transmitting member 21 with which the toner supplying apparatus 100 is provided. The engaging portion 15*a* is engageable with the engaging portion 21*a* through a sequential operation for inserting the toner supply container 1.

Also referring to FIGS. 6 and 10, the diving force transmitting member 21 as a rotational force transmitting means comprises a shaft 21*s*, the engaging portion 21*a* for receiving the driving force, and an engaging portion 21*b* for transmitting the driving force. The shaft 21*s* is fitted with the engaging portions 21*a* and 21*b*, one for one at its longitudinal ends, and is rotationally supported by the toner supplying apparatus 100. The engaging portions 21*a* and 21*b* comprise gears with multiple teeth. The engaging portion 21*a* on the driving force reception side in this embodiment comprises a single gear. However, there is no specific restriction regarding the structure or gear count portion 21*a* as long as it is structured to function as a mechanism for receiving the driving force. The engaging portion 21*b* on the driving force transmission side is meshed with the engaging portion 21*g* on the driving force transmission side as an idler gear which is meshed with the engaging portion 16*d*, a segment gear, on the driving force reception side. In this embodiment, the driving force member 21, a member comprising the shaft 21*s*, and engaging portions 21*a* , 21*b* and 21*g*, is provided on the apparatus main assembly 124 side of the image forming apparatus.

(Toner Conveying Member)

Referring to FIG. 5, one end of a shaft 27 for supporting the toner conveying member 29 is rotationally borne by the hole 12*d* (FIG. 37), and the other end of the shaft is borne by the bearing 13*d* fitted in the shaft hole 12*d* so that the rotational driving force is transmitted through the coupling 26*a* fixed to this end of the shaft 27. Further, the toner conveying member 29 comprises a toner conveying wing 28, which is a flexible member fixed to the shaft 27. The coupling 26*a* is rotationally supported by the toner containing portion 11.

The toner conveying wing 28 rubs against the inward surface of the toner containing portion 11. The toner conveying wing 28 comprises a plurality of segments each with a winglet 28*a*. The toner outlet 21*a* side of the winglet 28*a* is bent away from the rotational direction of the toner conveying wing 28 so that the toner in the toner containing portion 11 can be conveyed toward the toner outlet 11*a*. The toner outlet 11*a* is located on the upstream side in terms of the direction in which the toner supply container 1 is inserted into the apparatus main assembly 124. Thus, all winglets 28*a* extend in the same direction. However, it is not mandatory that all winglets 28*a* extend in the same direction; the winglets 28*a* may be different in their extending direction, depending on the positioning of the toner outlet 11*a*. After the toner supply container 1 is inserted into the toner supplying apparatus 100, the aforementioned coupling 26*a* receives the driving force by meshing with the coupling 44 (FIG. 19) provided on the toner supplying apparatus 100 side, and rotates the toner conveying member 29.

As long as the toner within the toner containing portion 11 can be conveyed to the toner outlet 11*a*, the provision of the toner conveying member 29 is not mandatory. However, the provision of the toner conveying member 29 assures reliable suppliance of the toner.

Figure 9:
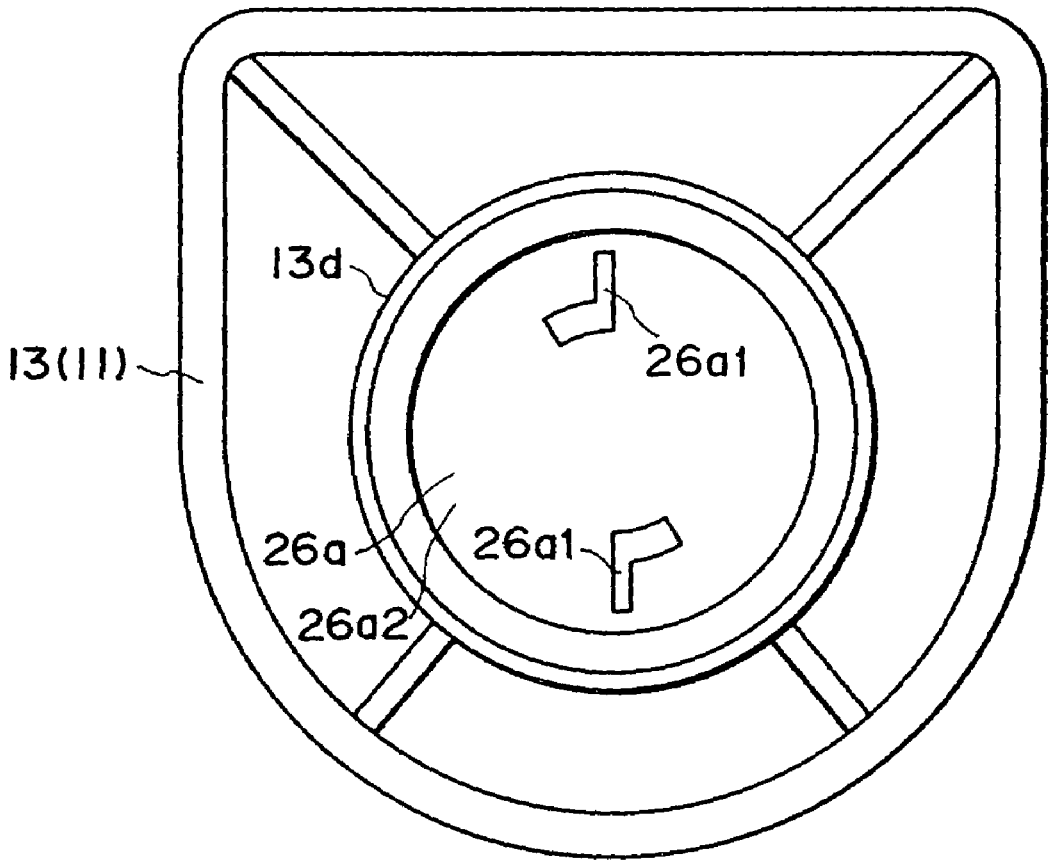
FIG. 9 is a rear view of the toner supply container.

Next, referring to FIG. 9 which depicts the driving force receiving end portion of the toner supply container 1, a coupling 26*a* as a driving force receiving member is rotationally supported by the end plate of the toner containing portion 11. Both ends of the coupling 26*a* in the axial direction are in the form of a shaft coupler. One end of the coupling 26*a* is positioned within the toner containing portion 11, and is coupled with one end of the shaft 27 of the toner conveying member 29, whereas the other end of the coupling 26*a*, which is positioned outside the toner containing portion 11, is provided with a rotational force receiving portion. As the toner supply container 1 is installed into the apparatus main assembly 124, this rotational force receiving portion couples with the coupling 44 provided on the toner supplying apparatus 100 side to transmit the rotational force. Referring to FIG. 9, the rotational force receiving portion is in the form of a projection 26*a*1, a part of which extends in the radial direction of the coupling 26*a*. The couplings 26 and 44 couple with each other as the projections 44*a* of the coupling 44 fit into the two spaces 26*a*2 between the two projections 26*a*1, one for one.

(Container Shutter)

Referring to FIG. 4, the container shutter 16 is provided with a pair of sliding portions 16*f*, which are located at the longitudinal ends, in terms of inserting direction of the toner supply container 1, of the container shutter 16, one for one. The sliding portions 16*f* engage, one for one, with a pair of shutter supporting members 11*e* as guiding members which extend on the toner containing portion 11 in the circumferential direction of the toner containing portion 11 along the curved edges of the toner outlet 11*a*, one on the front side and the other on the back side of the outlet 11*a*, in terms of the inserting direction of the container 1. The container shutter 16 slides in the circumferential direction of the toner containing portion 11 to expose or seal the toner outlet 11*a*. More specifically, the cross section of the container shutter 16 perpendicular to the longitudinal direction of the toner supply container 1 is in the form of an arc, the curvature of which is such that the container shutter 16 perfectly fits along the outer surface of the cylindrical portion 11*g* of the toner containing portion 11. As for the sliding portions 16*f* and shutter supporting members 11*e*, their cross section at a plane which includes the axial line of the theoretical hollow cylinder to which the container shutter 16 belongs, are in the form of an interlocking hook (FIG. 6). The shape of the cross section of shutter supporting member 11*e*, i.e., the interlocking hook, is the same across the entire length of the member.

Figure 20:
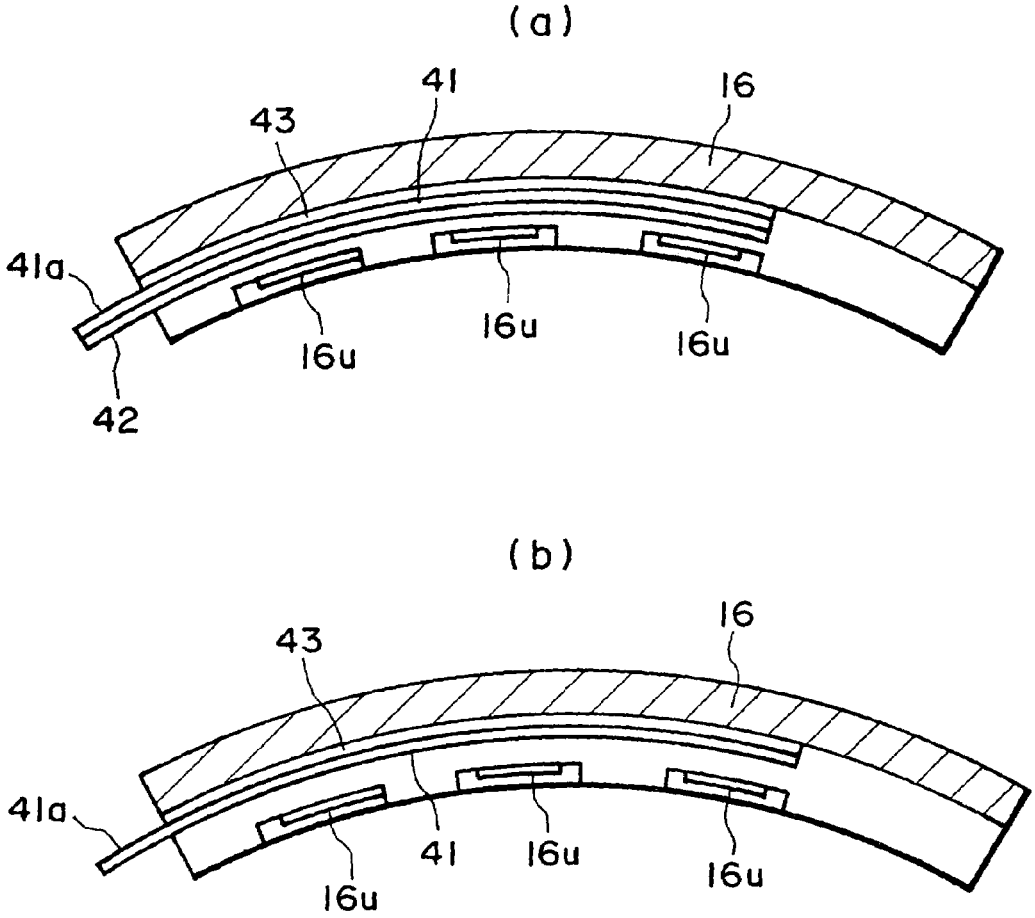
FIG. 20(*a*) and FIG. 20(*b*) are vertical sectional views of a toner supply container shutter, at a plane perpendicular to the longitudinal direction of the toner supply container.
Figure 21:
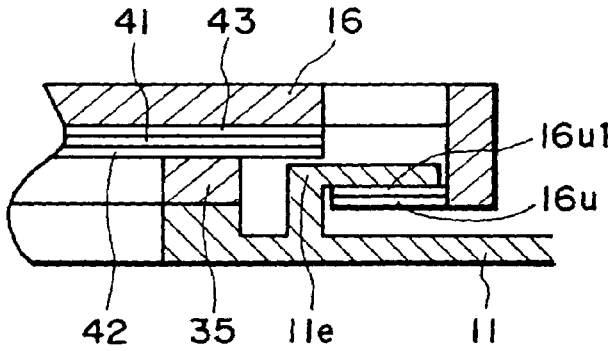
FIG. 21 is a vertical sectional view of an essential portion of the essential portion of the toner supply container shutter, at a plane perpendicular to the sectional plane of FIG. 20(*a*).
Figure 44:
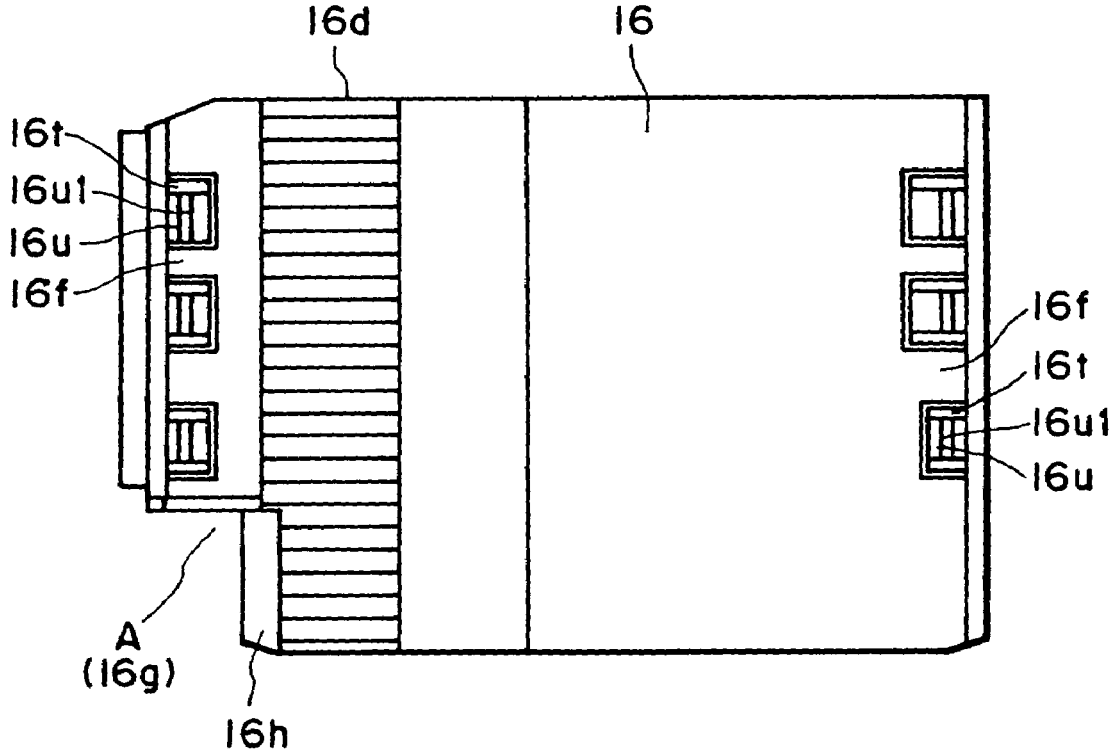
FIG. 44 is a plan view of the toner supply container shutter.

Referring to FIGS. 20, 21, 39, 40 and 44, the sliding portion 16*f* is provided with a plurality of small hook-like horizontal projections 16*u* which extend inward, relative to the toner outlet 11*a*, from the upright base portion of the sliding portion 16*f*. The locations of these hook-like horizontal projections 16*u* correspond one for one with the locations of the plurality of through holes 16*t* cut through the container shutter 16 along its curved edges. Referring to FIG. 44, each of these horizontal hook-like projections 16*u* is provided with a tiny projection 16*u*1 in the form of a character H or T (projects toward the reader side of this page), which is located on the surface of the projection 16*u*, which faces the shutter supporting member 11*e*. Each projection 16*u* functions as an elastic member which generates a predetermined amount of pressure for keeping the container shutter 16 tightly in contact with the elastic packing 35. Therefore, even if the pressure which each projection 16*u* receives from the elastic packing 35 varies depending upon the location of the container shutter 16 during the opening or closing of the container shutter 16, the presence of the plurality of projections 16*u* averages out the amount of pressure which keeps the container shutter 16 in contact with the elastic packing 35 (FIG. 21).

Referring to FIG. 10, the container shutter 16 is provided with the aforementioned driving force receiving engaging portion 16*d* as a member for receiving the rotational force which is enabled to engage with a gear as the aforementioned driving force transmitting engaging portion 21*g* as the toner supply container 1 is installed into the toner supplying apparatus 100. This engaging portion 16*d* is provided with a plurality of teeth, and is enabled to engage with the driving force transmitting engaging portion 21*g* through a sequence of operations for inserting the toner supply container 1 into the toner supplying apparatus 100. The driving force receiving engaging portion 16*d* is cut in the outer surface 16*m* of the container shutter 16. In other words, the diameter of the theoretical circle which includes the tooth tips of the segment gear, and the diameter of the theoretical circle which includes the outer surface of the container shutter 16 are rendered practically the same so that space can be saved in terms of the radial direction of the toner supply container 1. Since the engaging portion 16*d* must be engaged, or disengaged, with the driving force transmitting engaging portion 21*g*, it is cut in the outer surface of the container shutter 16, close to the curved edge on the coupling 26*a* side. With this arrangement, the engaging portion 16*d* engages with, or disengages from, the driving force transmitting engaging portion 21*g* when the container shutter 16 is in the closed state. As described before, the driving force transmitting engaging portion 21*g* with which the toner supplying apparatus 100 is provided, and the driving force receiving portion 16*d* with which the container shutter 16 is provided, are engaged through a sequence of operations for inserting the toner supply container 1 into the toner supplying apparatus 100. Therefore, the sliding portion 16*f* (16*f*1) of the container shutter 16, on the side where the coupling 26*a* is provided, is made shorter than the driving force receiving engaging portion 16*d* (portion designated by a referential character A in FIGS. 4, 10 and 44). In other words, the sliding portion 16*f*1 is desired to be configured so that the plane of the edge surface 16*h* of the container shutter 16, on the downstream side in terms of the longitudinal direction of the toner containing portion 11, which squarely faces the driving force transmitting engaging portion 21*g* when the toner supply container 1 is inserted into the toner supplying apparatus 100, coincides with the plane of the surfaces of the teeth of the driving force receiving engaging portion 16*d*, on the downstream side in terms of the inserting direction of the toner supply container 1. Therefore, in this embodiment, a portion 16*g* is removed to shorten the sliding portion 16*f*1. Of the two surfaces created by removing the portion 16*g*, the one perpendicular to the longitudinal direction of the toner containing portion 11 is the aforementioned edge surface 16*h*. With this arrangement, the driving force transmitting engaging portion 21*g* and the container shutter 16 do not interfere with each other.

When the container shutter 16 is thick, the sliding portion 16*f*1 is extended across the entire curved edge of the container shutter 16, and in order to prevent the driving force transmitting engaging portion 21*g* from colliding with the sliding portion 16*f*1, the sliding portion 16*f*1 is provided with an indentation as an equivalent of the aforementioned missing portion 16*g* to allow the driving force transmitting engaging portion 21*g* to pass.

Figure 11:
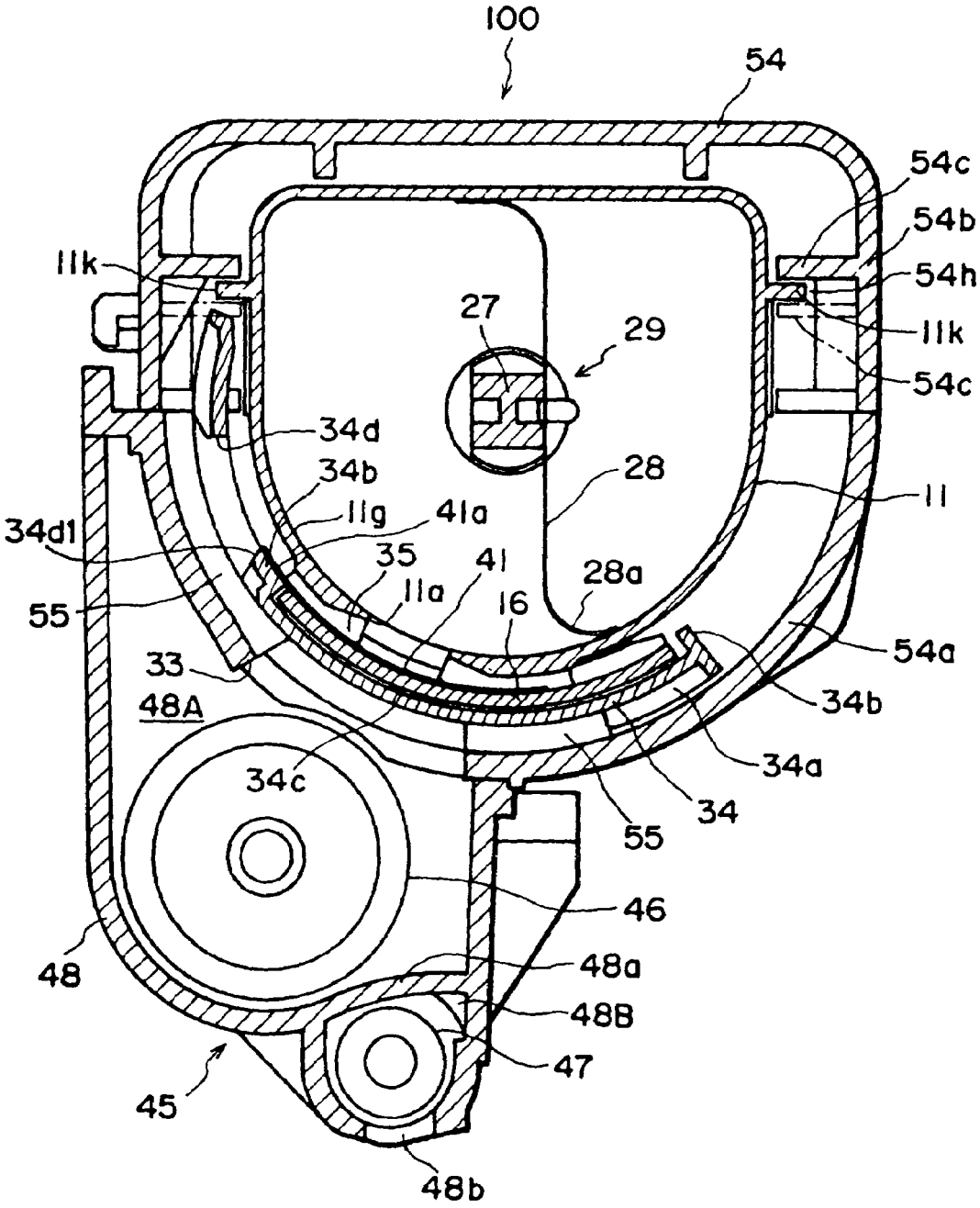
FIG. 11 is a vertical sectional view of a toner supplying apparatus, at a plane perpendicular to the longitudinal direction of the toner supplying apparatus (shutter is open).

Referring to FIG. 11, the container shutter 16 fits in an indented portion 34*c* formed between the surfaces 34*b*1 of the shutter 34 on the main apparatus side, which exposes or seals the toner inlet 33 with which the toner supplying apparatus 100 is provided. Being fitted in the indented portion 34*c*, the container shutter 16 can cause the shutter 34 on the main apparatus side to slide as the container shutter 16, which is on the side of the toner supply container 1, is slid.

Figure 3:
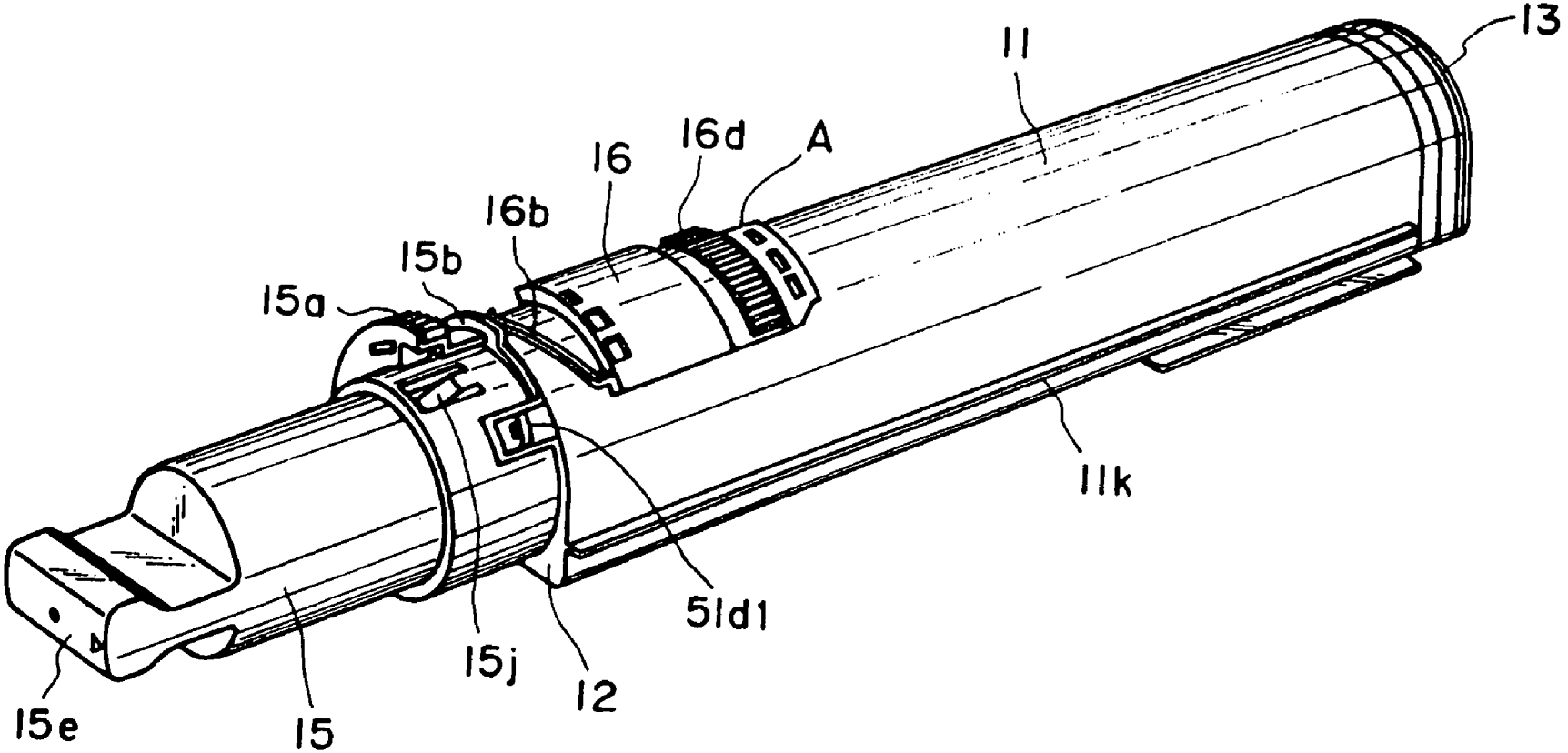
FIG. 3 is a perspective view of the toner supply container as seen from diagonally below the downstream side of its installation direction.

In this embodiment, the engaging portion 21*b* and 21*g* on the driving force transmitting side, with which the apparatus main assembly 124 is provided, comprise two gears as shown in FIG. 6. However, as long as a driving force transmitting mechanism is provided, there is no specific restriction regarding its structure, or the number of gears it comprises. Referring to FIG. 3, the container shutter 16 is provided with an elastic portion 16*b* in the form of an arm which generates such pressure that constantly applies to the handle 15 in the longitudinal direction of the toner containing portion 11. The tip of this elastic portion 16*b* is in contact with the flange 15*b* of the handle 15.

(Toner Supplying Apparatus)

Figure 13:
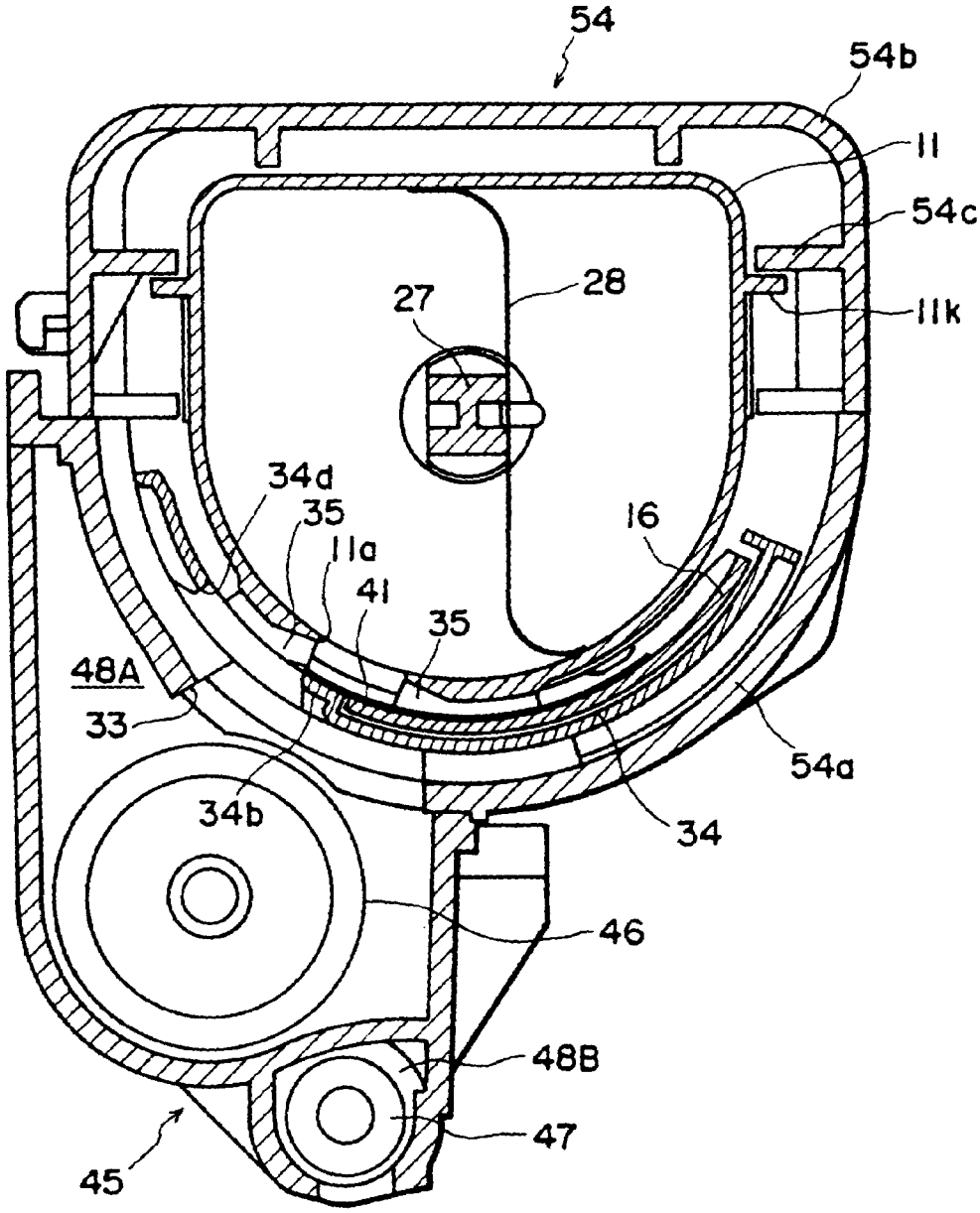
FIG. 13 is a vertical sectional view of the toner supplying apparatus, at the plane perpendicular to the longitudinal direction of the toner supplying apparatus (shutter is being opened or closed).

Referring to FIGS. 11-13, the toner supplying apparatus 100 is provided with a toner supplying apparatus main assembly 54, a cartridge receiving portion, which comprises a bottom portion 54*a* and a top portion 54*b*, the cross sections of which in the direction perpendicular to their lengthwise directions are semicircular and rectangular, respectively, to accommodate the toner containing portion 11. The top portion 54*b* is provided with a plurality of projections 54*c* for guiding a pair of guide portions 11*k* of the toner supply container 1. The projections 54*c* are on the inner surface of the top portion 54*b*. One pair of the projections 54*c* are at the entrance of the toner supplying apparatus main assembly 54, one for each side, and the other pairs are aligned inward of the toner supplying apparatus main assembly 54, one half the pairs being above the line correspondent to the position of the guide portion 11*k* and the other half being below the same line. The bottom portion 54*a* is provided with a pair of parallel guide rails 55, which are in the inwardly facing surface of the bottom portion 54*a* and extend in the circumferential direction of the bottom portion 54*a*. The guides 34*a* of the main assembly shutter 34 are engaged one for one in these guide rails 55. The guide rails 55 and the guide 34*a* are hook-like in their cross section, and interlock with each other. As is evident from the above description, there are two guide rails 55 and two guides 34*a*, which are parallel to each other. In other words, the main assembly shutter 34 is supported by the toner supplying apparatus main assembly 54. The radius of the inwardly facing surface of the projection 34*b* of the main assembly shutter 34 is exactly or approximately the same as that of the inwardly facing surface of the container shutter 16. The main assembly shutter 34 is provided with a pair of projections 34*b*, which are located at both edges, one for one, perpendicular to the moving direction of the main assembly shutter 34. The main assembly shutter 34 is provided with a main assembly shutter opening 34*d*. This opening 34*d* has only to be able to expose or seal the toner supply inlet 33; there may be only one cross section, i.e., a section 34*d*1. The width of inwardly facing surface of the main assembly shutter 34, between the two projections 34*b*, in the circumferential direction of the main assembly 54, is approximately the same as the width of the inwardly facing surface of the container shutter 16 in the circumferential direction of the main assembly 54. Therefore, as the toner supply container 1 is inserted into the toner supplying apparatus 100, it perfectly fits into the space 34*c* between the two projections 34*b* of the main assembly shutter 34, which project inward in the radial direction of the toner supply container 1; the two edges of the container shutter 16, which extend in the longitudinal direction of the main assembly 54, come virtually in contact with the corresponding inwardly facing surfaces 34*b*1 of the projections 34*b*. Therefore, as the container shutter 16 is opened or closed, the main assembly shutter 34 moves with the container shutter 16. Thus, if the two shutters 16 and 34 are designed so that the toner outlet 11*a* and the toner supply inlet 33 align with each other, as the container shutter 16 is opened, the toner can be supplied into the developing device 204 by a toner stirring-conveying apparatus 45. The main assembly shutter opening 34*d* and the space 34*c* are immediately adjacent to each other in the circumferential direction of the main assembly shutter 34, being bordered by the projection 34*b*.

(Packing Member)

The packing member 35 as a sealing member is an elastic member (FIGS. 4, 11-17). It assures that the toner outlet 11*a* is airtightly sealed by the container shutter 16. For example, it prevents the toner within the toner containing portion 11 from leaking due to the impact caused by the falling or the like of the toner supply container. For effectiveness, the packing member 35 is pasted to the outwardly facing surface of the toner containing portion 11 in a manner of surrounding the toner outlet 11*a*. More specifically, the material for the packing member 35 is rubbery material such as silicon rubber, urethane rubber, foamed polyethylene rubber, or the like, or sponge made of these rubbers. Preferably, it is slightly foamed polyurethane which is 20-70 deg. in hardness, no more than 10% in permanent compressive deformation, 60-300 μm in cell size, 0.15-0.50 g/in density, and 5-50% in compression ratio.

The packing member 35 is shaped so that the top surface of the portion next to the longitudinal edges of the toner outlet 11*a* is slanted downward toward the toner outlet 11*a*.

The packing member 35 shaped as described above is fixed to the surfaces adjacent to the toner outlet 11*a* with the use of adhesive or the like.

(Sealing Member)

As the toner supply container 1 is installed into the toner supplying apparatus 100, the container shutter 16 fits into the indentation 34*c* (space between the two projections 34*b*) of the main assembly shutter 34. The indentation 34*c* extends across the main assembly shutter 34 in the longitudinal direction, and the surface 34*b*1 functions as the guide for the container shutter 16. After the container shutter 16 is fitted in the indentation 34*c* of the main assembly shutter 34, the plane of the inwardly facing surface of the projection 34*b*, i.e., the brim of the main assembly shutter opening 34*d*, and the plane of the inwardly facing surface of the container shutter 16 are at approximately same level. Referring to FIGS. 11-17, the container shutter 16 is provided with a sealing member 41, which is on the surface on the container side. In order to cover the inwardly facing surface of the projection 34*b* next to the toner inlet 33 of the main assembly shutter 34, the sealing member 41 is extended downstream, in terms of the closing direction of the container shutter 16, beyond the container shutter 16. The sealing member 41 is a member for preventing the toner from entering the gap g between the container shutter 16 and the main assembly shutter 34. As long as this objective is accomplished, the material, shape, size, and method of attachment, of the sealing member 41 are optional.

As for the preferable structure for the sealing member 41 in this embodiment, a piece of 125 μm thick polyester sheet is pasted, as a sealing member, to the container shutter 16 with the use of double-sided adhesive tape (#5000NC: Nitto Denko Co., Ltd. (FIG. 20).

More specifically, since the sealing member 41 is structured to cover the projection 34*b* of the main assembly shutter 34 as described before, it is desired not to interfere with the installation or removal of the toner supply container 11 by hanging up or colliding. The main assembly shutter 34 is not necessarily smooth on the container facing surface. But, the sealing member 41 is required to perfectly conform to the container facing surface of the main assembly shutter 34. Because of requirements such as the above, the sealing member 41 is desired to be formed of flexible sheet or sheet formed of elastic material.

As for the method for attaching the sealing member 41, any of various known attaching means may be employed in addition to the aforementioned double-sided adhesive tape as long as it satisfies the requirement that the sealing member 41 does not peels off in spite of repetitive opening and closing of the container shutter 16 which occurs as the toner supply container 1 is repeatedly installed or removed.

It is most preferable that elastomer be used as the material for the sealing member 41, and the sealing member 41 be integrally formed with the container shutter 16 by two color injection molding. In such a case, it is desired that the elastomer for the sealing member 41 and the material for the container shutter 16 are compatibly selected. Also, the sealing member 41 and container shutter 16 may be formed of the same material. In such a case, they can be integrally formed with the use of a simple method.

(Function of Sealing Member)

Next, the function of the sealing member 41 will be described.

Figure 19:
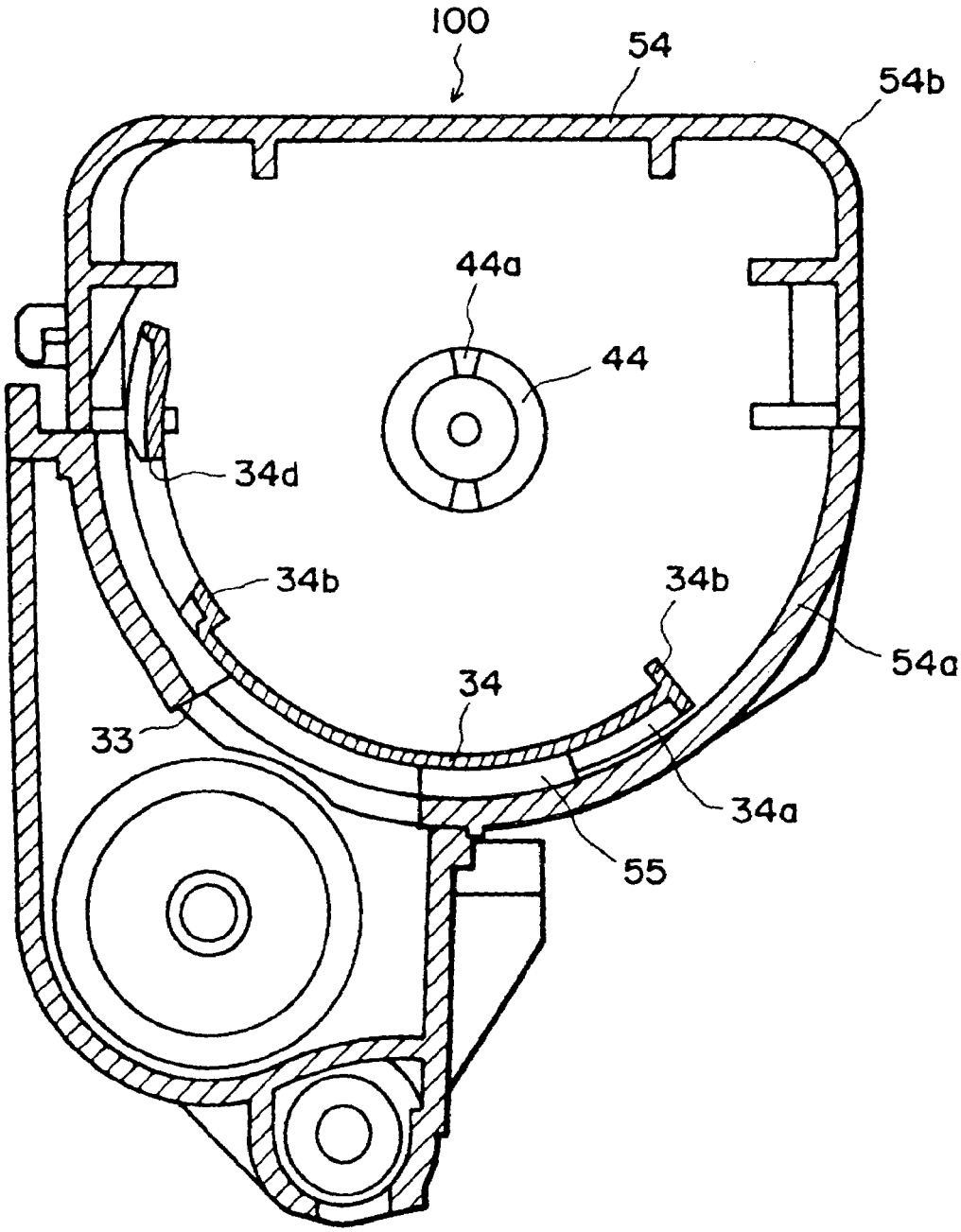
FIG. 19 is a vertical sectional view of the toner supplying apparatus, at a plane perpendicular to the longitudinal direction of the toner supplying apparatus, in which there is no toner supply container.

The state of the main assembly of the toner supplying apparatus 100 when the toner supply container 1 has been removed, that is, when the container shutter 16 is not in engagement with the main assembly shutter 34 is as shown in FIG. 19. In this state, the main assembly shutter 34 is positioned to seal the toner inlet 33 to prevent foreign substances such as dust from entering the toner supply container 1 through the toner inlet 33.

FIG. 12 shows the state in which the toner supply container 1 has been installed, and the toner is being replenished. In this state, the container shutter 16 has retreated from the toner outlet 11*a*, allowing a passage to be formed through the toner outlet 11*a*, main assembly shutter opening 34*d*, and toner inlet 33. Also in this state, the plane of the container facing surface of the container shutter 16 and the plane of the container facing surface of the projection 34*b* next to the opening 34*d* of the main assembly shutter 34 is at approximately the same level. Therefore, the sealing member 41 is in contact with the projection 34*b* of the main assembly shutter 34, keeping the toner passage airtight, and at the same time, preventing the toner from adhering to the surface of the projection 34*b* of the main assembly shutter 34. Also in this state, the toner having been stored in the toner supply container 1 is conveyed toward the toner stirring-conveying apparatus 45, i.e., a toner receiving apparatus, by the function of the toner conveying member 29 contained in the toner supply container 1 through the toner outlet 11*a*, opening 34*d*, and toner inlet 33 through which the toner passage has been established.

Figure 14:
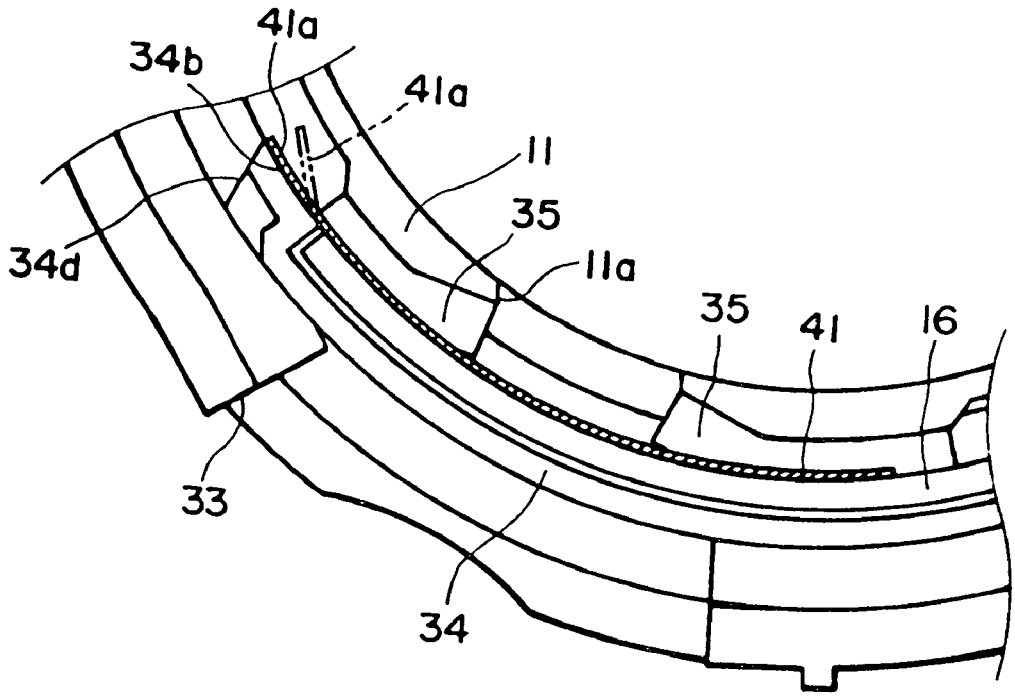
FIG. 14 is an enlarged view of an essential portion of FIG. 11.
Figure 15:
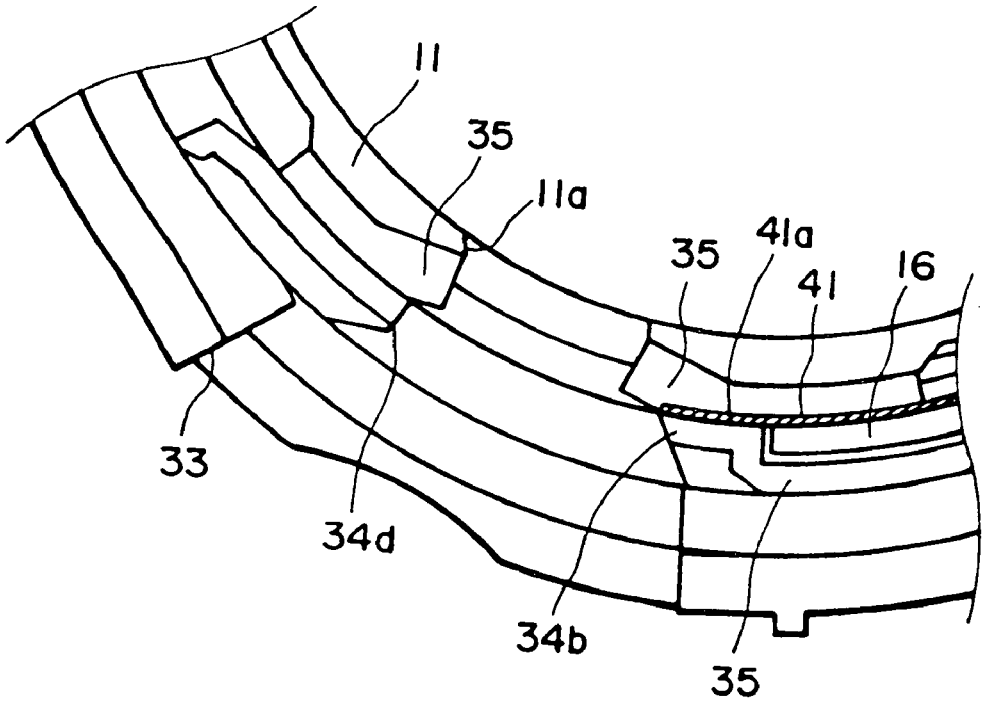
FIG. 15 is an enlarged view of an essential portion of FIG. 12.

Referring to FIGS. 14 and 15, which are enlarged drawings of the portions in FIGS. 11 and 12, respectively, even if the end portion of the sealing member 41 is pinched between the projection 34*b* of the main assembly shutter 34 and the packing member 35 while the shutters 16 and 34 are moved in the opening direction from the positions in FIG. 14 to the positions in FIG. 15, the airtightness of the toner passage at this location is not broken, because the sealing member 41 is formed of thin PET sheet. For assurance, the thickness of the sealing member 41 is desired to be no less than 50 μm and no more than 300 μm, preferably, no less than 70 μm and no more than 200 μm, and ideally, 125 μm. If the sealing member is excessively thick, it fails to properly seal the gap between the main assembly shutter 34 and toner supply container 1. On the other hand, if it is excessively thin, it fails to properly perform its primary function, that is, the function to prevent the toner from entering between the container shutter 16 and main assembly shutter 34. As a result, various problems occur while the toner supply container 1 is handled, in particular, while the toner supply container 1 is installed into, or removed from, the toner supplying apparatus 100. For example, the sealing member 41 is peeled back or wrinkled.

The requirement regarding the thickness of the sealing member 41 can be eliminated by the provision of the structure in which the sealing member 41 is retracted to a point where the sealing member 41 does not contact the packing member 35. However, such a structure makes the shutter stroke substantially longer, making it difficult to give a toner supplying apparatus and a toner supplying container a compact design.

Figure 16:
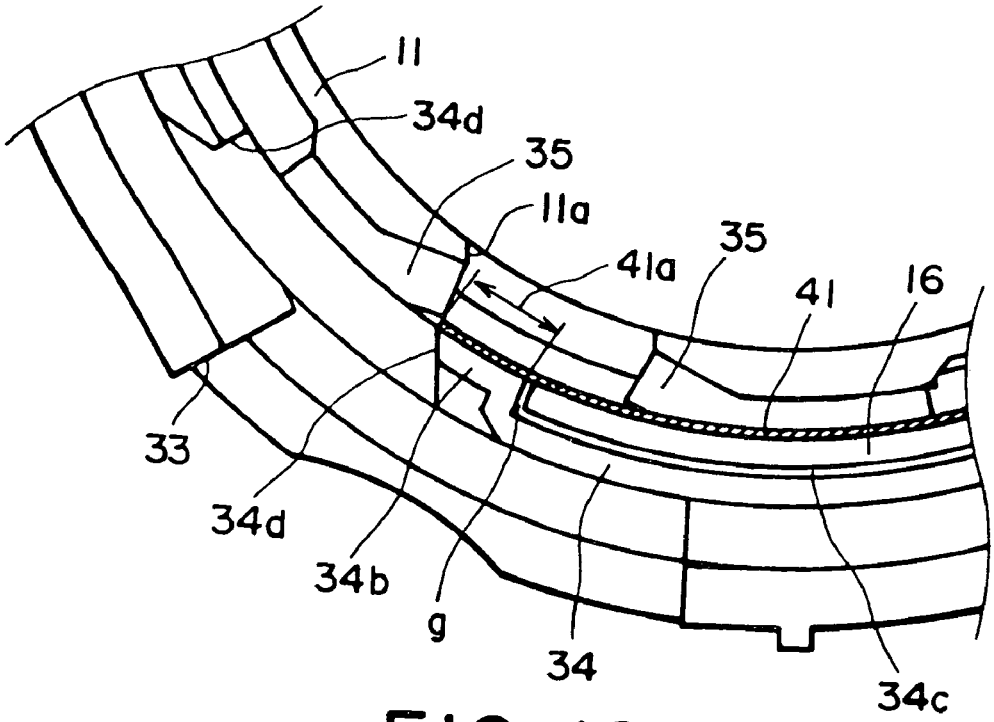
FIG. 16 is an enlarged view of an essential portion of FIG. 13.
Figure 17:
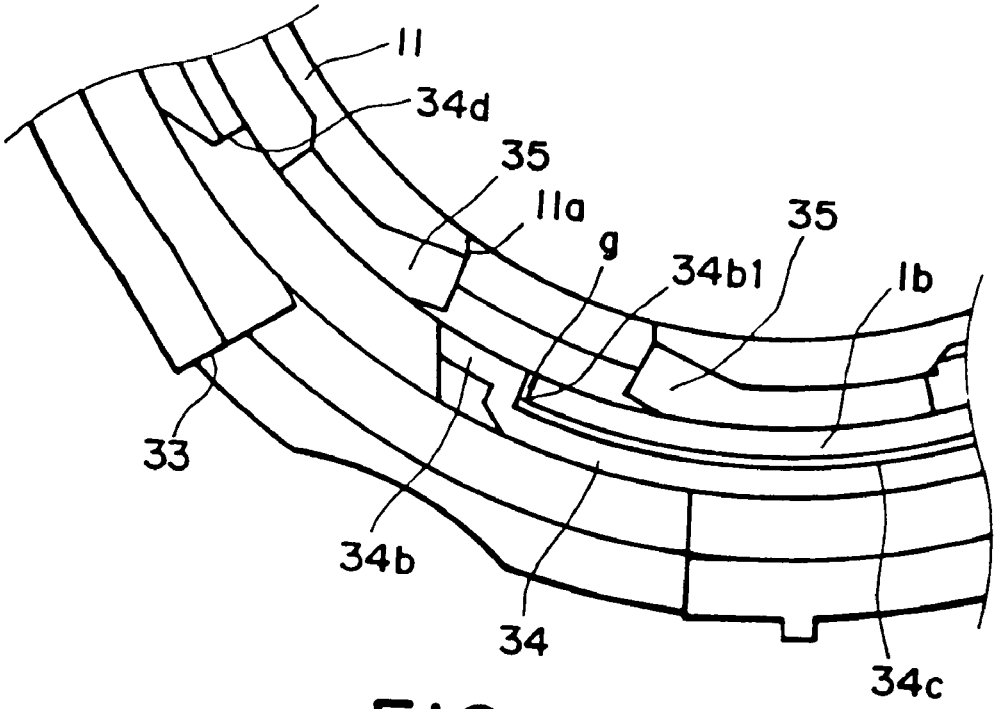
FIG. 17 is an enlarged view of an essential portion of the vertical sectional view of a toner supplying apparatus provided with no sealing member, at a plane perpendicular to the longitudinal direction of the toner supply container, and corresponds to FIG. 16.
Figure 18:
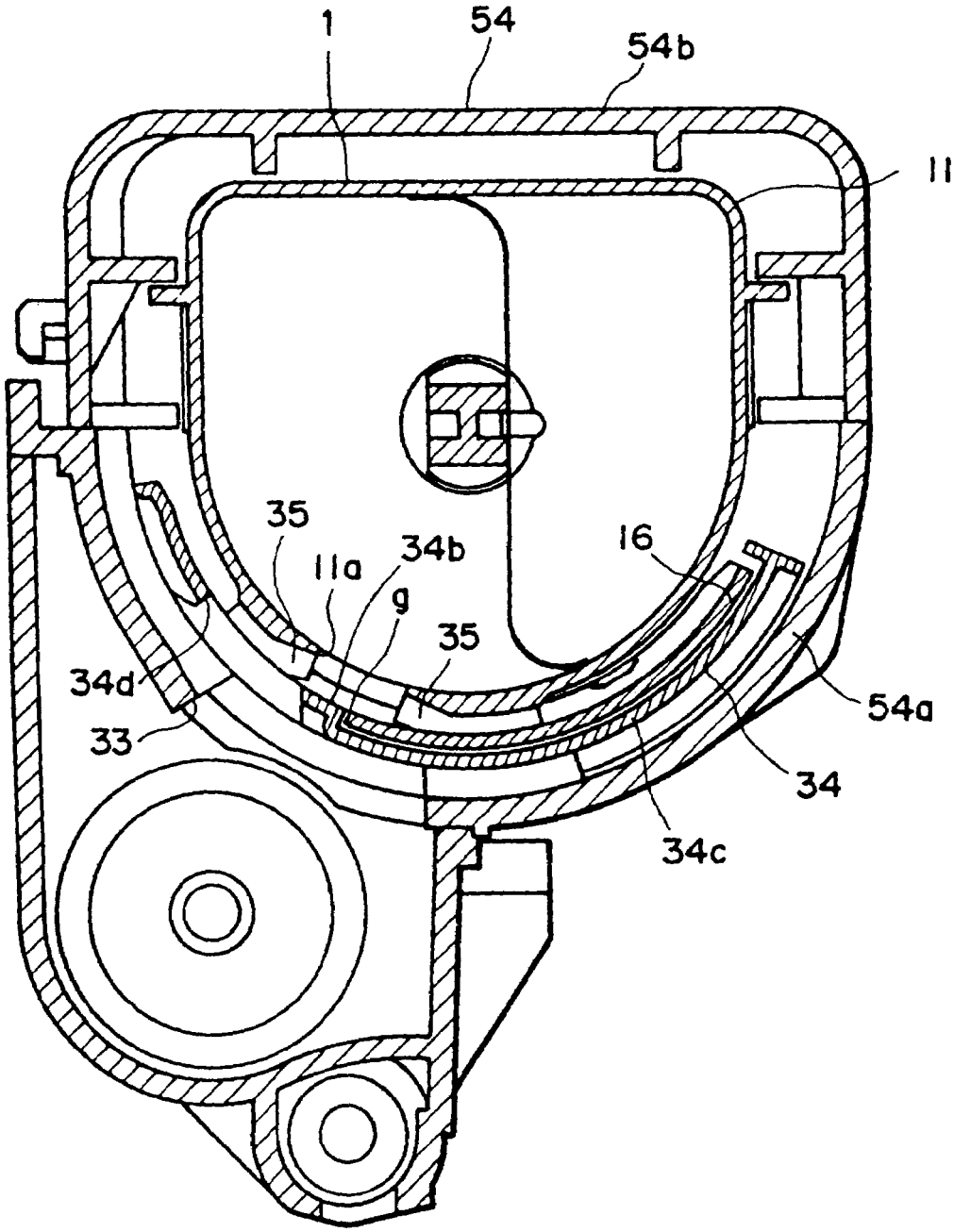
FIG. 18 is an enlarged view of an essential portion of the vertical sectional view of the toner supplying apparatus provided with no sealing member, at the plane perpendicular to the longitudinal direction of the toner supplying apparatus, and corresponds to FIG. 13.

Next, a state in which the toner supply container 1 is removed before a "no toner" light in the warning panel 124*a* is lit, and the function of the sealing member 41 in such a state, will be described. In this state, a substantial amount of toner is still stored in the toner supply container 1. In other words, any of the toner outlets 11*a* of the toner supply container 1, the main assembly shutter opening 34*d*, and the toner supply inlet 33, is filled with the toner. The first step to be taken to remove the toner supply container 1 in this state is to seal the open portions. As the container shutter 16 is moved in the closing direction, the main assembly shutter 34, which is in engagement with the container shutter 16, moves with the container shutter 16 in the direction to close the toner supply container 1. The toner at the main assembly shutter opening 34*d* moves undisturbed in the closing direction, and becomes separated from the toner in the toner supply container 1 and the toner in the toner stirring-conveying apparatus 45, as shown in FIG. 16. During this closing step, the gap G between the main assembly shutter 34 and container shutter 16 passes directly below the toner outlet 11*a* as shown in FIG. 16. Thus, if there were no sealing member 41 as shown in FIGS. 17 and 18, the toner within the toner supply container 1 would rush into the gap g. In reality, however, the sealing member 41 covers this gap g as shown in FIG. 16, preventing the toner from entering the gap g.

Also during this closing step, the sealing member 41 and container shutter 16 are under the contact pressure generated downward (in drawings) by the resiliency o the packing member 35. Therefore, the portion 41*a* of the sealing member 41, which extends beyond the edge of the sealing member 41, is also pressed upon the container facing surface of the main assembly shutter 34, not only gaining in sealing performance but also in preventing the toner from adhering to the surface of the projection 34*b* of the main assembly shutter 34.

The state in which main assembly shutter 34 and container shutter 16 have been completely closed is as shown in FIG. 14. In this state, the toner adhesion to the exterior surfaces of the container shutter 16 and toner containing portion 11 is prevented although the toner adheres to the surface of the extension portion 41*a* of the sealing member 41, on the side of the toner supply container 1. The amount of the toner which adhered to the inwardly facing surface of the aforementioned extension portion 41*a* of the sealing member 41 is extremely small, and also, the location at which the toner adheres to the extension portion 41*a* is in the small pocket created between itself and the toner containing portion 11. Therefore, it is very difficult for the toner to come out once it adheres to the extension portion 41*a*; it rarely scatters outward of the pocket.

For a reason which will be described later, the length by which the aforementioned extension portion 41*a* extends is desired to be approximately the same as the width of the projection 34*b* of the main assembly shutter 34. More specifically, it is desired to be set at a value no less than 2 mm and no more than 10 mm, preferably, no less than 4 mm and no more than 8 mm, and ideally, at 6 mm. If the extension portion 41*a* is excessively short, it is unsatisfactory in terms of effectiveness in preventing the toner invasion of the aforementioned gap g, and also, the aforementioned pocket which the sealing member 41 and toner containing portion 11 form is shallow, failing to retain the toner. In addition, it fails to prevent the toner adhesion to the surface of the projection 34*b* of the main assembly shutter 34.

On the other hand, if the extension portion 41*a* is excessively long, it interferes with the installation or removal of the toner supply container 1. For example, it collides with the various portions of the internal surface of the toner supplying apparatus 100, which is a problem. In addition, the pressure generated by the aforementioned packing member 35 fails to be transmitted to the farthest portion of the extension portion 41*a*, causing the sealing member 41 to lose in sealing performance. Obviously, the pressure can be transmitted to the farthest portion of the extension portion 41*a* of the sealing member 41 by increasing the rigidity of the sealing member 41. However, such a practice reduces the ability of the sealing member 41 to conform to the surface of the main assembly shutter 34, also causing the sealing member 41 to lose in sealing performance. Further, if the extension portion 41*a* is excessively long, it makes the main assembly shutter opening 34*d* too small, possibly interfering with the passage of the toner.

A case in which the sealing member 41 is not provided is shown in FIGS. 17 and 18. In this case, as the main assembly shutter 34 is moved in the closing direction before the "no toner" light is lit in the warning panel 124*a*, the gap g between the container shutter 16 and main assembly shutter 34 is exposed to the toner. As a result, the toner invades the gap g, and the outwardly facing surface of the container shutter 16 is contaminated by the adhesion of the toner which invaded the gap g. Since there is no outlet for the toner which invaded the indentation of the main assembly shutter 34*c*, i.e., the space between the mutually facing surfaces 34*b*1 of the projections 34*b* of the main assembly shutter 34, the toner continues to accumulate there. Therefore, unless the indentation 34*c* is cleaned during the maintenance of the image forming apparatus, the contamination of the toner supply container 1 worsens. Further, the toner also adheres to the projection 34*b* of the main assembly shutter 34, and this toner transfers onto the toner supply container 1, on the surface which opposes the projections 34*b*; in other words, it contaminates the toner supply container 1.

[Sealing Member Design 1 Different from Preceding Design]

In the case of this design, a material low in friction is placed on the surface of the sealing member.

In order to gain in sealing performance, the ratio with which the packing member 35 is compressed is desired to be as high as possible, since the compressive stress of the packing member 35 is proportional to the compression ratio. In other words, when the compression ratio is small, the compressive stress of the packing is also small, and therefore, the sealing performance of the packing member 35 is at an unsatisfactory level. Thus, when the compression ratio is small, the toner leak due to the impact caused by a fall or the like of the toner supply container. On the other hand, if the compression ratio is excessively increased, the compression stress of the packing member 35 also becomes excessively high. This improves the packing member 35 in sealing performance, and at the same time, increases load in terms of sliding. As a result, the force required to open or close the container shutter 16 increases.

Thus, in order to improve the sealing performance while reducing, or at least without increasing, the force necessary to drive the shutters, a piece of flexible film 42 as a low friction material is pasted to the sealing member 41, on the surface which faces the packing member 35, as shown in FIGS. 20 and 21, so that the amount of the frictional resistance between the surfaces of the sealing member 41 and packing member 35 is reduced. More specifically, flexible film created by coating silicon oil, silicone wax, silicone containing paint, or the like, on a base film, for example, film comprising a single layer of polyester, biaxially stretched polypropylene (OPP), polyamide, polyethylene, or fluorinated resin, or film comprising mixed layers of preceding materials, is used as the material for the flexible film 42.

The thickness of the layer of the silicone oil on the aforementioned flexible film 42 is desired to be in a range of 0.05-2 μm, preferably, 0.1-0.5 μm. If the thickness of the coated layer of silicone oil is excessively thick, the toner in the toner containing portion 11 is negatively affected, whereas if it is excessively thin, the flexible film 42 is not effective to satisfactorily reduce the force necessary to open or close the shutters.

The toner supply container 1 with the above described structure was installed in the toner supplying apparatus 100, and the operation for removing the toner supply container 1 before the "no toner" light is lit was repeated. However, just as in the case of the sealing member illustrated in FIG. 20, (*b*), there was no sign of contamination traceable to the toner adhesion to the outwardly facing surface of the container shutter 16 and its adjacencies., and no sign of toner accumulation, providing that the above described structure improved the sealing performance of the sealing member without increasing the driving force necessary to open or close the container shutter 16.

[Sealing Member Design 2 Different From Preceding Two Designs]

In this version, as the toner supply container 1 is inserted into the toner supplying apparatus 100, the extension portion 41*a* of the sealing member 41 rides onto the projection 34*b* of the main assembly shutter 34 from the one of the longitudinal ends of the projection 34*b* of the main assembly shutter 34.

Figure 27:
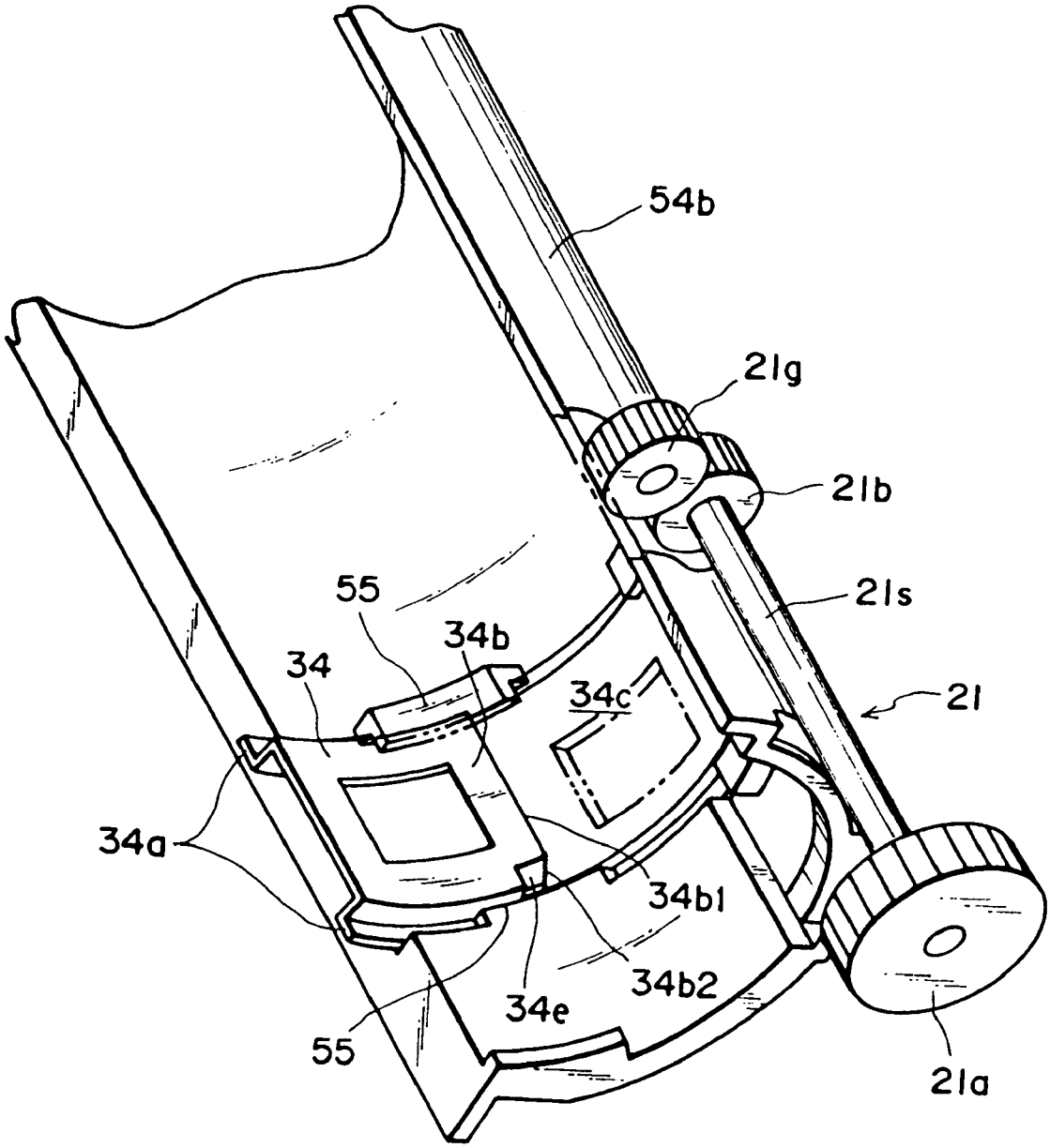
FIG. 27 is a perspective view of the main portion of the shutter on the toner supplying apparatus side.
Figure 39:
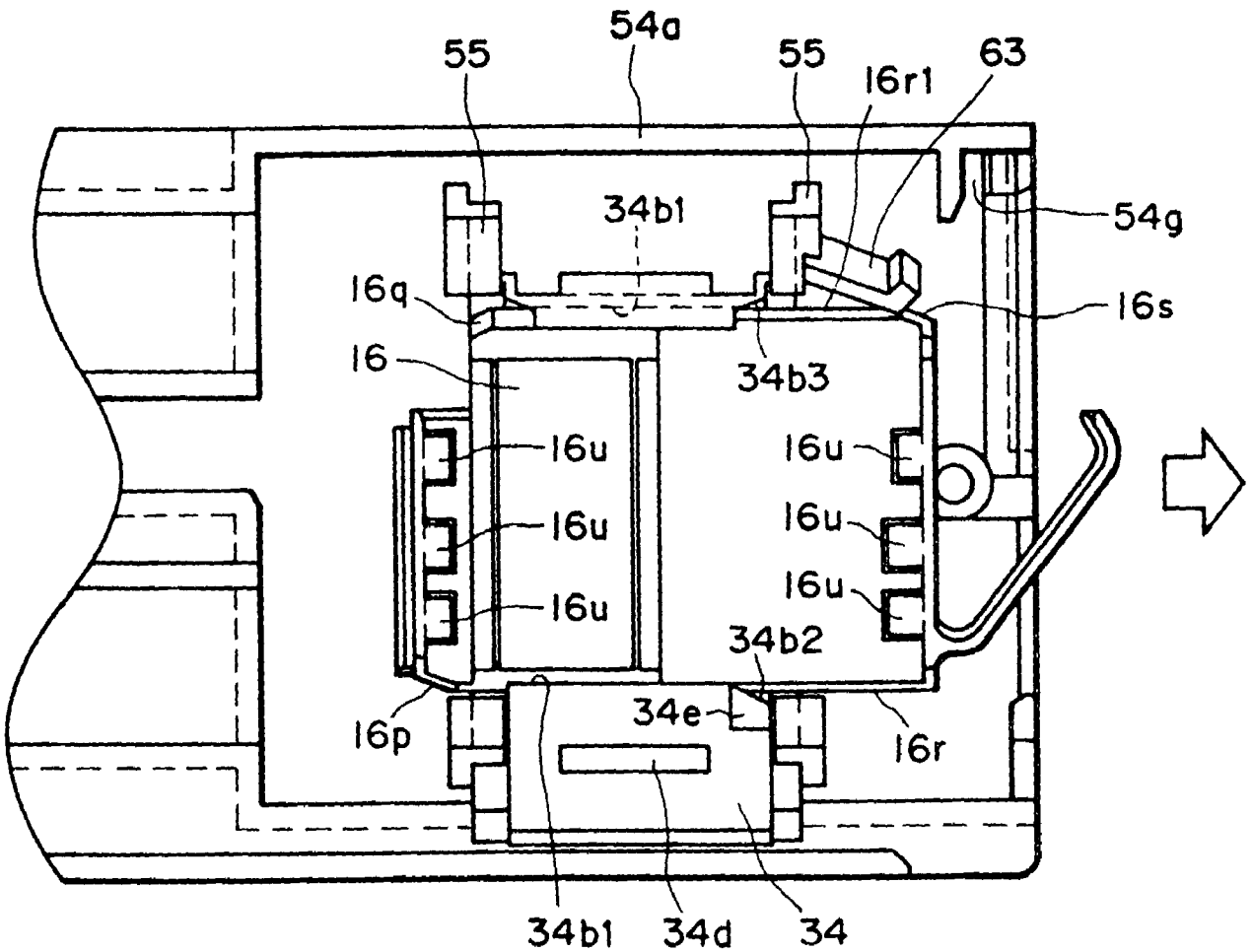
FIG. 39 is a horizontal sectional view of the toner supplying apparatus.
Figure 40:
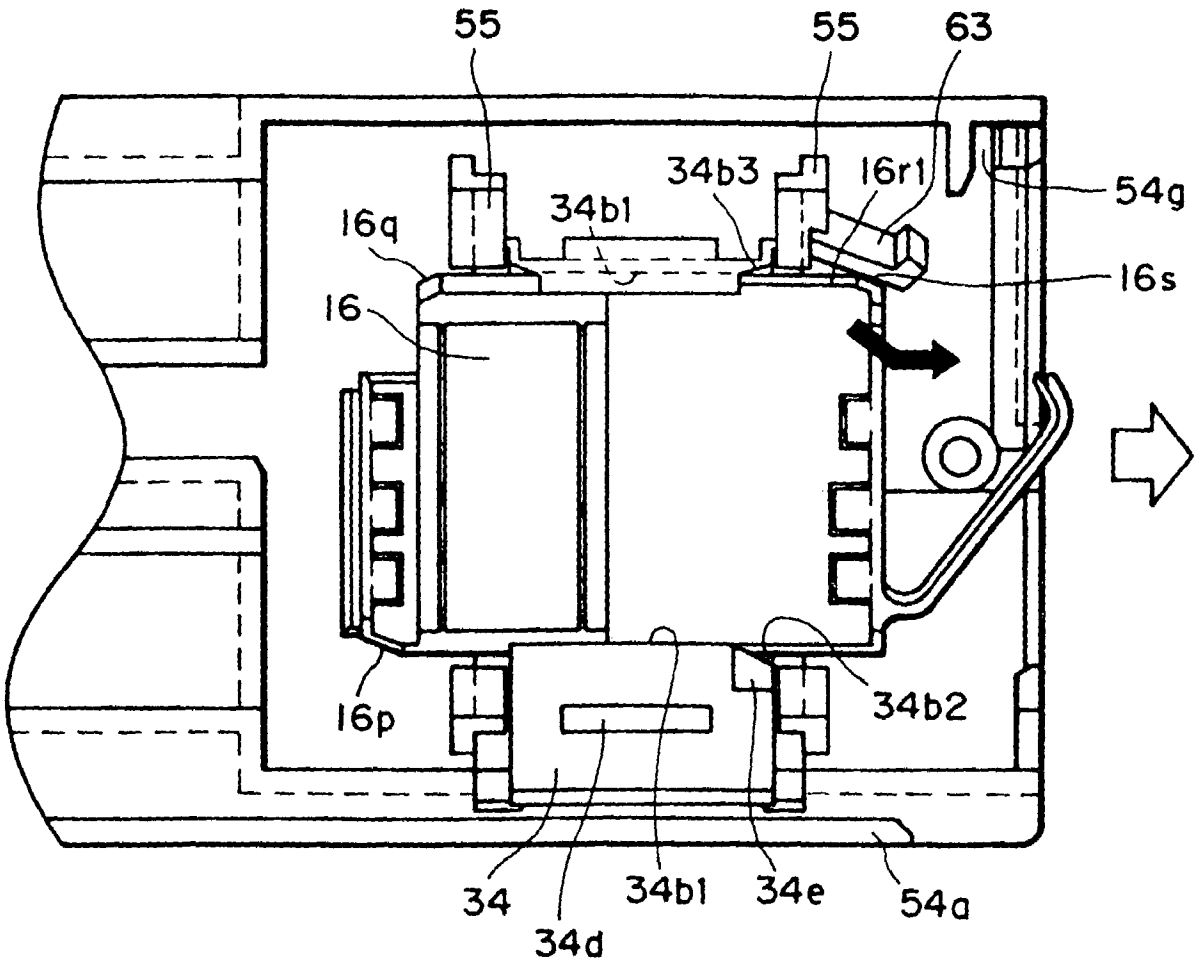
FIG. 40 is also a horizontal sectional view of the toner supplying apparatus.

Thus, in order to make it easier for the container shutter 16 to slide into the indentation 34*c* (space) between the opposing surfaces 34*b*1 of the projections 34*b* of the main assembly shutter 34, the projection 34*b* of the main assembly shutter 34 is chamfered at the opposing downstream corners in terms of the inserting direction, i.e., both downstream corners in FIG. 27 (right-hand corner is behind the bottom portion 54*b* of the toner supplying apparatus main assembly 54), creating the surface 34*b*2, and the corresponding corners of the container shutter 16 are also chamfered, creating surfaces 16*p* and 16*q* (FIGS. 39 and 40).

Further, referring to FIG. 27, the main assembly shutter 34 is provided with an entrance guide portion 34*e*, which is located at the upstream corner of the projection 34*b* of the main assembly shutter 34 to allow the extension portion 41*a* of the sealing member 41 to smoothly ride onto the projection 34*b*. This entrance guide portion 34*e* is a slanted surface, which is located on the upstream corner of the projection 34*b*, and inclines in the downward and upstream direction from the container facing surface of the projection 34*b*.

The provision of an entrance guide portion such as the one described above is effective in preventing the extension portion 41*a* from being damaged at the corners as the extension portion 41*a* of the sealing member 41 rides onto the projection 34*b* of the main assembly shutter 34.

FIGS. 22-26 show the structure for helping the extension portion 41*a* of the sealing member 41 more smoothly advance onto the projection 34*b* from the entrance guide portion 34*e* of the projection 34*b* of the main assembly shutter 34.

Figure 22:
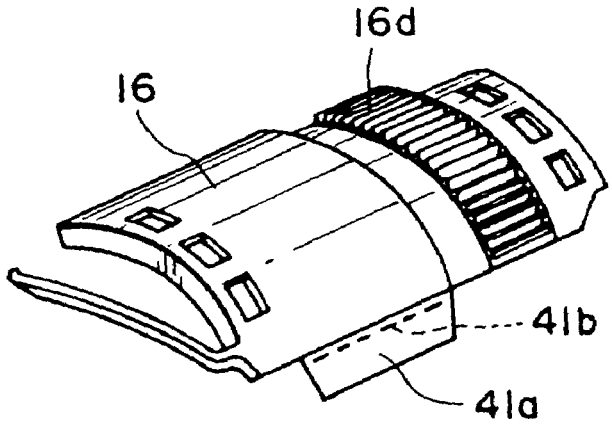
FIG. 22 is a perspective view of the toner supply container shutter (with perforation).
Figure 25:
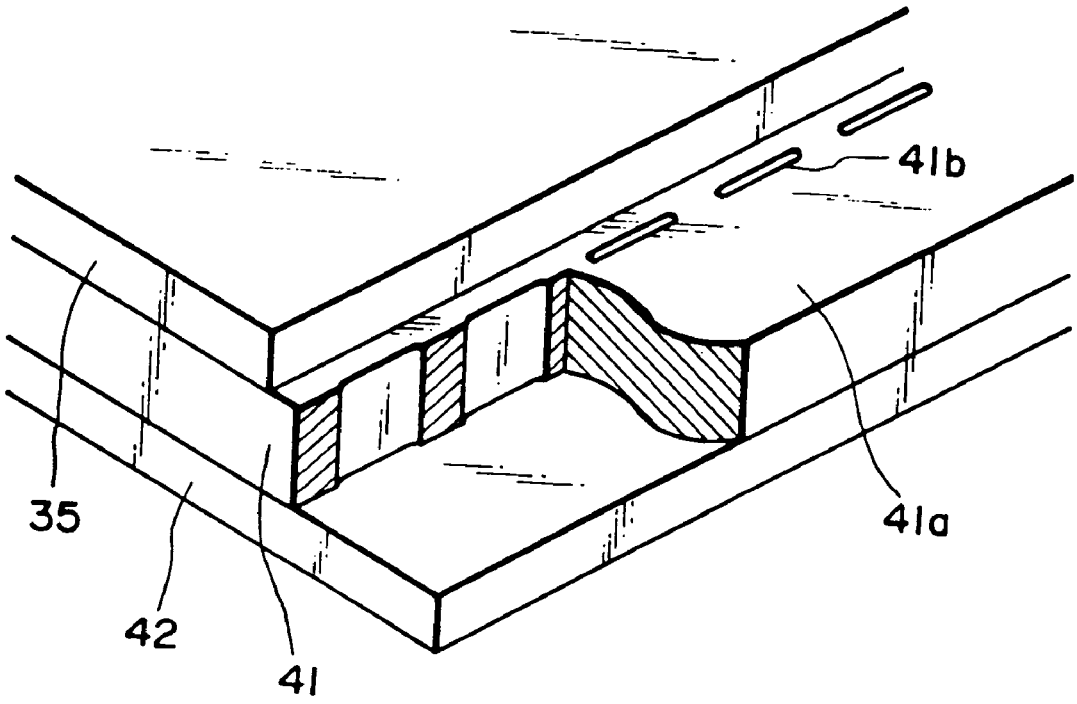
FIG. 25 is a perspective view of the sealing member of the toner supply container shutter (with perforation).
Figure 26:
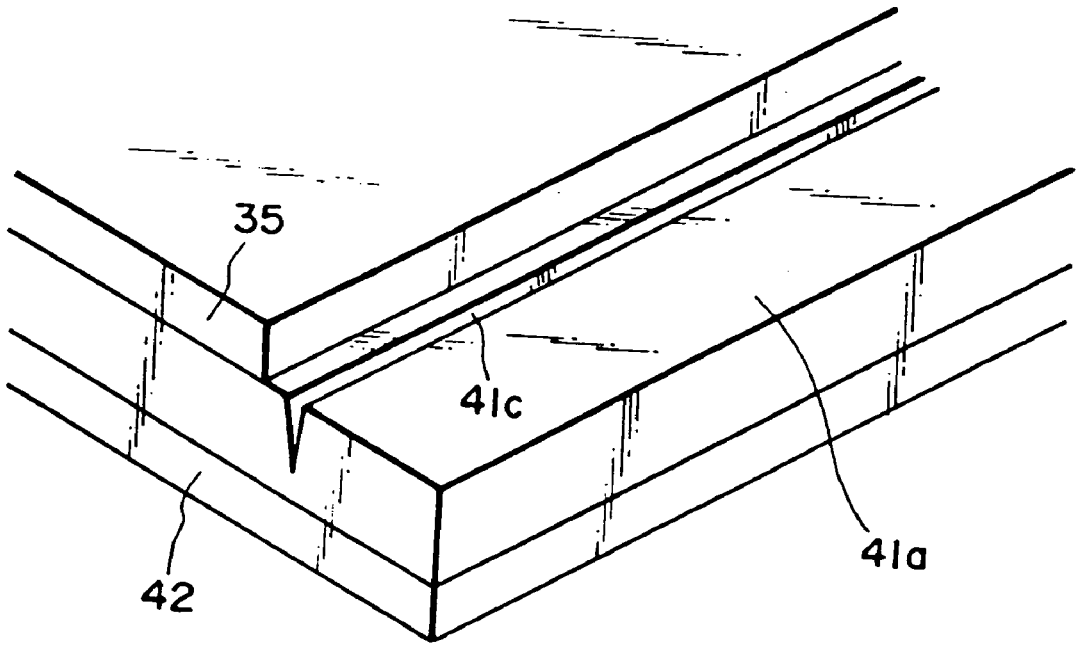
FIG. 26 is a perspective view of the sealing member of the toner supply container shutter (with a groove).

Referring to FIG. 22, the sealing member 41 is provided with a single line of perforation 41*b*, which extends along the base portion of the extension portion 41*a*. FIG. 25 is a perspective view of the sealing member 41 provided with the perforation 41*b*. Referring to FIG. 26, instead of being provided with the perforation 41*b*, the sealing member 41 may be provided with a groove 41*c* which extends along the extension portion 41*a* of the sealing member 41 in the longitudinal direction. In this embodiment, the groove 41*c* may be V-shaped or U-shaped in cross section.

With the provision of the above arrangement, as the extension portion 41*a* of the sealing member 41 comes in contact with the entrance guide portion 34*e* of the main assembly shutter 34 before it rides onto the projection 34*b* of the main assembly shutter 34, it bends at the perforation or groove, preventing its longitudinal end from being damaged.

Figure 23:
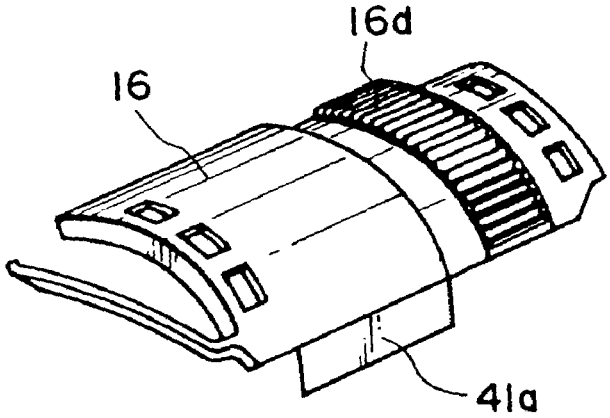
FIG. 23 is a perspective view of the toner supply container shutter (with a bent portion).
Figure 24:
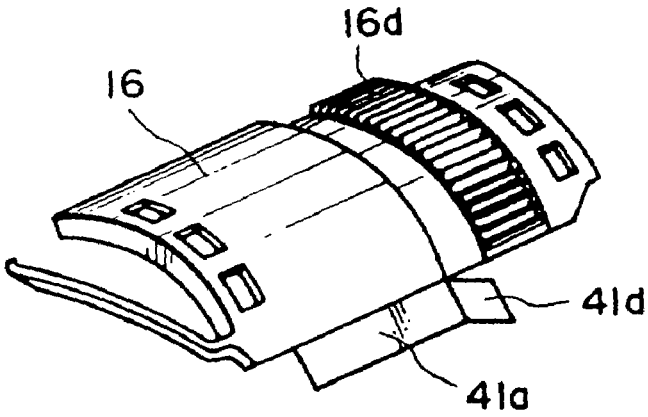
FIG. 24 is a perspective view of the toner supply container shutter (with a diagonally projecting piece).

In the preceding description of the sealing member 41, the sealing member 41 inclusive of the extension portion 41*a* was arc-shaped in cross section. However, the extension portion 41*a* of the sealing member 41 may be bent at its base line toward the toner containing portion 11, as shown in FIG. 23. Being bent as described above, the extension portion 41*a* can smoothly rides onto the projection 34*b* of the main assembly shutter 34 as depicted by the double dot chain line in FIG. 14. Even if the extension portion 41*a* is bent in this manner, when the container shutter 16 and main assembly shutter 34 open the toner outlet 11*a* and main assembly shutter opening 34*d*, the extension portion 41*a* is pinched at both longitudinal edges between the packing member 35 and the other projections of the main assembly shutter 34, perpendicular to the projection 34*b*. Therefore, the projection 34*b* and the extension portion 41*a* tightly contact with each other. In the case of the design illustrated in FIG. 23, since the extension portion 41*a* is bent, its tip portion remains firmly in contact with the packing member 35, sliding on the packing member 35, during the opening or closing of the container shutter 16. Therefore, it is liable that the extension portion 41*a* becomes damaged. The design illustrated in FIG. 24 is a design in which the above concern has been eliminated. In this design, the extension portion 41*a* is provided with a sub-extension portion 41*d*, which extends at an angle from the downstream edge, in terms of the toner supply container 1 installation direction, of the extension portion 41*a*. In this case, extension portion 41*d* is positioned not to contact the packing member 35. Therefore, the aforementioned problems do not occur. In other words, this embodiment is the ideal one.

(Locking Member)

The toner cartridge is provided with a locking member 51 in the form of a ring so that the handle 15 is locked to the toner containing portion 11 before the toner supply container 1 is installed into the main assembly 124 of an image forming apparatus, and after the toner supply container 1 has been removed from the apparatus main assembly 124 (FIGS. 7 and 8).

The locking member 51 is rotationally fitted around the first flange 12, more specifically, the locking member engagement portion 12*g* of the first flange portion, that is, the portion immediately next to the end plate 12*b* of the first flange 12. It is also movable in the direction in which the toner supply container 1 is inserted into, or removed from, the toner supplying apparatus 100 (direction indicated by an arrow mark in FIG. 7, and also the opposite direction).

The locking member 51 comprises a cylindrical ring portion 51*a*, i.e., the portion which fits around the locking member engagement portion 12*g*, and is provided with a notch 51*b* which faces the aforementioned end plate 12*b*. The notch 51*b* is in engagement with the locking projection 12*h* with which the first flange 12 is provided. The locking member 51 integrally comprises an arm-like springy portion 51*c* which presses upon the end surface 15*i* of the handle 15. The first flange 12 is provided with a circumferential ridge 12*i* which is on the cylindrical portion 12*e*, and circles around the cylindrical portion 12*e*. Further, the handle 15 integrally comprises a stopper 15*j*, which is formed by outwardly bending a portion of the handle 15. The tip of the stopper 15*j* is kept in contact with the ridge 12*i* by the resiliency of the aforementioned springy portion 51*c*, to prevent the handle 15 from slipping off the cylindrical portion 12*e* of the first flange 12 (FIG. 3). Further, the locking member 51 is kept in contact with the end plate 12*b* of the first flange 12 by the resiliency of the springy portion 51*c*.

The springy portion 51*c* is gradually reduced in cross section toward its tip, being enabled to evenly bend across its entire length, to prevent the base portion of the springy portion 51*c* from turning white due to the concentration of the bending stress to the base portion. In other words, when the cross section of the springy portion 51*c* is rectangular, it is made gradually smaller in the width or thickness direction toward the tip. Therefore, the springy portion 51*c* gradually reduces in cross section from its base portion to its tip.

A pair of engagement ribs 51*d* provided on the outwardly facing surface of the locking member 51 are enabled to move in the installation-removal direction of the toner supply container 1 by being loosely fitted, one for one, in grooves 15*k* and 15*m* which are cut in the handle 15 in the installation-removal direction of the toner supply container 1. The engagement rib 51*i* of the locking member 51 is engaged in the groove 15*j* of the handle 15. Therefore, the handle 15 and locking member 51 are prevented from moving relative to each other in their circumferential direction, but are allowed to move relative to each other in their axial direction (FIGS. 37 and 38).

The length, in terms of the installation-removal direction of the toner supply container 1, of the locking projection 12*h* provided on the first flange 12 is less than the length of the stroke of the engagement ribs 51*d* through the grooves 15*k* and 15*m*, one for one, in the installation-removal direction of the toner supply container 1. Further, the length, in terms of the installation-removal direction of the toner supply container 1, of the locking projection 12*h* is less than the length of the stroke of the engagement rib 51*i* of the locking member 51 through the groove 15*j* of the handle 15.

With the provision of the above structure, the notch 51*b* of the locking member 51 is kept engaged with the locking projection 12*h* of the first flange 12 by the resiliency of the springly portion 51*c* of the locking member 51. Therefore, whatever state the toner supply container 1 is in, the state in which it is being inserted into the toner supplying apparatus 100, the state in which it is being removed from the toner supplying apparatus 100, or the state in which it is out of the toner supplying apparatus 100, the handle 15 is not allowed to move in its circumferential direction relative to the toner containing portion 11. More specifically, in this embodiment, the handle is allowed to slip in its circumferential direction by six degrees, which is equivalent to the amount of the play between the projection 12*h* provided on the first flange 12 and the notch 51*b* of the locking portion 51. It should be noted here that the projection 12*h* of the first flange 12 is provided also as a means for properly aligning the handle 15 relative to the toner supplying apparatus 100 in terms of the circumferential direction of the handle 15 when installing the toner supply container 1 into the toner supplying apparatus 100. This subject will be described later. In other words, when the toner supply container is out of the image forming apparatus main assembly, the handle 15 is rotatable relative to the toner containing portion 11, by six degrees, which is equivalent to the distance between a first position, or the one end of the rotatable range, and a second position, or the other end of the rotatable range.

The locking member 51 is provided with a latch 51*e*, which is a thin piece of projection and projects outward in the radial direction from the engagement rib 51*d* which is adjacent to the springy portion 51*c*. The latch 51*e* prevents the toner supply container 1 from coming out of the main assembly 54.

[Function of Locking Member]

Next, the function of the locking member 51 will be described. As the toner supply container 1 is inserted into the toner supplying apparatus 100 by engaging the guide portion 11*k* of the toner supply container 1 between the projections 54*d* of the toner supplying apparatus main assembly 54, the container shutter 16 and main assembly shutter 34 engage with each other. While the container shutter 16 engages with the main assembly shutter 34, the driving force receiving engaging portion 16*d* of the container shutter 16 partially meshes with the driving force transmitting engaging portion 21*g*, and immediately thereafter, the driving force transmitting engaging portion 15*a* of the handle 15 partially meshes with the driving force receiving engaging portion 21*a*. after the container shutter 16 partially engages with the main assembly shutter 34, the aforementioned extension portion

41*a* of the sealing member 41 rides onto the projection 34*b* past the entrance portion 34*e* of the main assembly shutter 34.

Figure 33:
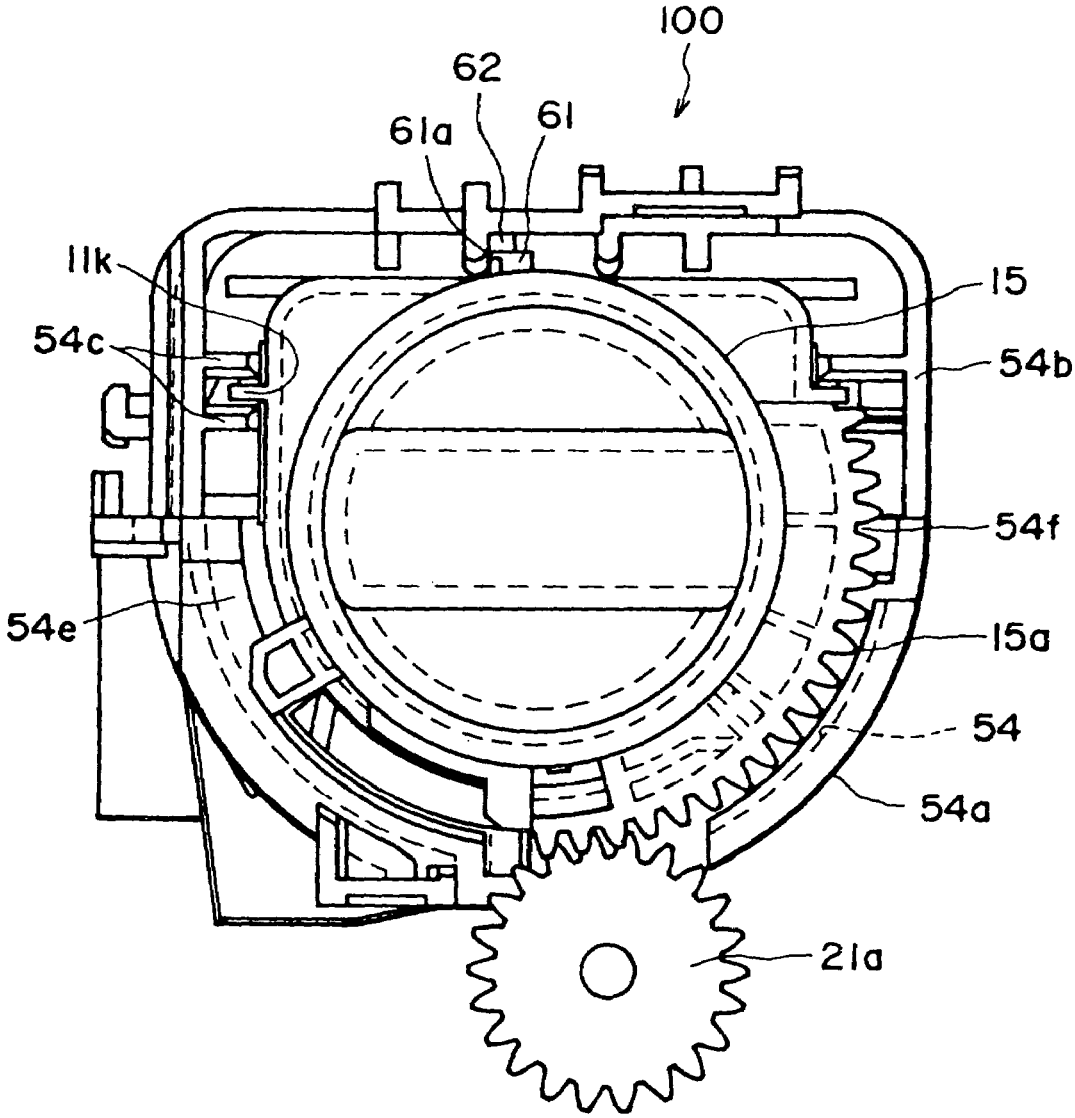
FIG. 33 is a front view of the toner supplying apparatus, and depicts one of the steps in which the toner supply container is installed into the toner supplying apparatus.

Then, as the handle 15 is pushed in the installing direction, the projection 51*d*1 provided on the engagement rib 51*d* comes in contact with the striking surface 54*e* of the toner supplying apparatus main assembly 54, and at the same time, the latch 51*e* comes in contact with the contact surface 54*f*, as shown in FIG. 8 (FIGS. 37 and 33). Then, as the handle 15 is pushed in further, the handle 15, first flange 12, toner containing portion 11, second flange 13, and the like, advance together in the same direction indicated by the arrow mark in FIG. 7, and causes the locking projection 12*h* of the first flange 12 to move out of the notch 1*b* as shown in FIG. 8. In other words, the handles 15 is unlocked from the toner containing portion 11, being allowed to rotate.

Therefore, the handle 15 can be rotated clockwise as seen from the upstream side in terms of the toner supply container 1 installing direction (arrow direction in FIG. 8). Then, as the handle 15 is rotated, the locking member 51 rotates together with the handle 15, and immediately, the latch 51*e* engages into the groove 54*g* integrally provided in the strike surface 54*f* of the bottom portion 54*a* of the toner supplying apparatus main assembly 54 (FIGS. 39 and 40). This groove 54*g* extends in the circumferential direction on the cylindrical wall of the bottom portion 54*a* of the toner supplying apparatus main assembly 54, forming an arc. After engaging into the groove 54*g*, the latch 51*e* remains in the groove 54*g* when the toner outlet 11*a* and main assembly shutter 34 are opened or closed. Therefore, while the toner supplying operation is carried out after the installation of the toner supply container 1 into the toner supplying apparatus 100, the toner supply container 1 cannot be simply pulled out of the toner supplying apparatus 100. In other words, the toner supply container 1 can be removed from the toner supplying apparatus 100 only when the container shutter 16 and main assembly shutter 34 are closed, because the latch 51*e* is allowed to come out of the arc-like groove only when the container shutter 16 and main assembly shutter 34 are closed.

Regarding this locking mechanism, if the number of the lock releasing projection is only one, moment and/or deformation occurs to the locking member 51, preventing the locking member 51 from smoothly sliding. Further, even if the number of the lock releasing projection is plural, if they are unevenly distributed, the same problem occurs. Therefore, it is desired that a plurality of lock releasing projections are distributed in the circumferential direction with as even as possible intervals. In this embodiment, two projections are provided, being apart from each other by approximately 180 deg. In this embodiment, the latch 51*e* functions also as a lock releasing projection, the angle formed by the radial line connecting the projection 51*d*1 and the center of the locking member 51 and the radial line connecting the latch 51*e* and the center of the locking member 51 is approximately 150 deg.

Next, referring to FIG. 38, the lock releasing timing of the locking member 51 will be described. The locking projection 12*h* for regulating the angle the locking member rotates is provided with a projection 12*h*1, which projects from the outwardly facing surface of the locking projection 12*h* in the radial direction of the locking member 51, and is enabled to engage with the handle 15. The angle B the handle 15 rotates from the position at which the projection 12*h* is engaged in the notch 51*b* to the position at which the projection 12*h*1 contacts one of the groove walls 15*n* of the groove 15*m* of the engagement rib, is approximately 90 deg. As stated before, the groove 15*m* is the groove in which the engagement rib 51*d* (on the side where the latch 51*e* is located) of the handle 15. As for the relationship between the notch 51*b* of the locking member 51 and the locking projection 12*h*, the notch 51*b* is made wide enough in terms of its central angle A so that a play of 6 deg. is afforded for the handle 15 in terms of its circumferential direction.

In order to exchange the toner supply container 1 with a fresh one after the toner in the toner supply container 1 was depleted, the handle 15 must be turned to its original position by turning it in the direction opposite to the direction in which the handle 51 is turned during the installation of the toner supply container 1 (counterclockwise as seen from the upstream side in terms of the direction in which the toner supply container 1 is inserted into the toner supplying apparatus 100). With this action, the latch 51*e* becomes disengaged from the arc-shaped groove 51*e*, and the locking member 51 slides back, on the locking member engagement portion 12*g*, to its original position, i.e., the position at which the locking projection 12*h* remains engaged in the notch 51*b* of the ring portion 51*a* of the locking member 51, due to the resiliency of the springy portion 51*c*.

As stated before, because the locking member 51 is under the pressure generated by the springy portion 51*c* in the direction of the toner containing portion 11, it slides in the direction to cause the aforementioned locking projection 12*h* and the notch 51*b* of the locking member 51 to engage with each other, and lock the handle 51.

(Toner Supplying Operation)

Next, a toner supplying operation which employs a toner supply container 1 in this embodiment will be described in general terms.

(1) Installation of Toner Supply Container 1

First, the lid 121 with which the apparatus main assembly 124 is provided is opened by 90 deg. toward an operator. Then, the guide portion 11*k* of the toner supply container 1 is engaged into the groove 54*h* (FIG. 11) between the projections 54*c* of the toner supplying apparatus 100. Then, the toner supply container 1 is inserted into the toner supplying apparatus 100 from the side where the coupling 26*a* is provided. With this action, first, the container shutter 16 of the toner supply container 1 and the main assembly shutter 34 within the toner supplying apparatus 100 engage with each other. Next, the driving force transmitting engaging portion 21*g* and the driving force receiving engaging portion 16*d* of the container shutter 16 engage with each other. Lastly, the driving force receiving engaging portion 21*a* on the toner supplying apparatus 100 side and the driving force transmitting engaging portion 15*a* of the handle 15 engage with each other.

(2) Positioning of Toner Supply Container and Supplying of Toner

With the toner supply container 1 being in the toner supplying apparatus 100, as an operator manually rotates the handle 15 by 90 deg. in the clockwise direction (handle 15 will be moved to the third position), the rotational driving force, i.e., the force applied by the operator, is transmitted from the driving force transmitting engaging portion 15*a* of the handle 15, as a driving force transmitting portion, to the driving force transmitting member 21, as a rotational force transmitting portion, through the driving force receiving engaging portion 21*a* of the toner supplying apparatus 100. Then, this force is further transmitted from the driving force transmitting engaging portion 21*g* to the driving force receiving engaging portion 16*d*, as a rotational force receiving portion, of the container shutter 16. By the driving force transmitted in the above described manner, the container shutter 16 is slid in the circumferential direction of the toner containing portion 11 while engaging with the shutter supporting member 11*e* of the toner containing portion 11. During this sliding movement of the container shutter 16, the main assembly shutter 34 moves with the container shutter 16. Therefore, the toner outlet 11*a* of the tone containing portion 11, the opening 34*d* of the main assembly shutter 34, and the toner inlet 33 in the toner supplying apparatus 100, are all opened at the same time. Then, toner supplying is started by rotating the toner conveying member 29 through the coupling 26*a* which receives the driving force from the coupling 44 of the apparatus main assembly 124.

During the above described operation, the toner containing portion 11 does not rotate. Therefore, the toner supply container 1 does not rotate with the handle 15; it remains fixed in the toner supplying apparatus 100.

(3) Removal of Toner Supply Container

An operator rotates the handle 15 by 90 deg. in the counterclockwise direction. With this action, driving force different in direction from the driving force applied during the installation (2) of toner cartridge is transmitted in the same order as in the installation of the toner supply closes the toner outlet 11*a*, and the main assembly shutter 34 closes the opening 34*d* of the main assembly shutter 34 and the toner inlet 33, to complete the toner replenishment sequence.

The toner supply container 1 is installed into the toner supplying apparatus 100 from the coupling 26*a* side. This requires that the engaging portion 16*d* of the container shutter 16 passes by the engaging portion 21*a* of the apparatus main assembly 124, and engages with the engaging portion 21*g*, i.e., the inward one, of the apparatus main assembly 124. Therefore, the diameter of the theoretical circle which connects the tips of the teeth of the engaging portion 16*d* in the form of a segment gear is desired to be smaller than the diameter of the theoretical circle which connects the bases of the teeth of the engaging portion 15*a* in the form of a segment gear.

With the provision of the above described structure, a toner containing portion is not required to move during the toner supplying sequence. Therefore, there is no restriction regarding the shape of a toner containing portion. Therefore, a shape which offers the highest spatial efficiency to a toner containing portion may be employed as the shape for a toner containing portion. In addition, a shutter and a handle are made into two separate components. Therefore, it is unnecessary for a toner outlet to be next to a handle. Therefore, more latitude can be afforded in designing a toner supply container.

Further, in the case of the toner supply container in this embodiment, the driving force applied to the handle is transmitted to the driving force receiving engaging portion of the shutter through a plurality of engaging portions: the engaging portion of the handle, the engaging portion of the driving force transmitting member, and the engaging portion of the shutter. Therefore, it is possible to more freely design these engaging portion in terms of engagement ratio (gear ratio).

Thus, when the distance the shutter is slid to be opened or closed is long, the angle by which the handle must be rotated can be reduced by increasing the engagement ratio (gear ratio) of the handle, and when the torque required to open or close the shutter is high, the torque required to operate (rotate) the handle can be reduced by reducing the engagement ratio (gear ratio) of the handle.

Also in this embodiment, the angle by which the handle is rotated to open or close the shutter is made to be 90 deg., so that when installing the toner supply container into the toner supplying apparatus, the thick end 15*e* is vertically positioned, and after the toner is discharged by rotating the handle clockwise by 90 deg., the thick end 15*e* of the handle 15 is horizontally positioned. This arrangement makes it easier for an operator to operate the toner supply container, and also to recognize the state of the toner supply container 1. For operational efficiency and convenience, the angle by which the handle 15 is rotated to open or close the shutter is desired to be in a range of 60-120 deg.

(Toner Stirring-Conveying Apparatus)

The toner supplying apparatus 100 is provided with the toner stirring-conveying apparatus 45. Referring to FIGS. 11 and 12, the toner supplying apparatus 100 is also provided with the case 48, which is fixed to the toner supplying apparatus main assembly 54 in a manner to cover the toner inlet 33 from below. The case 48 is approximately the same as the toner supplying apparatus 100 in the longitudinal dimension. In the case 48, the stirring screws 46 and 47 are disposed, being supported by the case 48 so that they can be rotationally driven.

The stirring screws 46 and 47 are separated by a partition wall 48*a* which divides the internal space of the case 48 into two chambers 48A and 48B, which are connected to each other through the hole provided in the partition wall 48*a* on the side opposite to the toner inlet 33, and in which the stirring screws 46 and 47 are disposed, respectively, the stirring screw 46 being diagonally above the stirring screw 47. The case 48 is provided with a toner outlet 48*b*, which is located at the same longitudinal end as the toner inlet 33, and leads to the developing apparatus 201.

With the provision of the above structural arrangement, as the toner is supplied through the toner inlet 33, the rotating toner stirring screw 46 conveys the toner, while stirring, through the chamber 48A in the longitudinal direction from the toner inlet 33 side to the opposite side, causing the toner to fall into the chamber 48B through the opening (unillustrated) provided in the partition wall 48*a*. The toner stirring screw 47, i.e., the one at the bottom, conveys, while stirring, the toner in the direction opposite to the toner conveying direction of the toner stirring crew 46. As a result, the toner is supplied into the developing apparatus 201 through the toner outlet 48B.

(Precise Positioning Means)

If cost is spared in producing a toner supply container and components related thereto, in other words, if highly precise components are not used for the production of a toner supply container and the related components, it is inevitable that the drive train, i.e., the driving force transmitting juncture from the rotatable handle to the shutter, suffers from an excessive amount of play and/or deformation which results in, for example, the gear backlash or the like. With the presence of such a large amount of play and/or deformation, the output stroke of the drive train does not correspond to the input stroke one to one. Therefore, there occurs sometimes such a condition that after the shutter is opened, it fails to come back all the way to its original position. If the toner supply container, the shutter of which is in this condition, is removed once from the apparatus main assembly, and reinstalled into the apparatus main assembly, the distance between the final position of the shutter of the toner supply container after the closing stroke, and the original position becomes greater than that in the previous installation. In other words, the distance continues to increase with the repetition of the installation and removal.

In the case of the above described design, according to which the main assembly shutter and container shutter are integrally engaged with each other, shutter misalignment such as the one described above makes it impossible to remove the toner supply container from the apparatus main assembly, or to install a fresh toner supply container (shutter is at its original position) into the apparatus main assembly, which is a serious problem.

This problem can be solved by providing a toner supply container and the related structure of the apparatus main assembly with such a feature that requires that when installing a toner supply container, the handle is rotated in the opening direction of the shutter by a predetermined angle, in addition to the theoretically necessary angle, before the handle and shutter begin to engage with the driving train gears on the apparatus main assembly side, and when removing the toner supply container, the handle is rotated in the closing direction of the shutter by the aforementioned predetermined angle, in addition to the theoretically necessary angle. This feature compensates for the additional length of stroke which the gear backlash or the like resulting from the excessive play requires, assuring that the shutters are returned to their original positions.

Next, a means for providing the above described feature will be described in detail.

Figure 41:
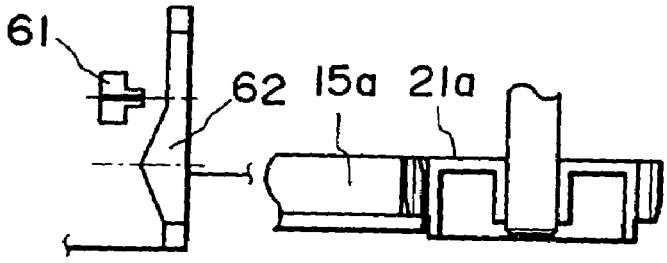
FIG. 41 is a schematic drawing which depicts the function of the means for always pre-rotating or rotating the rotational member to a predetermined position.
Figure 42:
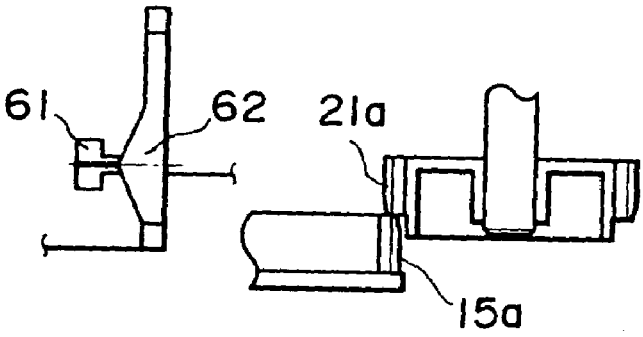
FIG. 42 is also a schematic drawing which depicts the function of the means for always pre-rotating or rotating the rotational member to the predetermined position.
Figure 43:
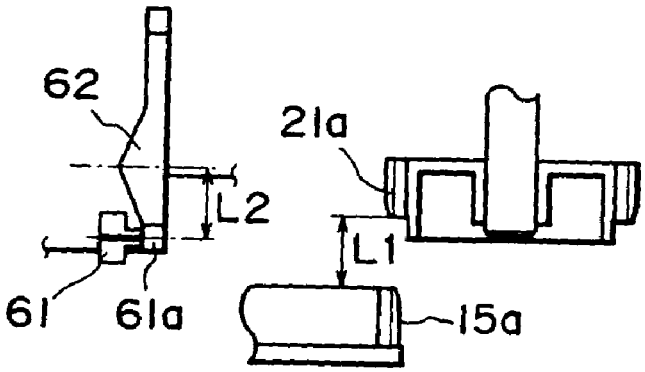
FIG. 43 is also a schematic drawing which depicts the function of the means for always pre-rotating or rotating the rotational member to the predetermined position.

Referring to FIGS. 1, 2, 33 and 34, the handle 15 is provided with a handle projection 61, as a contact portion, which is located on the outwardly facing surface of the handle 15. Referring to FIGS. 41-43, which are a schematic plan of the handle projection 61 and its adjacencies as seen from above, the handle projection 61 is shaped like a cam follower, and its portion with a contact surface 61*a* is narrower than the base portion in terms of the vertical direction in FIGS. 41-43. It is positioned to come in contact with the main assembly projection 62 provided on the inwardly facing surface of the top plate of the bottom portion 54*b* of the toner supplying apparatus main assembly 54. The projections 61 and 62 work in combination as a follower and a cam, respectively.

The cam portion of the main assembly projection 62 is angled in profile. The lift of this cam surface is just enough to make the center angle of the cam portion of the main assembly projection 62, that is, the angle formed by the line connecting the highest point of the cam surface and the center of the toner supplying apparatus main assembly 54 (center of the semicylindrical bottom portion 54*a*), and the line connecting the base of the cam surface and the center of the toner supplying apparatus main assembly 54, large enough to compensate for the play in the rotational direction between the toner supply container 1 and toner supplying apparatus 100. This center angle is no less than 6 deg. In this embodiment, it is 6 deg.

Next, the handle projection 61 and main assembly projection 62 will be described in positional relationship and function. Referring to FIGS. 33 and 43, as the toner supply container 1 is inserted into the toner supplying apparatus 100, the handle projection 61 reaches a point at which it comes in contact with the main assembly projection 62, on the cam surface, at the point with no lift. In this state, the driving force transmitting engaging portion 15*a* of the handle 15 and the driving force receiving engaging portion 21*a* on the main assembly side are apart from each other by a distance L1, which is equal to a distance L2 by which the handle projection 61 in this state must be moved to receive the highest lift.

Figure 34:
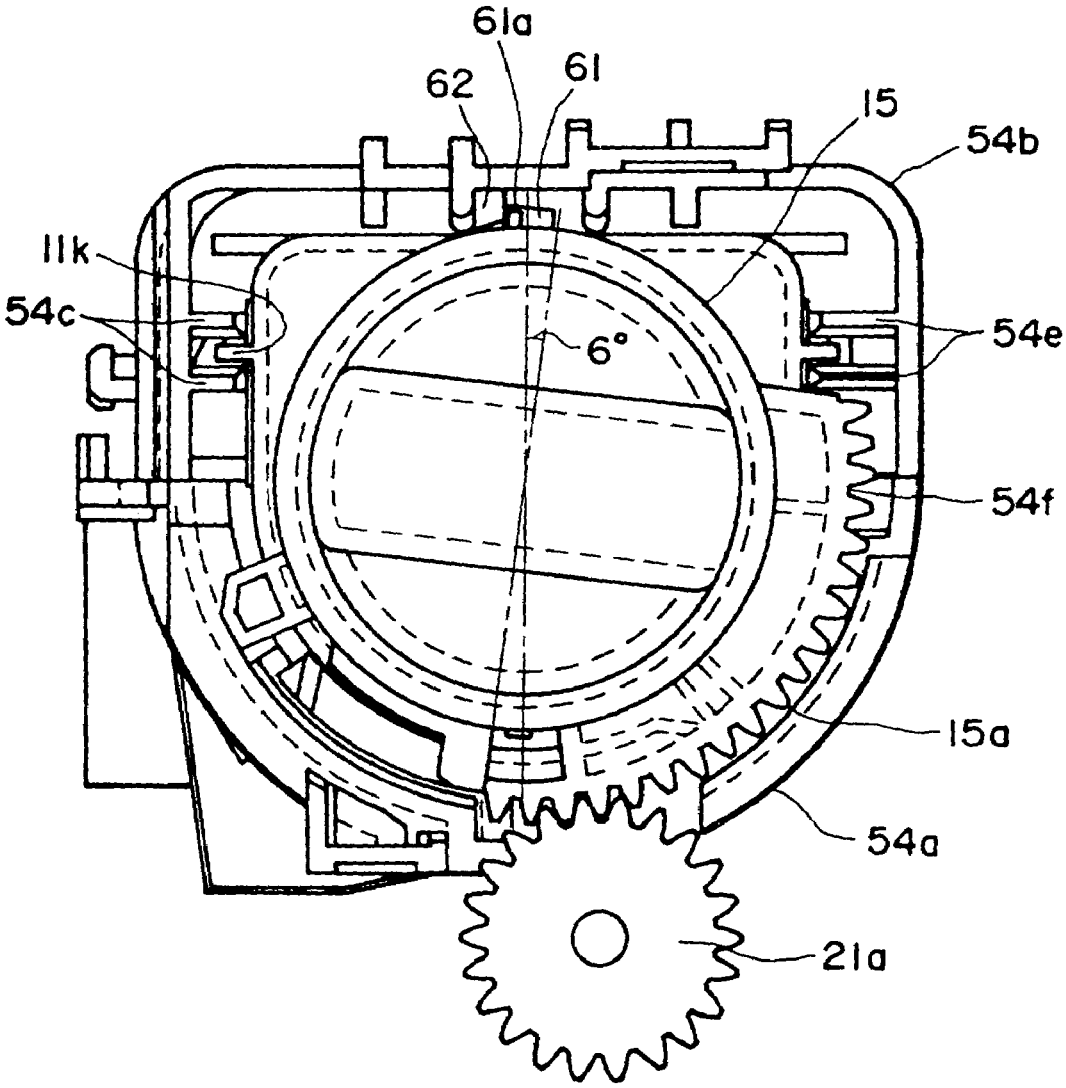
FIG. 34 is a front view of the toner supplying apparatus, and depicts one of the steps in which the toner supply container is installed into the toner supplying apparatus.
Figure 35:
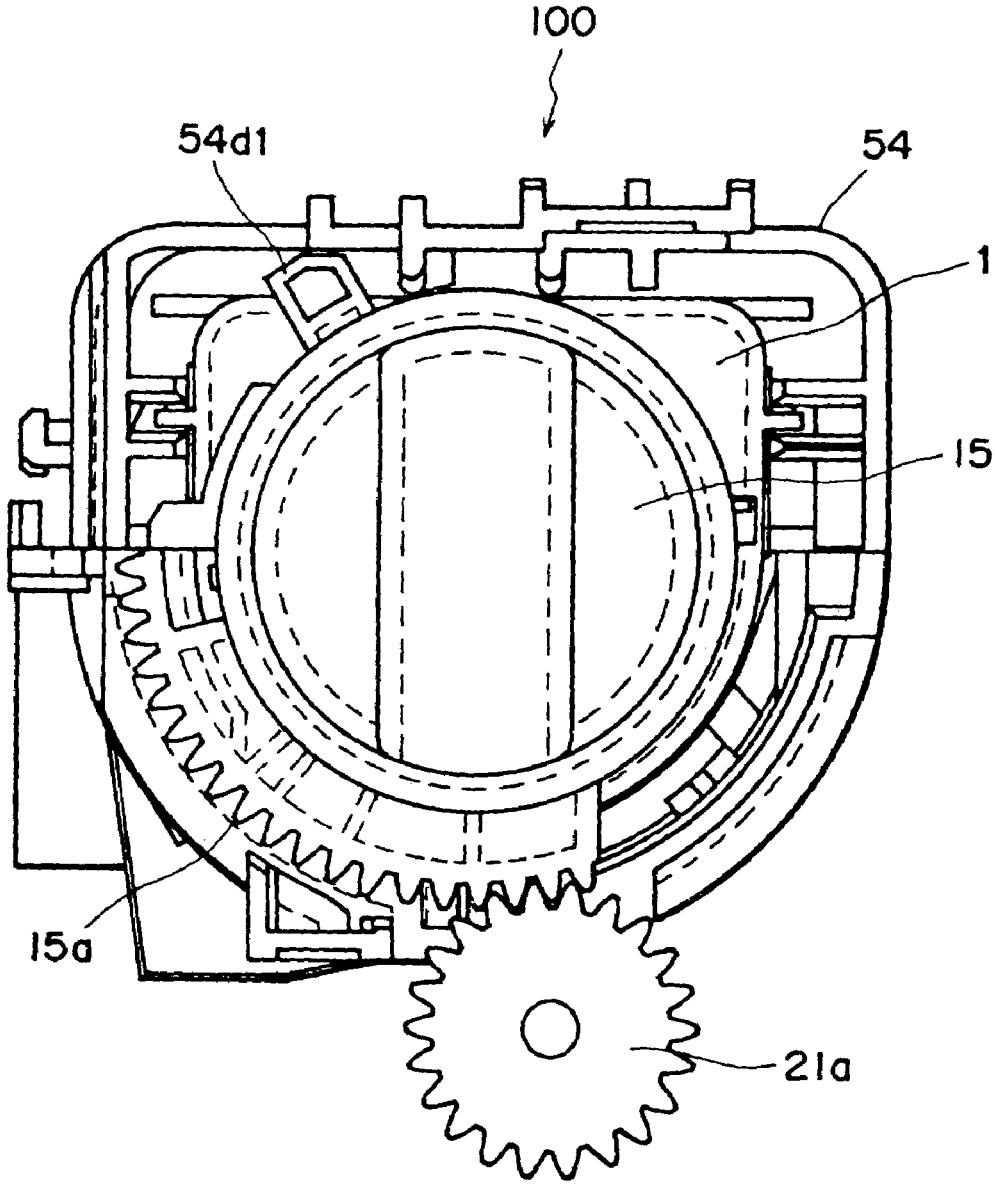
FIG. 35 is a front view of the toner supplying apparatus, and depicts one of the steps in which the toner supply container is installed into the toner supplying apparatus.

As the toner supply container 1 is further inserted into the toner supplying apparatus 100 from the point (handle is at the first rotational position) illustrated in FIGS. 33 and 43, the handle projection 61 slides on the main assembly projection 62 while rotating the handle 15. By the time the handle projection 61 slides to the cam crest of the main assembly projection 62, the handle 15 is rotated by 6 deg. The tooth tips of the engaging portion 15*a* of the handle 15 come in contact with the counterparts of the engaging portion 21*a* of the toner supplying apparatus 100 at the same time the handle projection 61 reaches the cam crest of the main assembly projection 62. In other words, at the moment the engaging portion 15*a* engages with the engaging portion 21*a*, the handle 15 is always at the second rotational position as shown in FIGS. 34 and 42. The tooth tips of the engaging portion 16*d* of the container shutter 16 come in contact with the counterparts of the engaging portion 21*g* on the main assembly side slightly before the contact between the engaging portions 15*a* and 21*a* by their tooth tips. In other words, the engagement of the engaging portion 16*d* of the container shutter 16 with the engaging portion 21*g* on the main assembly side occurs slightly ahead of the engagement of the engaging portion 15*a* of the handle 15 with the engaging portion 21*a* of the toner supplying apparatus 100.

Referring to FIG. 41, as the toner supply container 1 is further inserted into the toner supplying apparatus 100, the driving force transmitting engaging portion 15*a* of the handle 15 and the driving force receiving engaging portion 21*a* of the toner supplying apparatus 100 mesh with each other. On the other hand, the driving force receiving engaging portion 16*d* of the container shutter 16 meshes with the driving force transmitting engaging portion 21*g* illustrated in FIG. 10, across the entire ranges of their teeth. Therefore, while the toner supply container 1 moves from the position illustrated in FIG. 42 to the position illustrated in FIG. 41, the handle 15 does not rotate, and the handle projection 61 remains at the floating position a shown in FIG. 41, which corresponds to the cam crest of the main assembly projection 62. In other words, the handle 15 is led to the second rotational position illustrated in FIG. 34, regardless of the positional relationship between the handle 15 and toner containing portion 11 during the period in which the toner supply container 1 is not in the main assembly of the image forming apparatus.

As the handle projection 61 is displaced by the main assembly projection 62 as described above, the handle 15 rotates by 6 deg. Therefore, a certain amount of play is provided between the mutually facing surfaces of he handle 15 and first flange 12. More specifically, referring to FIGS. 7 and 8, when the toner supply container 1 is not in the main assembly of the image forming apparatus, a play large enough to allow the handle 15 to rotate by 6 deg. is provided in the circumferential direction of the handle 15 between the side surfaces of the notch 51*b* of the locking member 51, and the locking projection 12*h* of the first flange 12, and also between the surfaces of the grooves 15*k* and 15*m*, and the corresponding engagement ribs 51*d* of first flange 12.

Further, in order to make the container shutter 16 engage with the main assembly shutter 34 at a predetermined position before the handle 15 is rotated by the handle projection 61 and main assembly projection 62, the bottom portion 54*a* of the toner supplying apparatus main assembly 54 is provided with a positioning projection 63, which is located on the inwardly facing surface of the bottom portion 54*a*, and against which the end surface of the container shutter 16, on the leading side in terms of the installing direction of the toner supply container 1, slides, as shown in FIGS. 39 and 40. This projection 63 has a cam surface which is angled in profile, and the position of the cam crest of this projection 63 corresponds to the timing with which one of the mutually facing surfaces 34*b*1 of the indentation of the main assembly shutter 34, in which the container shutter 16 fits, comes to a predetermined point.

As the toner supply container 1 is inserted into the toner supplying apparatus 100, the chamfer surface 16*q* of the container shutter 16 comes in contact with the projection 63. As a result, the container shutter 16 is controlled in its positional relationship relative to the main assembly shutter 34 in the circumferential direction of the toner supply container 1. Then, as the toner supply container 1 is further inserted into the toner supplying apparatus 100, the longitudinal edge 16*r*1 of the container shutter 16, connected to the chamfer surface 16*q*, slides against the projection 63 while the container shutter 16 fits into the indentation of the main assembly shutter 34. During this movement of the container shutter 16, the chamfer surface 16*p* of the container shutter 16, on the opposite side of the container shutter 16, comes in contact with the chamfered surface 34*b*2 located at the corner of the projection 34*b*, on the corresponding side, of the main assembly shutter 34, also controlling the container shutter 16 in its positional relationship relative to the main assembly shutter 34. As the toner supply container 1 is further inserted, the chamfered surface 16*q* engages with the chamfered surface 34*b*3 of the main assembly shutter 34, and thereafter, the container shutter 16 advances into the indentation (space) between the mutually facing surfaces 34*b*1 of the projections 34*b* of the main assembly shutter 34. Then, as the container shutter 16 advances into the indentation of the main assembly shutter 34 to a point illustrated in FIG. 39, the engaging portions 15*a* and 16*d* on the toner supply container 1 side begin to mesh with the engaging portions 21*a* and 21*g* on the toner supplying apparatus 100 side. As the corresponding engaging portions mesh with each other by a predetermined margin in terms of the width direction of the gears, the positional relationship between the container shutter 16 and main assembly shutter 34 becomes as shown in FIG. 40. In this state, the chamfer surface 16*s* at the upstream end, in terms of the advancing direction of the container shutter 16 relative to the main assembly shutter 34, of the longitudinal edge 16*r* on the container shutter 16 sides has separated from the projection 63.

During the above described process, the resistance against the movement of the container shutter 16 for opening or closing the toner outlet of the toner containing portion 11 is large enough in comparison to the resistance against the opening or closing of the main assembly shutter 34, because the container shutter 16 is under the pressure generated by the packing member 35. Therefore, the projection 63 regulates the position of the container shutter 16, and the container surface 16 regulates the position of the main assembly shutter 34.

With the provision of the above described structure and its functions, the positions of the main assembly shutter 34 and container shutter 16 are always the same after their engagement. In this state, as a user rotates the handle 15 by 84 deg. in the clockwise direction as seen from the upstream side of the direction in which the toner supply container 1 is inserted in the toner supplying apparatus 100, both shutters 16 and 34 rotate 50 deg. in their opening direction; they fully open.

When removing the toner supply container 1 from the toner supplying apparatus 100, a user is required to rotate the handle 15 by 90 deg. in the counterclockwise direction, i.e., the direction opposite to the aforementioned direction. As the handle 15 is rotated, the both shutters 16 and 34 rotate by 50 deg. in their closing direction to their original positions.

As described above, the relations among the rotational angle of the handle 15 during the opening of the shutters 15 and 34, the rotational angle of the handle 15 during the closing of the shutters 15 and 34, the rotational angles of the shutters 16 and 34 during the closing of the shutters 16 and 34, and the rotational angles of the shutters 16 and 34 during the closing of the shutters 16 and 34, do not exactly correspond. This discrepancy occurs because the toner supply container rotates relative to the toner supplying apparatus due to the aforementioned gear backlash, deformation or bending of the handle, shutters, and shafts, and the like. Therefore, the shutters can be returned to their original positions by causing the rotational member 15 to rotate by 6 deg. to compensate for the backlash and/or deformation before the handle is turned for installation.

Also when pulling the toner supply container 1 out of the toner supplying apparatus 100, the handle 15 is pre-rotated by 6 deg. in the opening direction, as when installing the toner supply container 1, by the engagement of the handle projection 16 and the main assembly projection 62, to prepare the toner supply container 1 for the next usage. Should an attempt be made to pulled out the toner supply container 1 without rotating the handle 15 by 90 deg. in the counterclockwise direction (for example, rotating by only 80 deg.), it is possible that the container shutter 16 and main assembly shutter 34 might not return to their original positions. In the case of this embodiment, however, as the toner supply container 1 is pulled, the chamfered surface 16*s* of the container shutter 16 engages with the projection 63 of the toner supplying apparatus 100, and forces the container shutter 16 and main assembly shutter 34 back to their original positions. Therefore, the aforementioned inconvenience can be avoided.

The above described embodiments of the present invention may be summarized and amended as follows.

According to the first aspect of the present invention, the toner supply container 1 for supplying the main assembly 124 of an electrophotographic image forming apparatus with toner is characterized in that it comprises: the toner containing portion 11, that is, the very portion in which the toner to be supplied to the electrophotographic image forming apparatus main assembly 124 is contained; the toner outlet 11*a* with which the toner containing portion 11 is provided to discharge the toner contained in the toner containing portion 11; and the container shutter 16 for exposing or sealing the toner outlet 11*a*, which engages with the main assembly shutter 34 provided with the opening 33 for exposing or sealing the toner inlet 33 of the electrophotographic image forming apparatus main assembly 124, to expose or seal the toner outlet 11*a* and toner inlet 33 at the same time; the handle 15, that is, a rotational member, which is provided with the driving force transmitting engaging portion 15*a* as a driving force transmitting portion, and is rotatably attached to the toner containing portion 11; the engaging portion 16*d*, which is a part of the container shutter 16, as the rotational force receiving portion for receiving the rotational force generated by the rotation of the rotational member, or the handle 15, through the rotational force transmitting means 21, with which the electrophotographic image forming apparatus main assembly 124 is provided, to expose the toner outlet 11*a* as the rotational member, or the handle 15, is rotated as the toner supply container 1 is installed into the electrophotographic image forming apparatus main assembly 124: wherein a certain amount of play in terms the opening direction of the container shutter 16 is provided between the rotational member 15 and the toner containing portion 11; the rotational member, or the handle 15, is provided with the projection 61, that is, a follower portion, which engages with the electrophotographic image forming apparatus main assembly 124 so that the rotational member, or the handle 15, is rotated by a predetermined angle in the opening direction of the container shutter 16 to cancel the aforementioned play to cause the driving force transmitting engaging portion 15*a* of the rotational member 15 to engage with the rotational force transmitting member 21 always at the predetermined same position, as the toner supply container 1 is installed into the electrophotographic image forming apparatus main assembly 124.

According to the second aspect of the present invention, when the shutters are closed, the rotational member, or the handle 15, is rotated by a sufficient angle to compensate for the aforementioned predetermined angle, the rotational member 15 is pre-rotated in the opening direction during the installation of the toner supply container 1.

According to the third aspect of the present invention, which is in accordance with the first and second aspects of the present invention, the angle by which the rotational member 15 is prerotated in the opening direction during the installation equals the angle by which the rotational member 15 is rotated during the removal of the toner supply container 1.

According to the fourth aspect of the present invention, which is in accordance with the first aspect of the present invention, as the toner supply container 1 is pulled out of the electrophotographic image forming apparatus main assembly 124, the projection 61, which is a part of the rotational member 15, is caused to engage with the projection 62 on the side of the electrophotographic image forming apparatus main assembly 124, so that the rotational member 15 is rotated in the opening direction to the point to which the rotational member 15 was pre-rotated as the toner supply container 1 was installed into the electrophotographic image forming apparatus main assembly 124.

According to the fifth aspect of the present invention, which is in accordance with the first aspect of the present invention, the pre-rotation of the rotational member 15 in the opening direction during the installation of the toner supply container 1, and the rotation of the rotational member 15 in the closing direction to the predetermined position to which the rotational member is moved during the installation, are caused by the engagement between the same two members, that is, the projections 61 and 62.

According to the sixth aspect of the present invention, which is in accordance with any of the first to fifth aspects of the present invention, the toner supply container 1 is provided with the locking member 51 and locking projection 12*h*, which regulate the rotation of the rotational member 15 when the toner supply container 1 is not in the electrophotographic image forming apparatus main assembly 124, and the regulating means provides the rotational member 15 with a predetermined amount of rotational play.

According to the seventh aspect of the present invention, which is in accordance with the first aspect of the present invention, the regulating means comprises the locking member 51.

According to the eighth aspect of the present invention, which is in accordance with the seventh aspect of the present invention, the regulating means regulates the rotation of the rotational member 15 by the engagement between the notch 51*b* of the locking member 51, and the projection 12*h* of the toner containing portion 11.

According to the ninth aspect of the present invention, which is in accordance with the eighth aspect of the present invention, the width of the notch 51*b* in terms of the rotational direction of the rotational member 15 is greater than the width of the projection 12*h* in terms of the rotational direction of the rotational member 15, and also the distance equivalent to the predetermined angle the rotational member 15 is pre-rotated.

According to the tenth aspect of the present invention, which is in accordance with the second aspect of the present invention, the means for pre-rotating the rotational member 15 by the aforementioned predetermined angle during the installation, and rotating, during the removal, the rotational member 15 back to the position to which the rotational member 15 is pre-rotated during the installation, comprises the projection 61 in the form of a cam follower, with which the rotational member 15 is provided, and the projection 62 in the form of a slightly angled cam, with which the electrophotographic image forming apparatus main assembly 124 is provided.

According to the eleventh aspect of the present invention, which is in accordance with the second aspect of the present invention, the means for pre-rotating the rotational member 15 to the predetermined position during the installation, and rotating, during the pulling out of the toner supply container 1, the rotational member 15 to the predetermined position to which the rotational member 15 is pre-rotated during the installation, comprises: the projection, with which the rotational member 15 is provided, and which is the same in terms of the angle of the contact surface as the projection 62 with which the apparatus main assembly 124 is provided; and an unillustrated groove with which the electrophotographic image forming apparatus main assembly 124 is provided, and in which the projection 62 perfectly fits, or the projection with which the handle 15 is provided, and which is the same as the projection 61.

According to the twelfth aspect of the present invention, which is in accordance with any of the first to eleventh aspects of the present invention, as the toner supply container 1 is installed into the electrophotographic image forming apparatus main assembly 124, the container shutter 16 and main assembly shutter 34 engage with each other, becoming virtually integrated, so that both the container shutter 16 and the main assembly shutter 34 are opened or closed together by the rotation of the rotational member 15. For this action, the driving force transmitting engaging portion 21*g* of the driving force transmitting member 21 provided on the apparatus main assembly 124 side is caused to mesh with the unillustrated segment gear provided on the main assembly shutter 34 side.

According to the thirteenth aspect of the present invention, an electrophotographic image forming apparatus for forming images on recording medium, in which the toner supply container is removably installable, comprises:

a. a toner supplying apparatus 100, in which the toner supply container 1 comprising: the toner containing portion 11, that is, the very portion in which the toner to be supplied to the electrophotographic image forming apparatus main assembly 124 is contained; the toner outlet 11*a* with which the toner containing portion 11 is provided to discharge the toner contained in the toner containing portion 11; and the container shutter 16 for exposing or sealing the toner outlet 11*a*, which engages with the main assembly shutter 34 provided with the opening 33 for exposing or sealing the toner inlet 33 of the electrophotographic image forming apparatus main assembly 124, to expose or seal the toner outlet 11*a* and toner inlet 33 at the same time; the handle 15, that is, a rotational member, which is provided with the driving force transmitting engaging portion 15*a* as a driving force transmitting portion, and is rotatably attached to the toner containing portion 11; the engaging portion 16*d*, which is a part of the container shutter 16 as the rotational force receiving portion for receiving the rotational force generated by the rotation of the rotational member, or the handle 15, through the rotational force transmitting means 21, with which the electrophotographic image forming apparatus main assembly 124 is provided, to expose the toner outlet 11*a* as the rotational member, or the handle 15, is rotated as the toner supply container 1 is installed into the electrophotographic image forming apparatus main assembly 124; wherein a certain amount of play in terms the opening direction of the container shutter 16 is provided between the rotational member 15 and the toner containing portion 11; the rotational member, or the handle 15, is provided with the projection 61, that is, a follower portion, which engages with the electrophotographic image forming apparatus main assembly 124 so that the rotational member, or the handle 15, is rotated by a predetermined angle in the opening direction of the container shutter 16 to cancel the aforementioned play to cause the driving force transmitting engaging portion 15*a* of the rotational member 15 to engage with the rotational force transmitting member 21 always at the predetermined same position, as the toner supply container 1 is installed into the electrophotographic image forming apparatus main assembly 124, is removably installed;

b. image forming means for forming images on the recording medium; and c. conveying means for conveying the recording medium.

While the invention has been described with reference to the structures disclosed herein, it is not confined to the details set forth and this application is intended to cover such modifications or changes as may come within the purposes of the improvements or the scope of the following claims.

What is claimed is:

1. A toner supply container detachably mountable to an image forming apparatus, said toner supply container comprising:

a container body for containing toner, said container body having an opening;

a shutter for closing and opening the opening;

a first gear portion provided in said shutter;

a rotational member manually rotatable relative to said container body in a first rotational direction and a second rotational direction opposite to the first rotational direction; and a second gear portion provided in said rotational member, wherein in a state in which said toner supply container is set to the image forming apparatus, a drive transmission path from said rotational member to said shutter is established by engagement of said first gear portion with a first gear member of a drive transmission mechanism provided in the image forming apparatus and engagement of said second gear portion with a second gear member of the drive transmission mechanism, and said shutter is movable toward an opening position by a rotation of said rotational member in the first rotational direction and is movable toward a closing position by a rotation of said rotational member in the second rotational direction, wherein said rotational member is contactable to a part of the image forming apparatus in a mounting operation of said toner supply container to the image forming apparatus and rotates in the first rotational direction to a predetermined first position with the mounting operation before the drive transmission path is established, wherein in a state in which said toner supply container is set to the image forming apparatus, when said rotational member is rotated in the second rotational direction to close said shutter, said rotational member is rotatable to a predetermined second position which is downstream of said first position with respect to the second rotational direction, wherein in a dismounting operation for dismounting said toner supply container from the image forming apparatus, the shutter of which is closed, said rotational member is rotatable in the first rotational direction from the second position to the first position before the drive transmission path is disconnected by said rotational member contacting a part of the image forming apparatus, and wherein said shutter is substantially non-movable toward the opening position when said rotational member is rotating from the second position to the first position in the dismounting operation.

2. A toner supply container according to claim 1, further comprising a locking member for locking said rotational member so as to allow a permissible predetermined amount of rotation, said locking member releasing said rotational member upon completion of the mounting operation of said toner supply container to the image forming apparatus.

3. A toner supply container according to claim 1, wherein said container body is mounted substantially non-rotatably to the image forming apparatus.

4. A toner supply container according to claim 1, wherein said shutter is disengageable with a main assembly shutter for opening and closing a toner receiving opening provided in the image forming apparatus, wherein said shutter and the main assembly shutter are movable integrally with each other.

5. An image forming apparatus comprising:

image forming means for forming a toner image on an image bearing member;

a container mounting and dismounting portion for mounting and dismounting a toner supply container containing toner;

a drive transmission mechanism including a second gear member for receiving a driving force and a first gear member for transmitting the driving force received from the second gear member to said toner supply container;

said toner supply container being detachably mountable to the container mounting and dismounting portion, said toner supply container including:

a container body for containing toner, said container body having an opening;

a shutter for closing and opening said opening;

a first gear portion provided in said shutter;

a rotational member manually rotatable relative to said container body in a first rotational direction and a second rotational direction opposite the first rotational direction; and a second gear portion provided in said rotational member, wherein in a state in which said toner supply container is set to the image forming apparatus, a drive transmission path from said rotational member to said shutter is established by engagement of said first gear portion with said first gear member and engagement of said second gear portion with said second gear member, and said shutter is movable toward an opening position by a rotation of said rotational member in the first rotational direction and is movable toward a closing position by a rotation of said rotational member in the second rotational direction, wherein said rotational member is contactable to a part of the image forming apparatus in a mounting operation of said toner supply container to the image forming apparatus and rotates in the first rotational direction to a predetermined first position with the mounting operation before the drive transmission path is established, wherein in a state in which said toner supply container is set to the image forming apparatus, when said rotational member is rotated in the second rotational direction to close said shutter, said rotational member is rotatable to a predetermined second position which is downstream of said first position with respect to the second rotational direction, wherein in a dismounting operation for dismounting said toner supply container from the image forming apparatus the shutter of which is closed, said rotational member is rotatable in the first rotational direction from the second position to the first position before the drive transmission path is disconnected by said rotational member contacting a part of the image forming apparatus, wherein said shutter is substantially non-movable toward the opening position when said rotational member is rotating from the second position to the first position in the dismounting operation.

6. An image forming apparatus according to claim 5, further comprising a locking member for locking said rotational member so as to allow a permissible predetermined amount of rotation, said locking member releasing said rotational member upon completion of the mounting operation of said toner supply container to the image forming apparatus.

7. An image forming apparatus according to claim 5, wherein said container body is mounted substantially non-rotatably to the image forming apparatus.

8. An image forming apparatus according to claim 5, further comprising a main assembly shutter, provided in the image forming apparatus, for opening and closing a toner receiving opening provided in the image forming apparatus, said main assembly shutter being engageable with said shutter, wherein said shutter and said main assembly shutter are movable integrally with each other.

* * * * *

UNITED STATES PATENT AND TRADEMARK OFFICE

CERTIFICATE OF CORRECTION

PATENT NO. : 7,292,811 B2
APPLICATION NO. : 10/700825
DATED : November 6, 2007
INVENTOR(S) : Yutaka Ban et al.

It is certified that error appears in the above-identified patent and that said Letters Patent is hereby corrected as shown below:

COLUMN 1:
Line 44, “above described” should read --above-described--.

COLUMN 7:
Line 33, “above” should read --above--; and
Line 65, “above described” should read --above-described--.

COLUMN 15:
Line 63, “resiliency o” should read --resiliency of--.

COLUMN 17:
Line 50, “above described” should read --above-described--; and
Line 58, “above described” should read --above-described--.

COLUMN 18:
Line 18, “rides” should read --ride--.

COLUMN 21:
Line 25, “and” should be deleted.

COLUMN 23:
Line 1, “above described” should read --above-described--;
Line 14, “above described” should read --above-described--; and
Line 39, “above described” should read --above-described--.

COLUMN 25:
Line 1, “above described” should read --above-described--;
Line 24, “above described” should read --above-described--.

COLUMN 27:
Line 45, “above described” should read --above-described--.

UNITED STATES PATENT AND TRADEMARK OFFICE

CERTIFICATE OF CORRECTION

PATENT NO. : 7,292,811 B2
APPLICATION NO. : 10/700825
DATED : November 6, 2007
INVENTOR(S) : Yutaka Ban et al.

It is certified that error appears in the above-identified patent and that said Letters Patent is hereby corrected as shown below:

COLUMN 28:

Line 25, "pulled" should read --pull--; and
Line 37, "above described" should read --above-described--.

Signed and Sealed this

Twenty-fourth Day of June, 2008

JON W. DUDAS
*Director of the United States Patent and Trademark Office*